US006726807B1

(12) United States Patent
Mathur

(10) Patent No.: US 6,726,807 B1
(45) Date of Patent: Apr. 27, 2004

(54) MULTI-PHASE CALCIUM SILICATE HYDRATES, METHODS FOR THEIR PREPARATION, AND IMPROVED PAPER AND PIGMENT PRODUCTS PRODUCED THEREWITH

(75) Inventor: Vijay K. Mathur, Federal Way, WA (US)

(73) Assignee: G.R. International, Inc. (A Washington Corporation), Federal Way, WA (US)

( * ) Notice: Subject to any disclaimer, the term of this patent is extended or adjusted under 35 U.S.C. 154(b) by 0 days.

(21) Appl. No.: 09/649,413

(22) Filed: Aug. 26, 2000

Related U.S. Application Data

(60) Provisional application No. 60/150,862, filed on Aug. 26, 1999.

(51) Int. Cl.[7] ..... D21H 17/68

(52) U.S. Cl. ..... 162/181.6

(58) Field of Search ..... 162/181.1, 181.6; 106/470

(56) References Cited

U.S. PATENT DOCUMENTS

| | | | |
|---|---|---|---|
| 1,574,363 | A | 2/1926 | Calvert |
| 1,851,413 | A | 3/1932 | Thomson |
| 1,942,989 | A | 1/1934 | Thomson |
| 2,204,113 | A | 6/1940 | Allen |
| 2,215,891 | A | 9/1940 | Thomson et al. |
| 2,215,892 | A | 9/1940 | Thompson et al. |
| 2,534,303 | A | 12/1950 | Serinis |
| 2,547,127 | A | 4/1951 | Kalousek |
| 2,665,996 | A | 1/1954 | Kalousek |
| 2,786,757 | A | 3/1957 | Taylor |
| 2,786,758 | A | 3/1957 | Taylor |
| 2,888,377 | A | 5/1959 | Allen |
| 2,935,437 | A | 5/1960 | Taylor |
| 2,943,970 | A | 7/1960 | Allen |
| 2,995,422 | A | 8/1961 | Atkinson et al. |
| 3,033,648 | A | 5/1962 | Vander Linden |
| 3,034,913 | A | 5/1962 | Gosta |
| 3,052,563 | A | 9/1962 | Vanderlinden |
| 3,131,024 | A | 4/1964 | Leineweber |
| 3,190,789 | A | 6/1965 | Taylor |
| 3,257,220 | A | 6/1966 | Kalousek et al. |
| 3,264,130 | A | 8/1966 | Mays |
| 3,352,746 | A | 11/1967 | Williams |
| 3,597,253 | A | 8/1971 | Beschke et al. |
| 3,660,021 | A | 5/1972 | Olmsted et al. |
| 3,679,446 | A | 7/1972 | Kubo |
| 3,804,652 | A | 4/1974 | Laidlier et al. |
| 3,806,585 | A | 4/1974 | Takahashi et al. |
| 3,816,149 | A | 6/1974 | Zettel |
| 3,835,216 | A | 9/1974 | Almagro et al. |
| 3,928,539 | A | 12/1975 | Satoh et al. |
| 3,998,650 | A | 12/1976 | Schmitt-Henco et al. |
| 4,026,721 | A | 5/1977 | Kurrie |
| 4,072,537 | A | 2/1978 | Kurrie |
| 4,117,191 | A | 9/1978 | Kurrie |
| 4,118,227 | A | 10/1978 | Shiohara et al. |
| 4,124,439 | A | 11/1978 | Dessauer |
| 4,162,924 | A | 7/1979 | Kubo et al. |
| 4,181,567 | A | 1/1980 | Riddel et al. |
| 4,243,429 | A | 1/1981 | Tamura et al. |
| 4,260,454 | A | 4/1981 | Wason et al. |
| 4,277,457 | A | 7/1981 | Taga et al. |
| 4,294,810 | A | 10/1981 | Teruo et al. |
| 4,298,386 | A | 11/1981 | Kubo et al. |
| 4,330,519 | A | 5/1982 | Takahashi et al. |
| 4,402,892 | A | 9/1983 | Helser |
| 4,422,880 | A | 12/1983 | Wason et al. |
| 4,432,804 | A | 2/1984 | Tamura et al. |
| 4,529,508 | A | 7/1985 | Pierce |
| 4,545,970 | A | 10/1985 | Krijgsman |
| 4,557,916 | A | 12/1985 | Withiam |
| 4,629,508 | A | 12/1986 | Cain, Jr. et al. |
| 4,668,300 | A | 5/1987 | Miller |
| 4,780,180 | A | 10/1988 | Take et al. |

(List continued on next page.)

FOREIGN PATENT DOCUMENTS

| | | | | |
|---|---|---|---|---|
| CA | 601124 | | 7/1960 | |
| CA | 601158 | | 7/1960 | |
| CA | 653797 | | 12/1962 | |
| CA | 656411 | * | 1/1963 | ..... 162/181.6 |
| CA | 666992 | | 7/1963 | |
| CA | 712964 | | 7/1965 | |
| CA | 712965 | | 7/1965 | |
| CA | 991826 | | 6/1976 | |
| CA | 1129575 | | 8/1982 | |
| DE | 2516097 | | 12/1975 | |
| DE | 3306528 A1 | | 7/1984 | |
| WO | 8402727 | * | 7/1984 | ..... 162/181.6 |

OTHER PUBLICATIONS

"The Water Content of Calcium Sillicate Hydrate (I)", Hydrafted Calcium Silicates, Taylor, Part V., 1953 (pp. 163–171).

"System Water Silica Calcium Oxide", Hydrothermal Syntheses and Equilibria, (p. 197–212).

"Mineral Powder Diffraction File", Data Book, International Center for Diffraction Data, 29–377 (4 pages).

*Primary Examiner*—Peter Chin
(74) *Attorney, Agent, or Firm*—R. Reams Goodloe, Jr.

(57) ABSTRACT

A method for the hydrothermal preparation of calcium silicate hydrates. Multi-phase calcium silicate hydrates, having unique physical and chemical properties, are prepared by hydrothermal reaction of specified ratios of CaO and SiO2, normally starting from slurries of slaked lime and from fluxed calcined diatomaceous earth, each of which is at about the atmospheric boiling point before being mixed and charged to a reactor, and pressurized. The hydrothermal reaction is carried out while maintaining the initial dilution for a preselected reaction time at a preselected reaction temperature. The calcium silicate hydrates produced have high water absorption and light scattering power, and have optical and physical properties making them highly desirable as a filler substitute in papermaking.

31 Claims, 38 Drawing Sheets

U.S. PATENT DOCUMENTS

Figure 1:
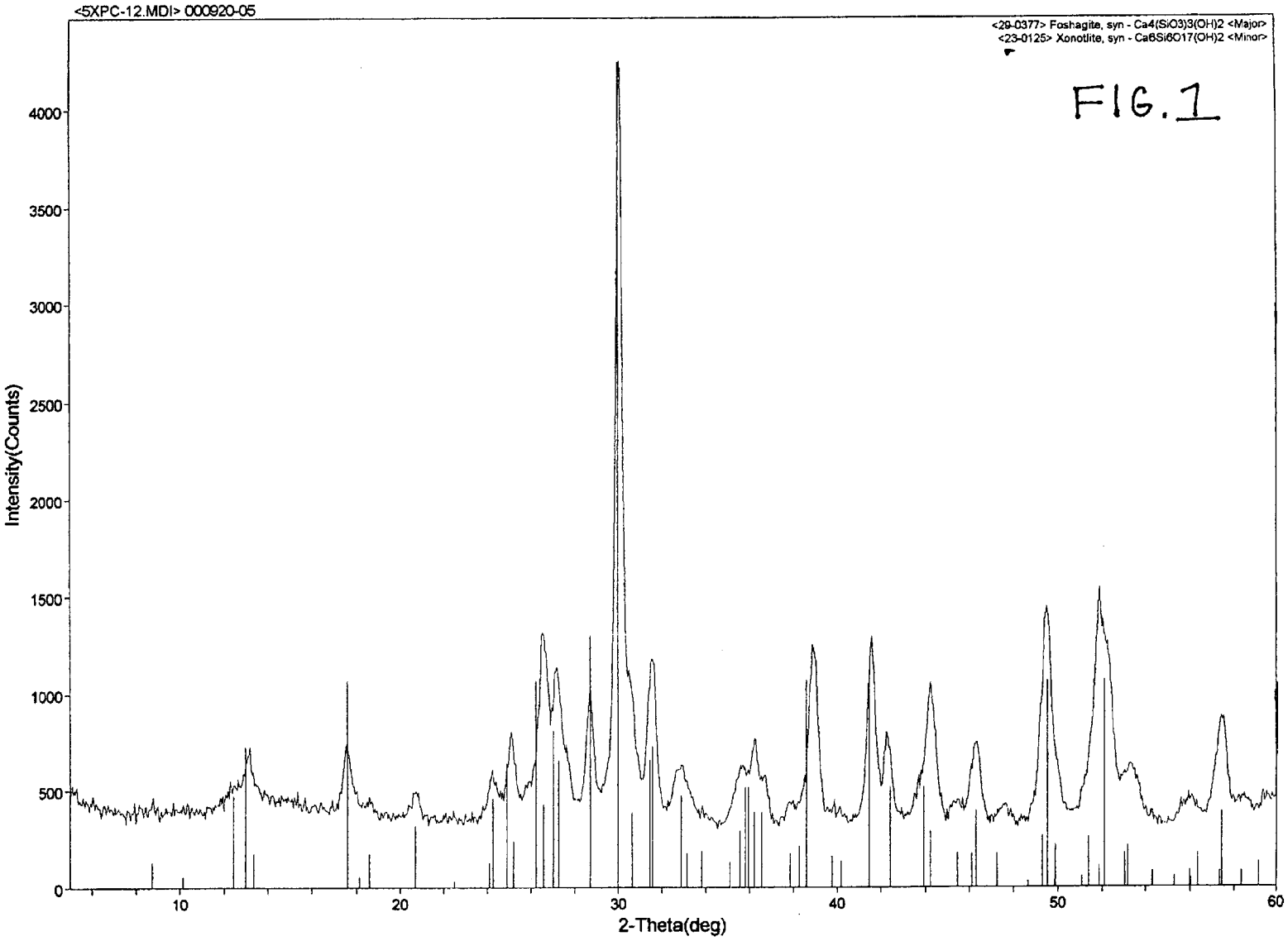

| | | | |
|---|---|---|---|
| 4,812,299 | A | 3/1989 | Wason |
| 4,853,351 | A | 8/1989 | Takashashi et al. |
| 4,965,452 | A | 10/1990 | Sturm |
| 5,098,520 | A | 3/1992 | Begala |
| 5,127,995 | A | 7/1992 | Wason |
| 5,279,663 | A | 1/1994 | Kaliski |
| 5,344,487 | A | 9/1994 | Whalen-Shaw |
| 5,352,287 | A | 10/1994 | Wason et al. |
| 5,370,852 | A | 12/1994 | Ikawa et al. |
| 5,591,256 | A | 1/1997 | Freeman et al. |
| 5,750,038 | A | 5/1998 | Tsunematsu et al. |
| 5,814,143 | A | 9/1998 | Freeman et al. |
| 5,916,420 | A | 6/1999 | Wurster et al. |
| 5,989,714 | A | 11/1999 | Drummond |
| 6,030,704 | A | 2/2000 | Wilshaw et al. |
| 6,413,373 | B1 | 7/2002 | Matsuda et al. |
| 2002/0040773 | A1 | 4/2002 | Matsuda et al. |

* cited by examiner

5XPC - 12 10,000x

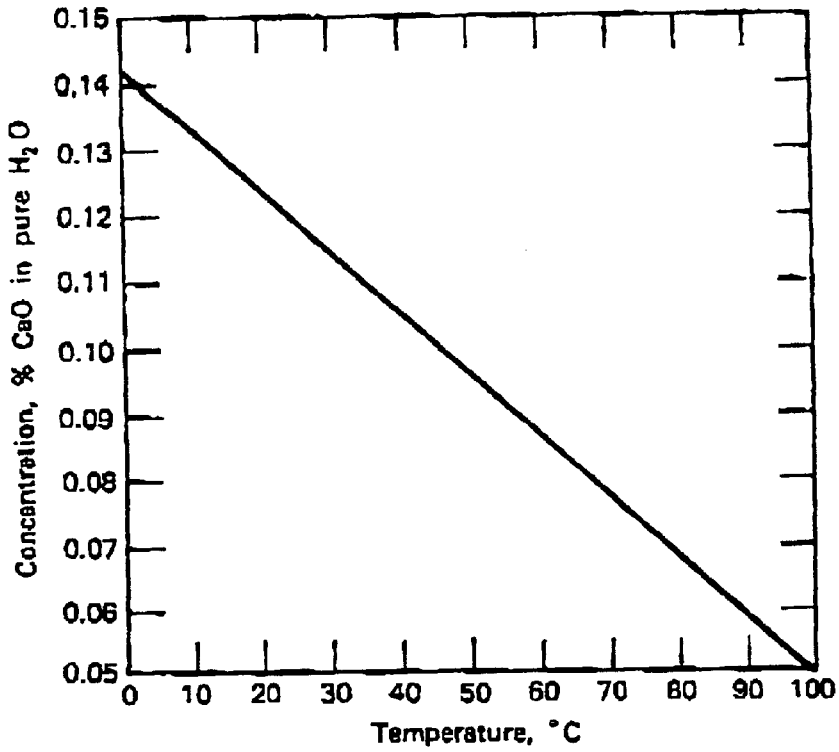
Figure 7: Solubility of lime in water
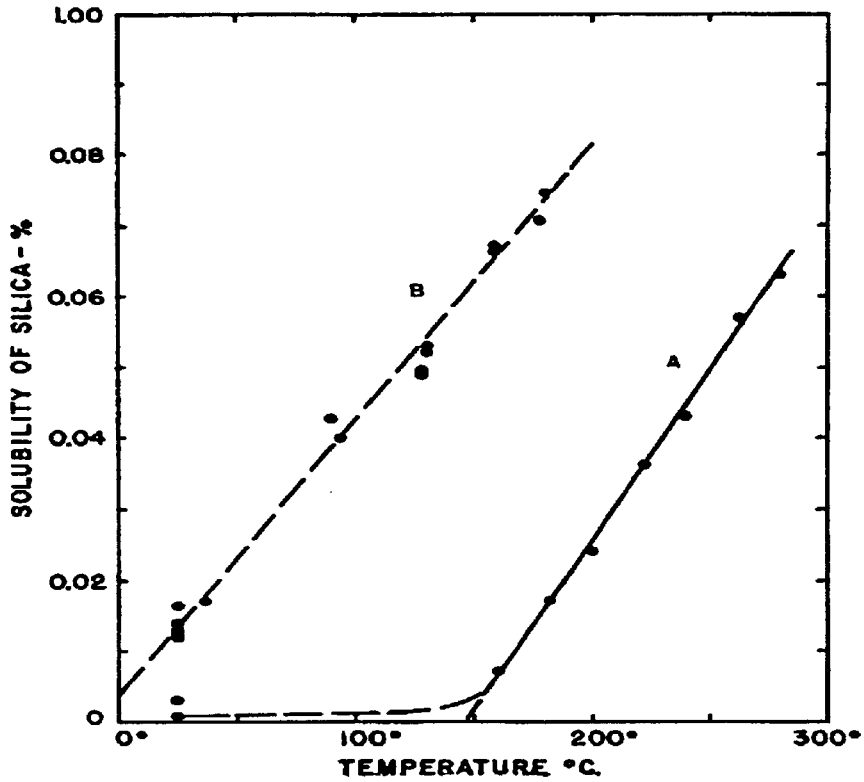
Figure 8: Solubility of silica in water

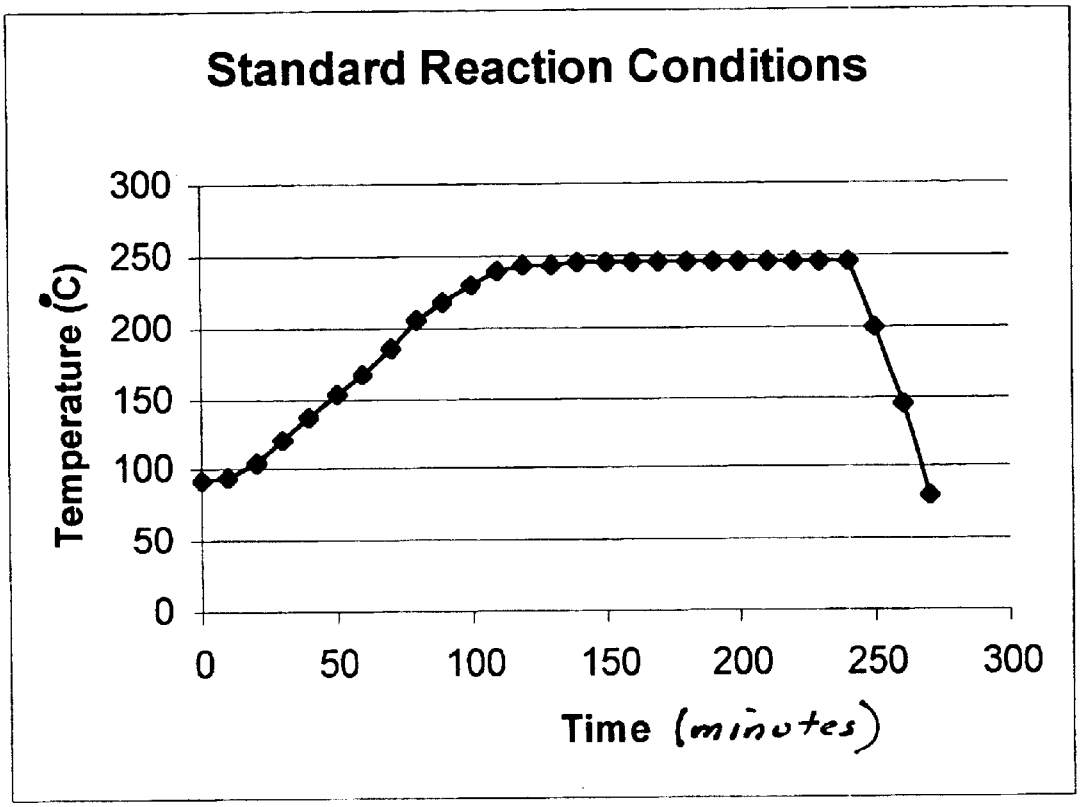
Figure 9: Heating/cooling cycle for a standard reaction

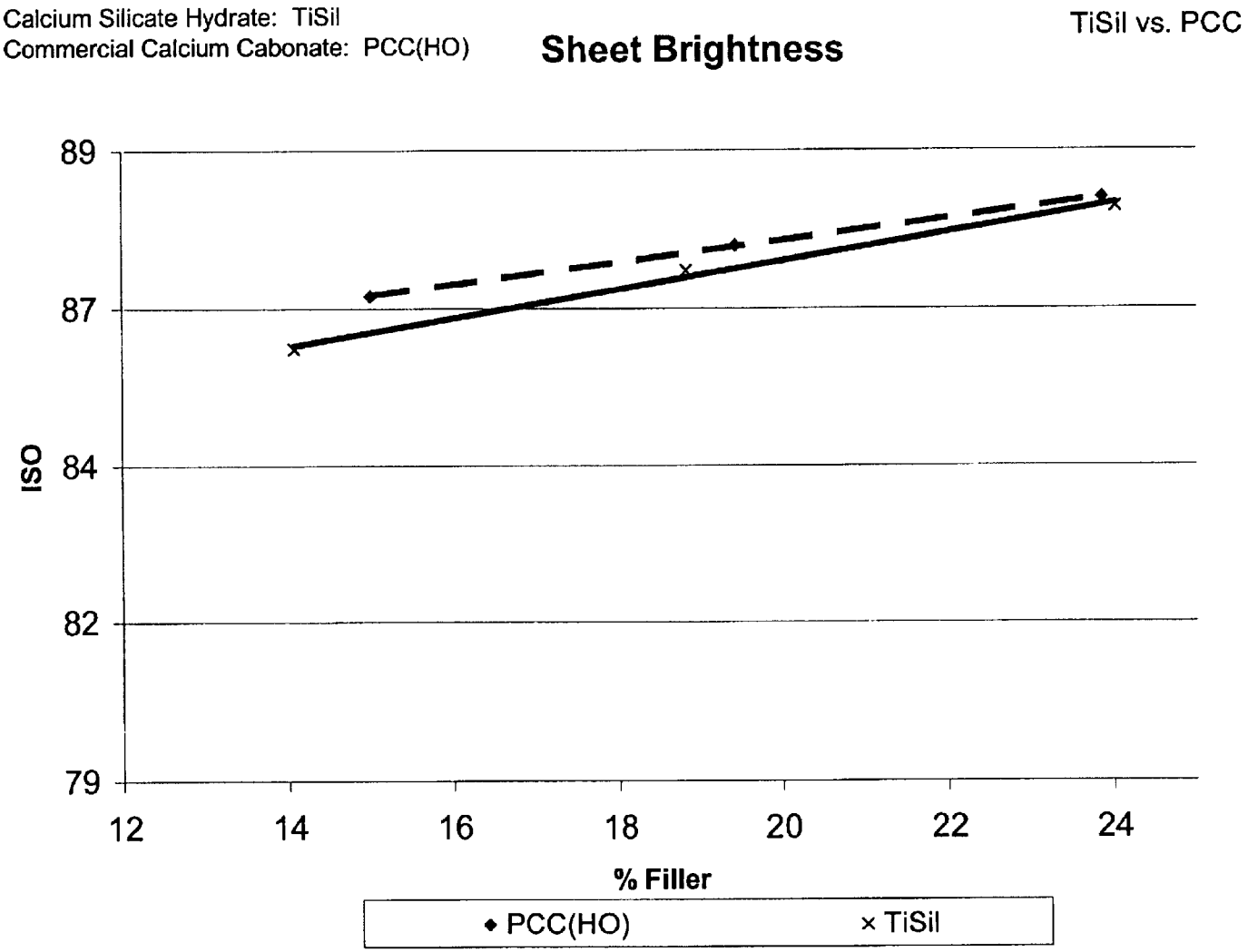
Fig 10: Sheet Brightness results for TiSil and PCC(HO)

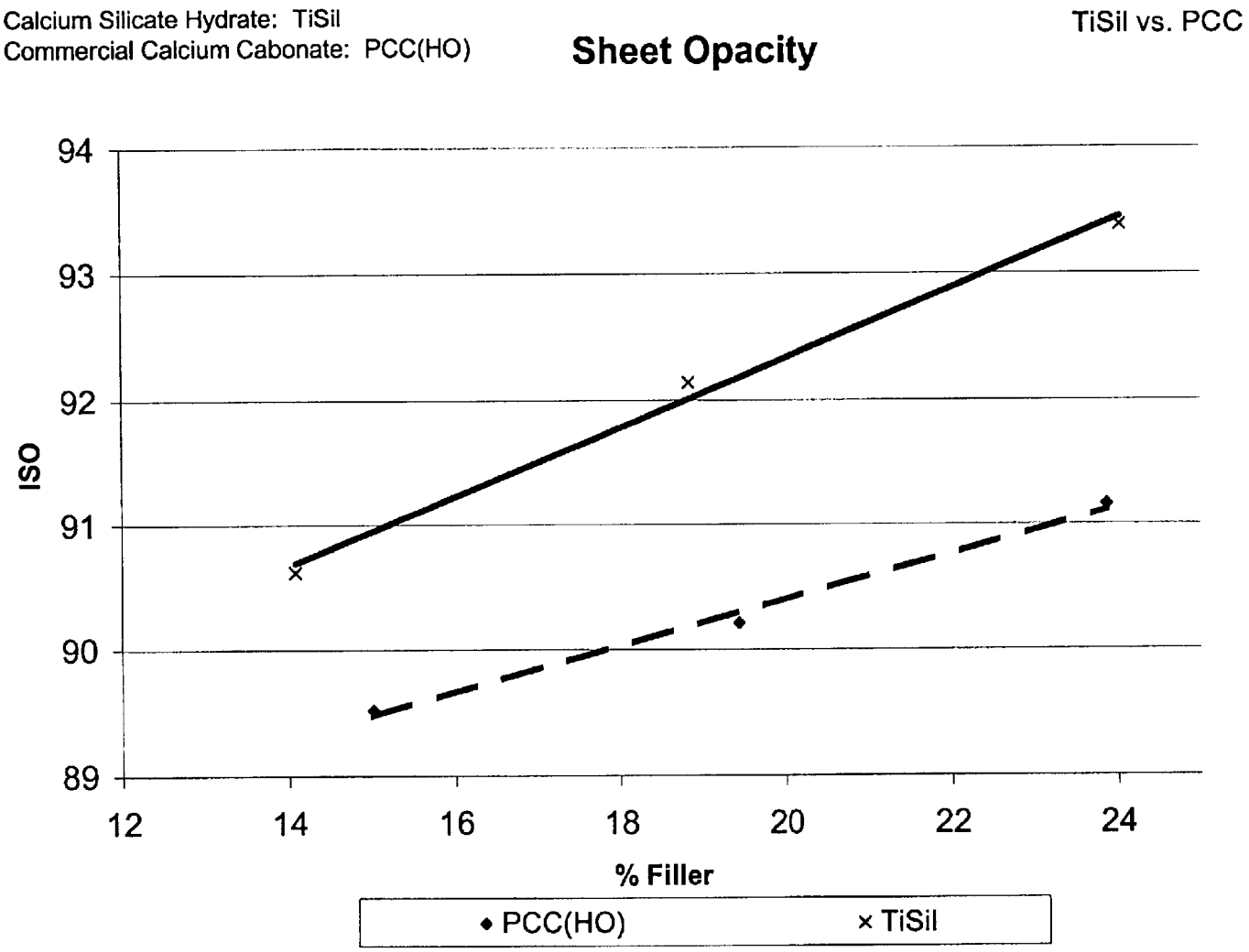
Fig 11: Sheet Opacity results for TiSil and PCC(HO)

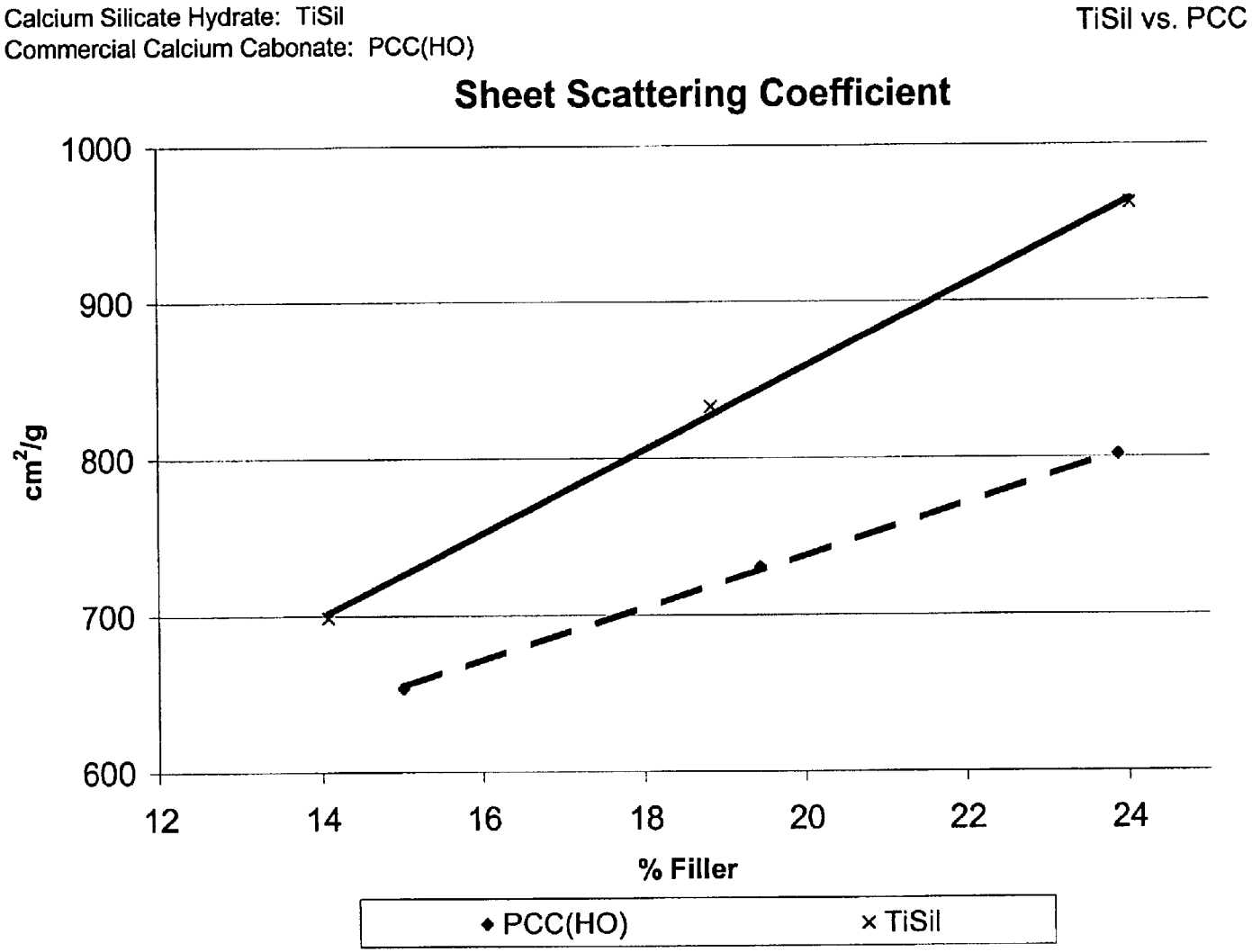
Fig 12: Sheet Scattering Coefficient results for TiSil and PCC(HO)

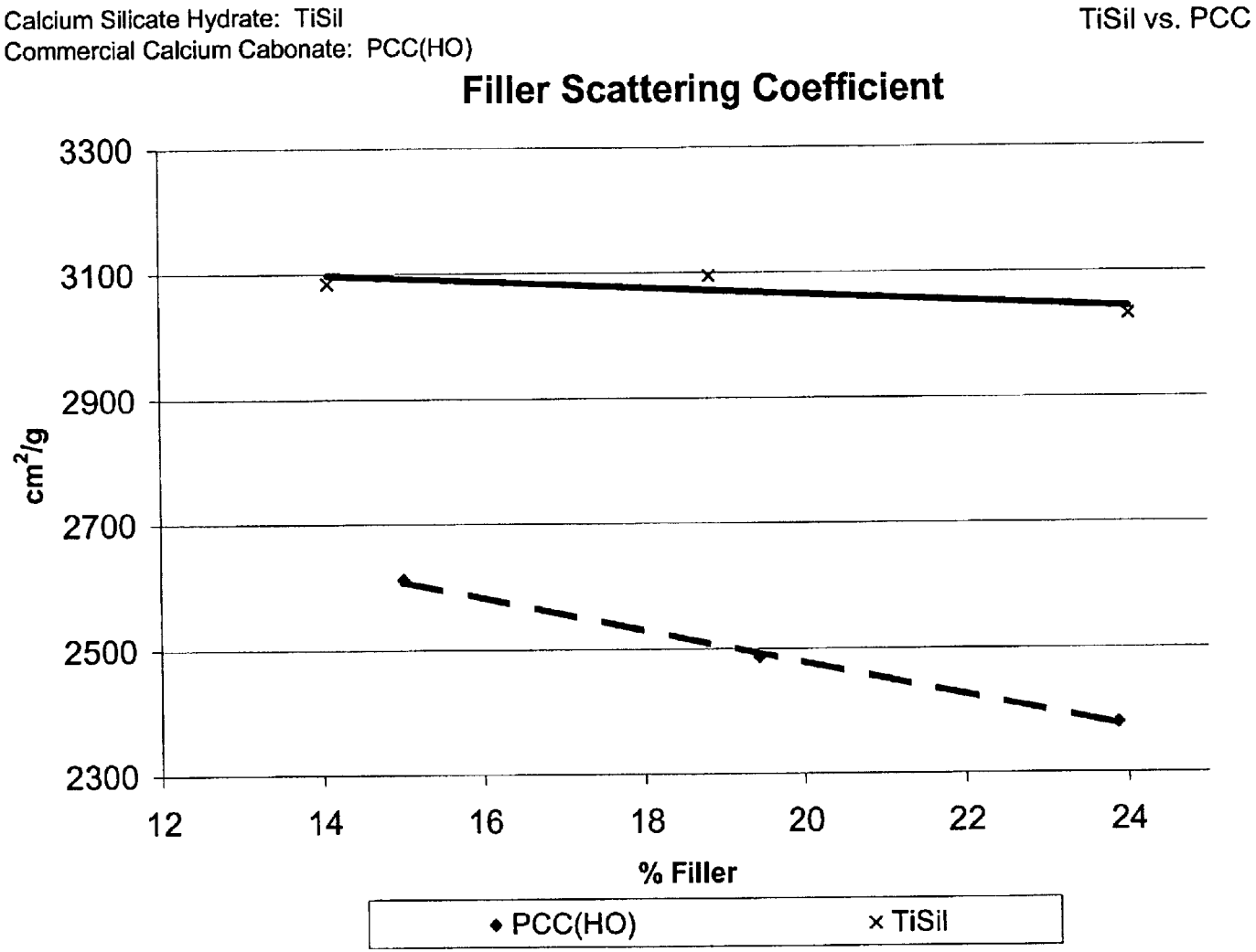
Fig 13: Filler Scattering Coefficient results for TiSil and PCC(HO)

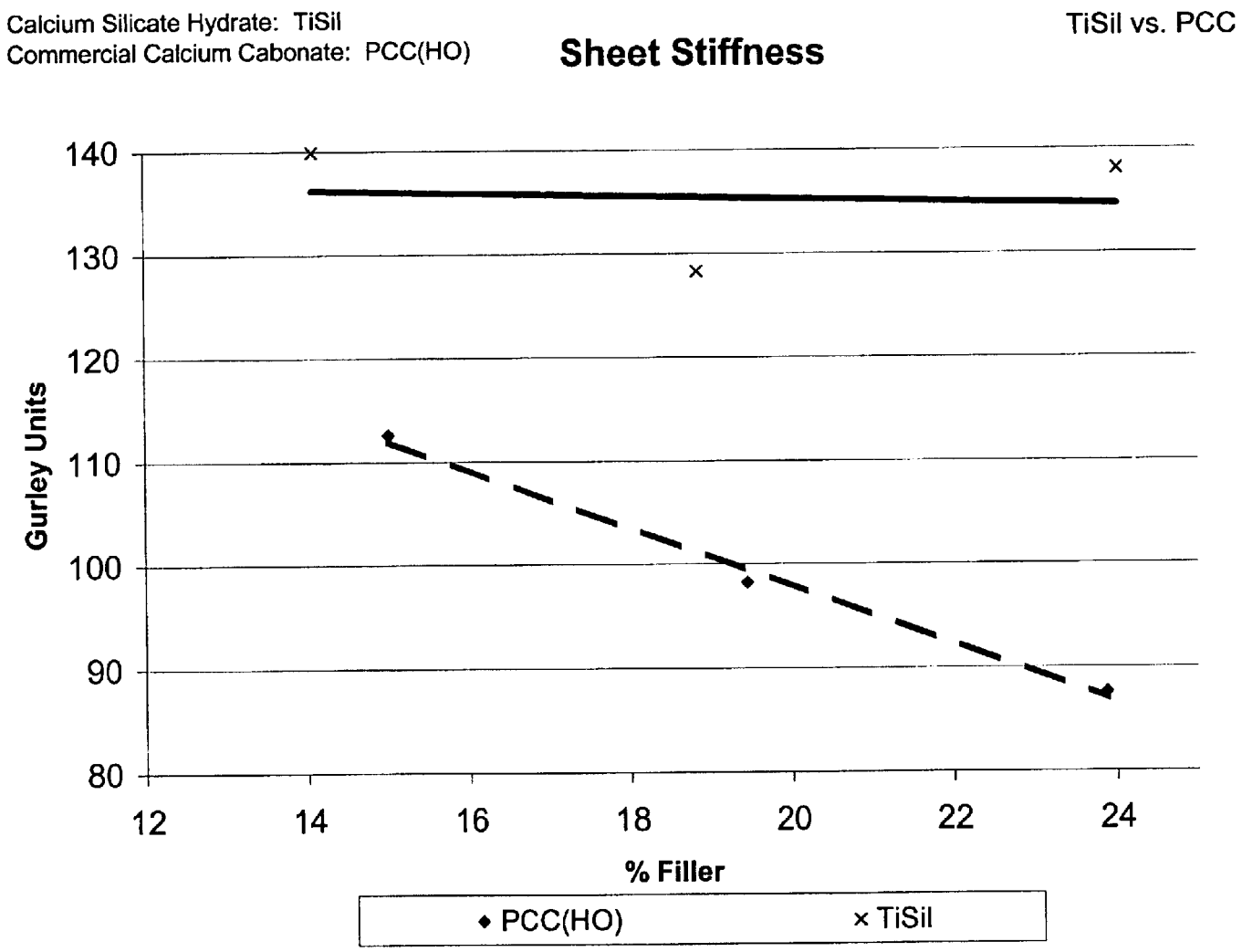
Fig 14: Sheet Stiffness results for TiSil and PCC(HO)

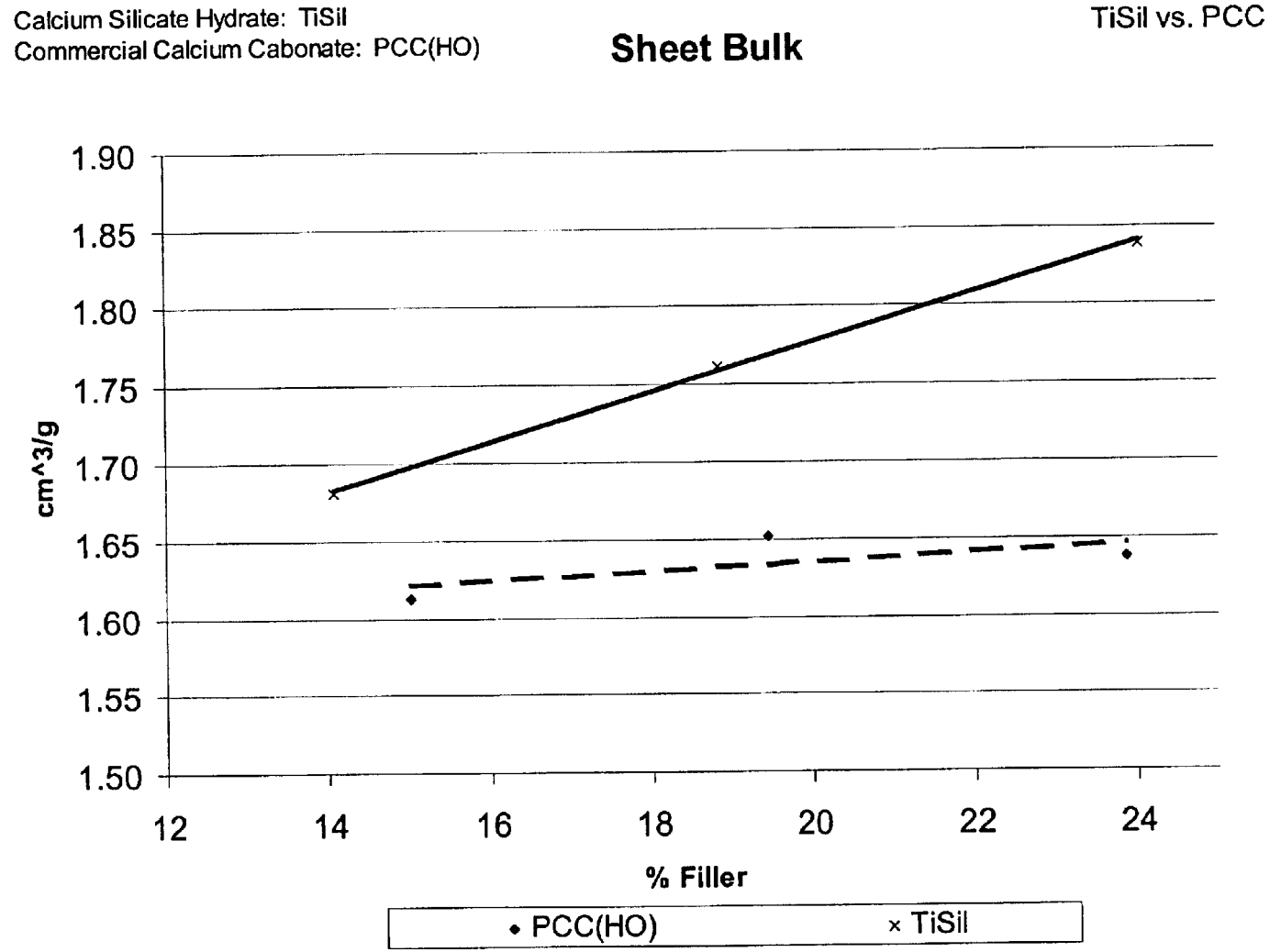
Fig 15: Sheet Bulk results for TiSil and PCC(HO)

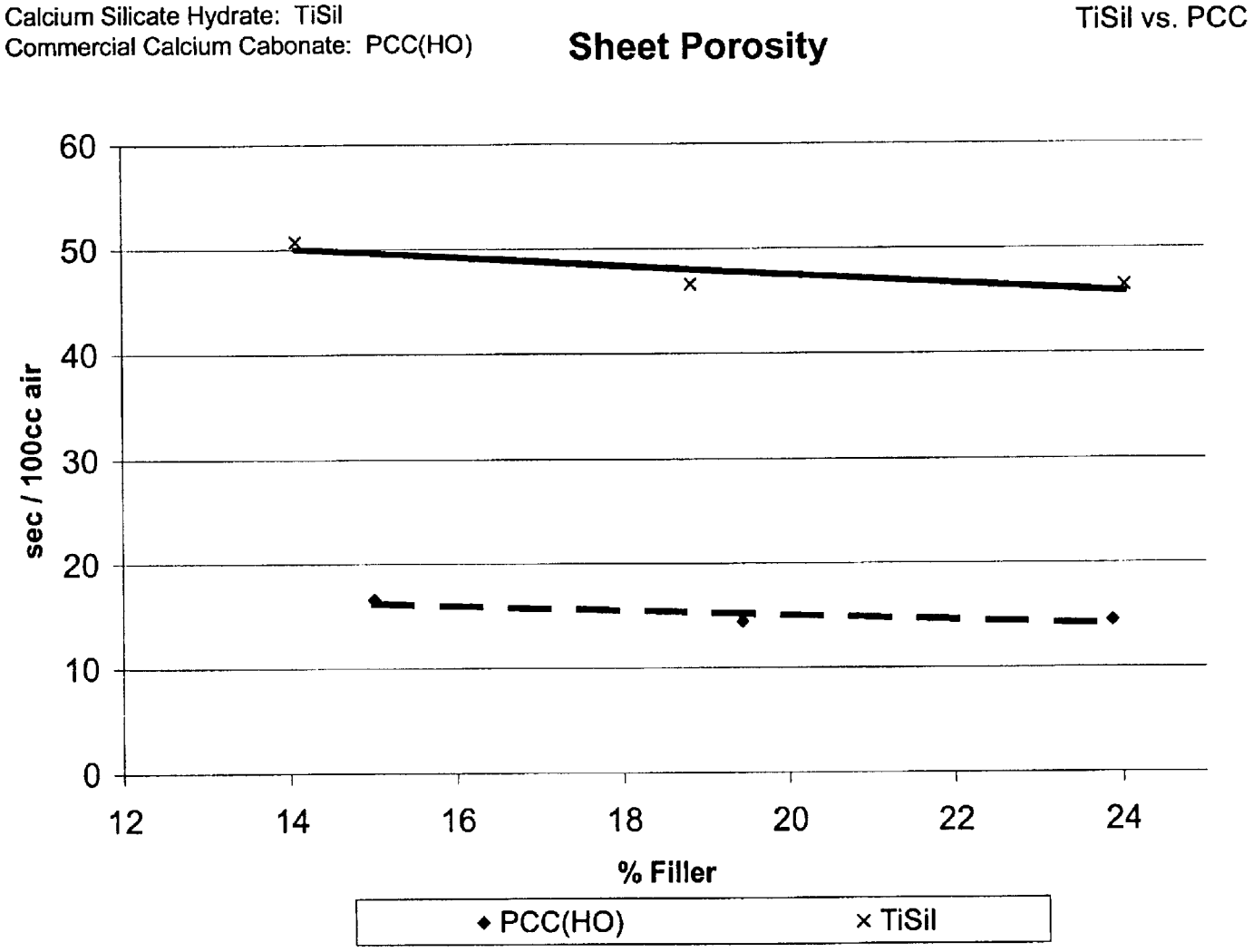
Fig 16: Sheet Porosity results for TiSil and PCC(HO)

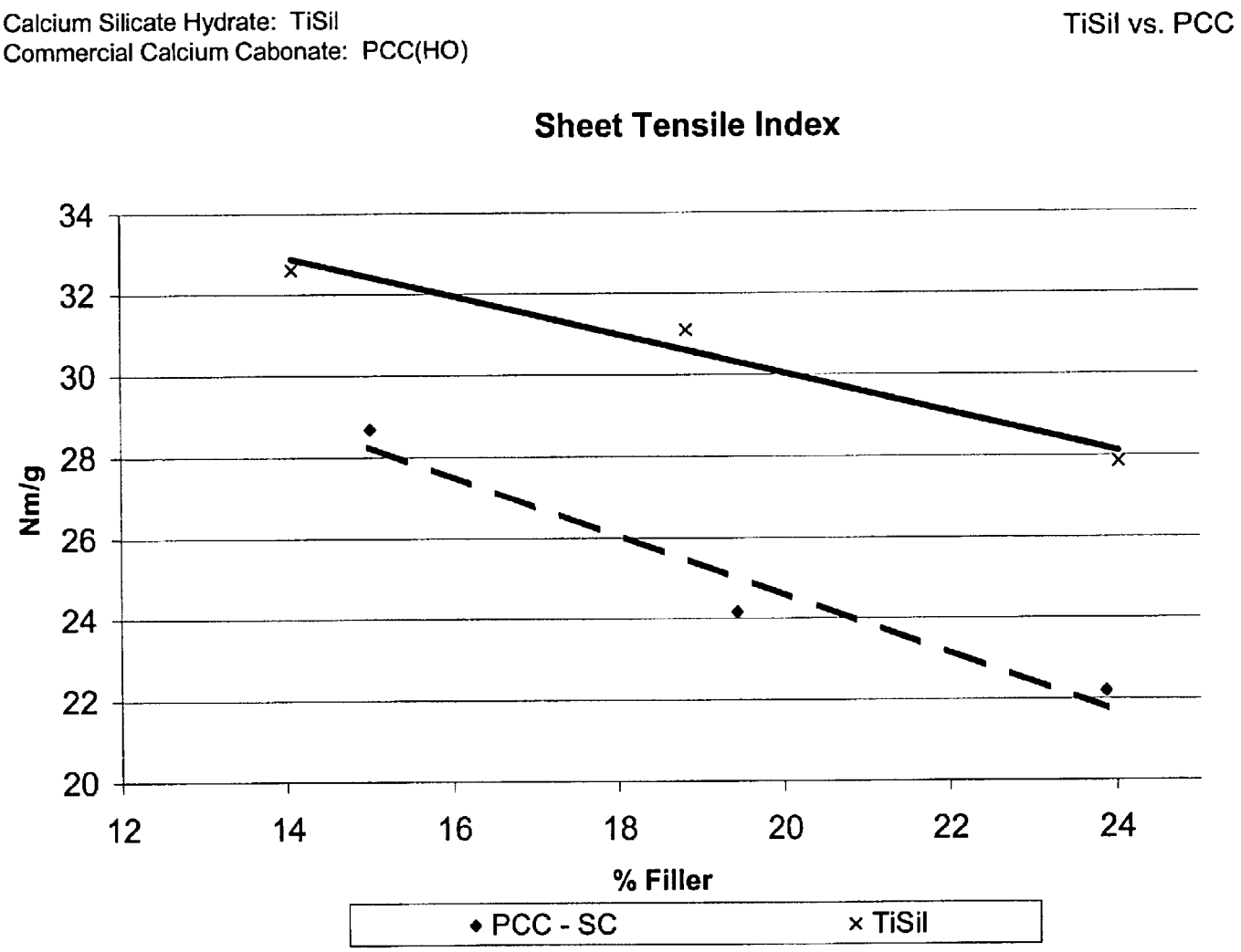
Fig 17: Sheet Tensile Index results for TiSil and PCC(HO)

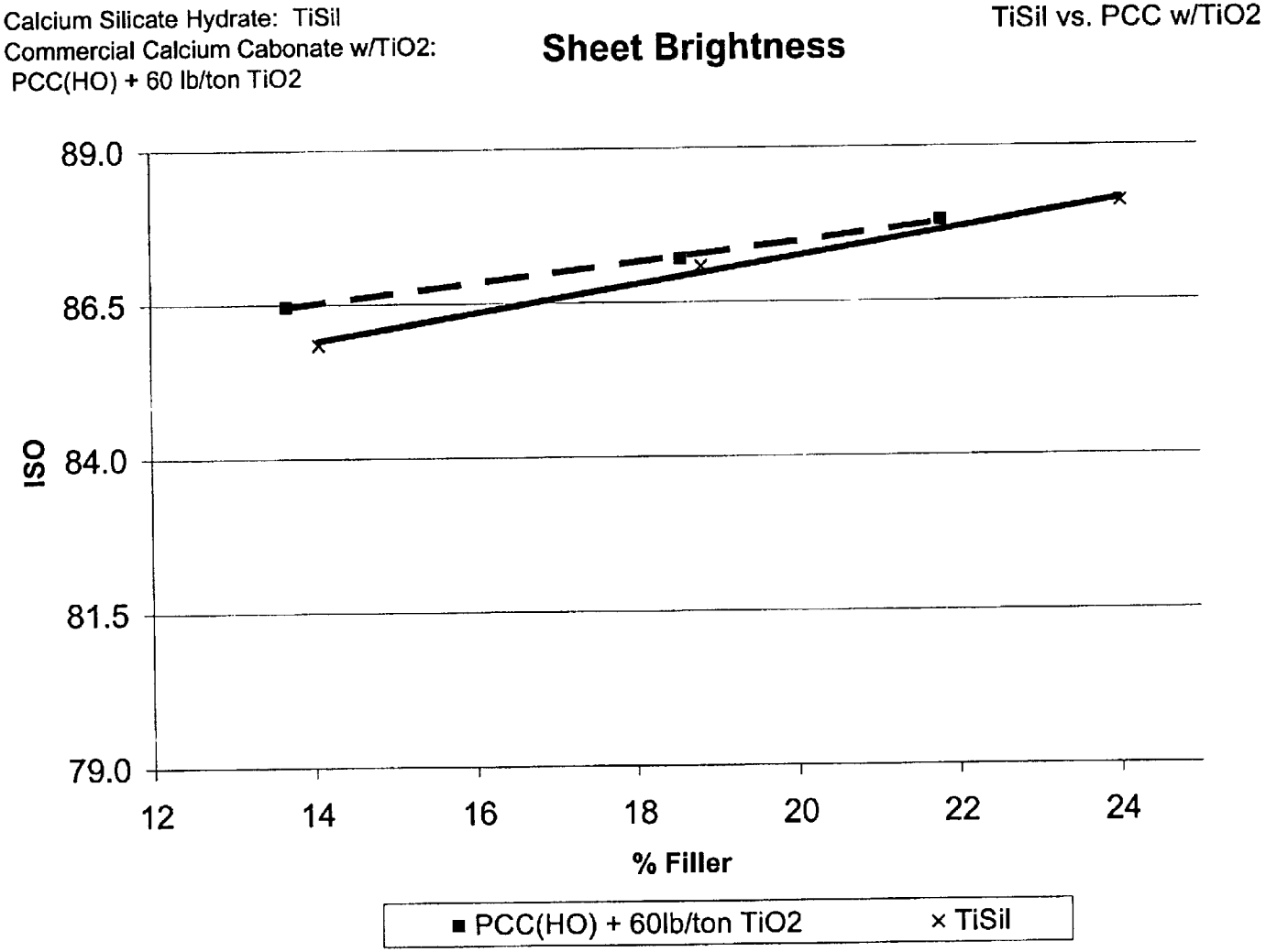
Fig 18: Sheet Brightness results for TiSil and PCC(HO) w/$TiO_2$

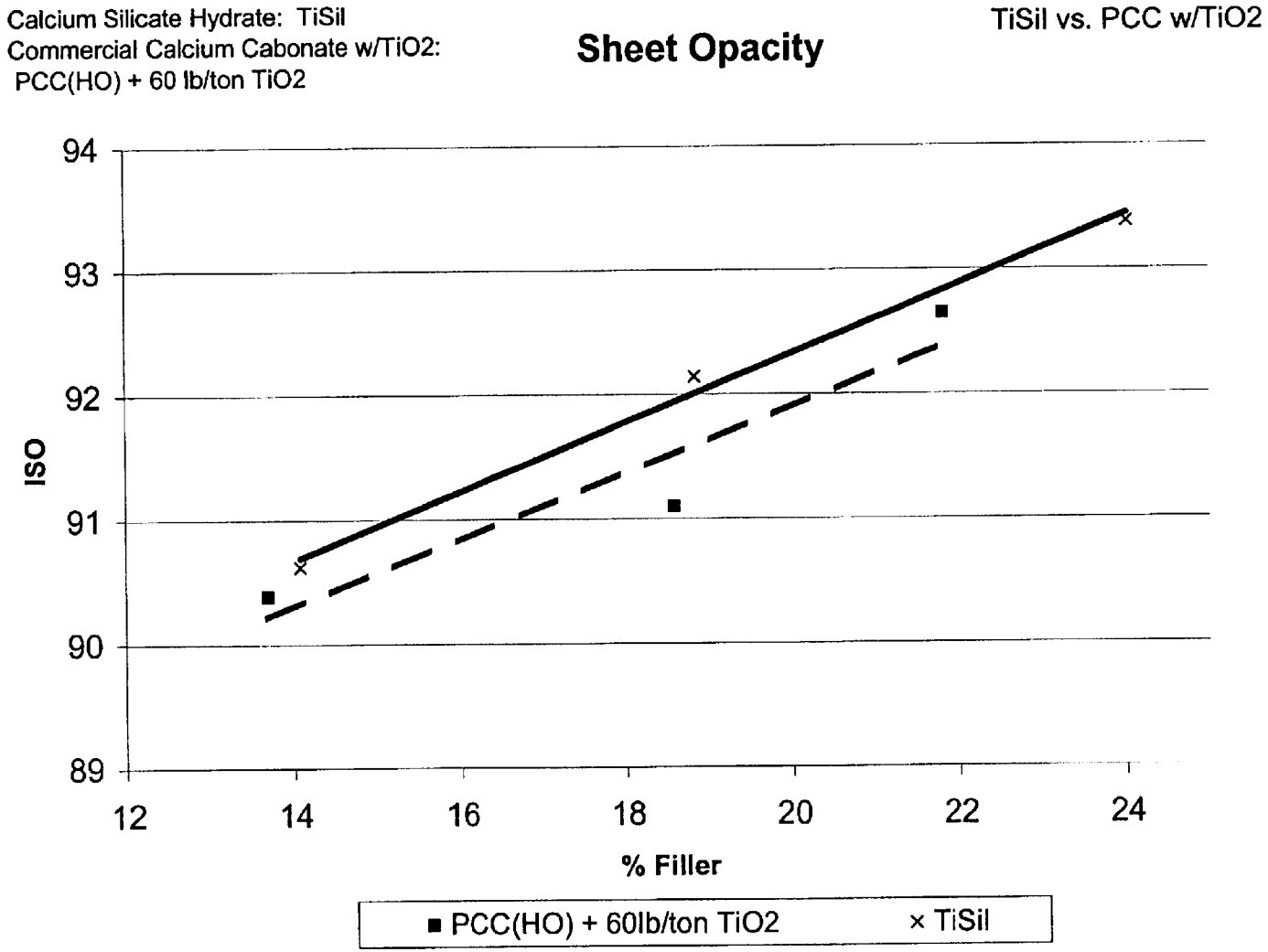
Fig 19: Sheet Opacity results for TiSil and PCC(HO) w/$TiO_2$

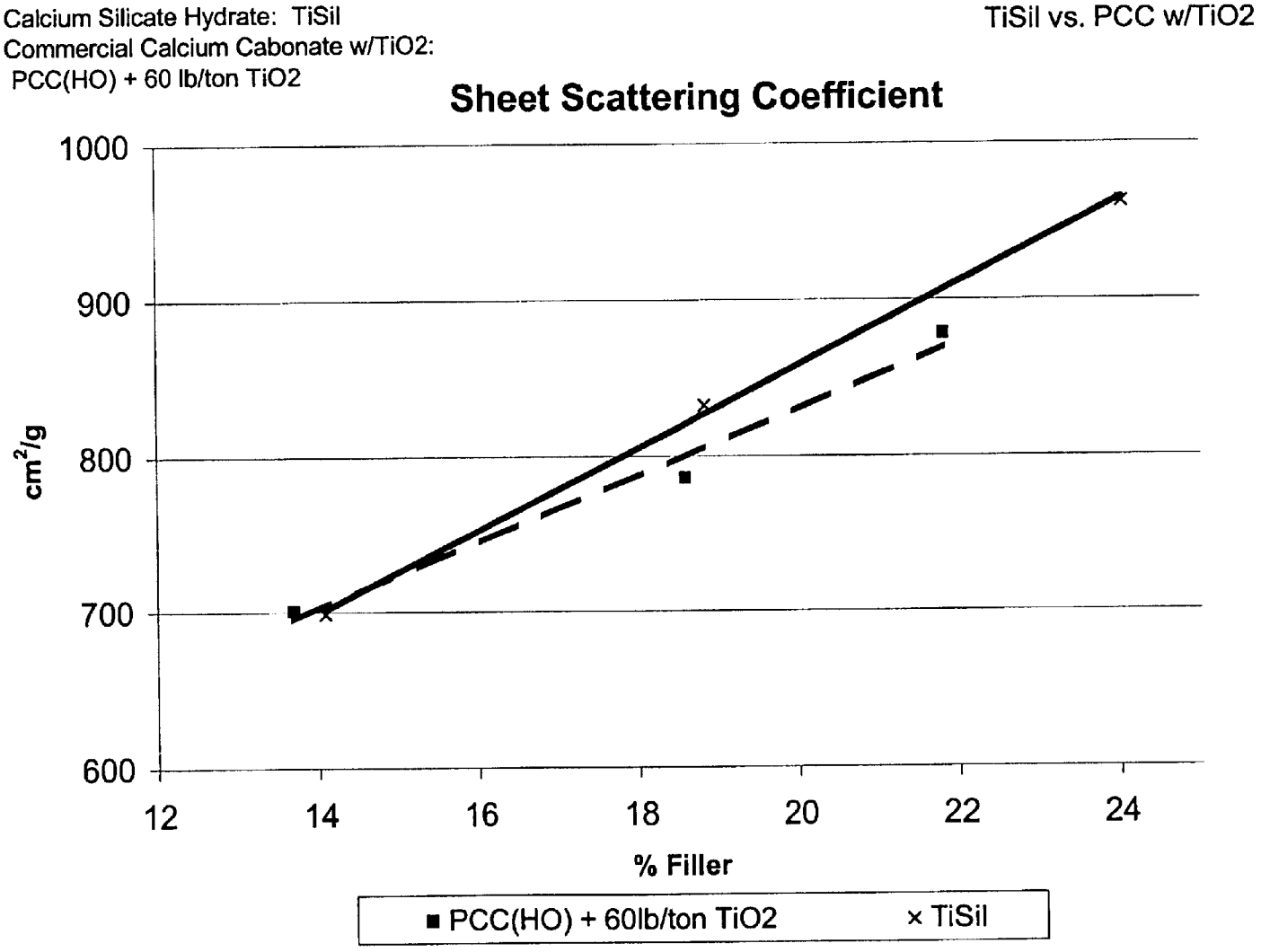
Fig 20: Sheet Scattering Coefficient results for TiSil and PCC(HO) w/$TiO_2$

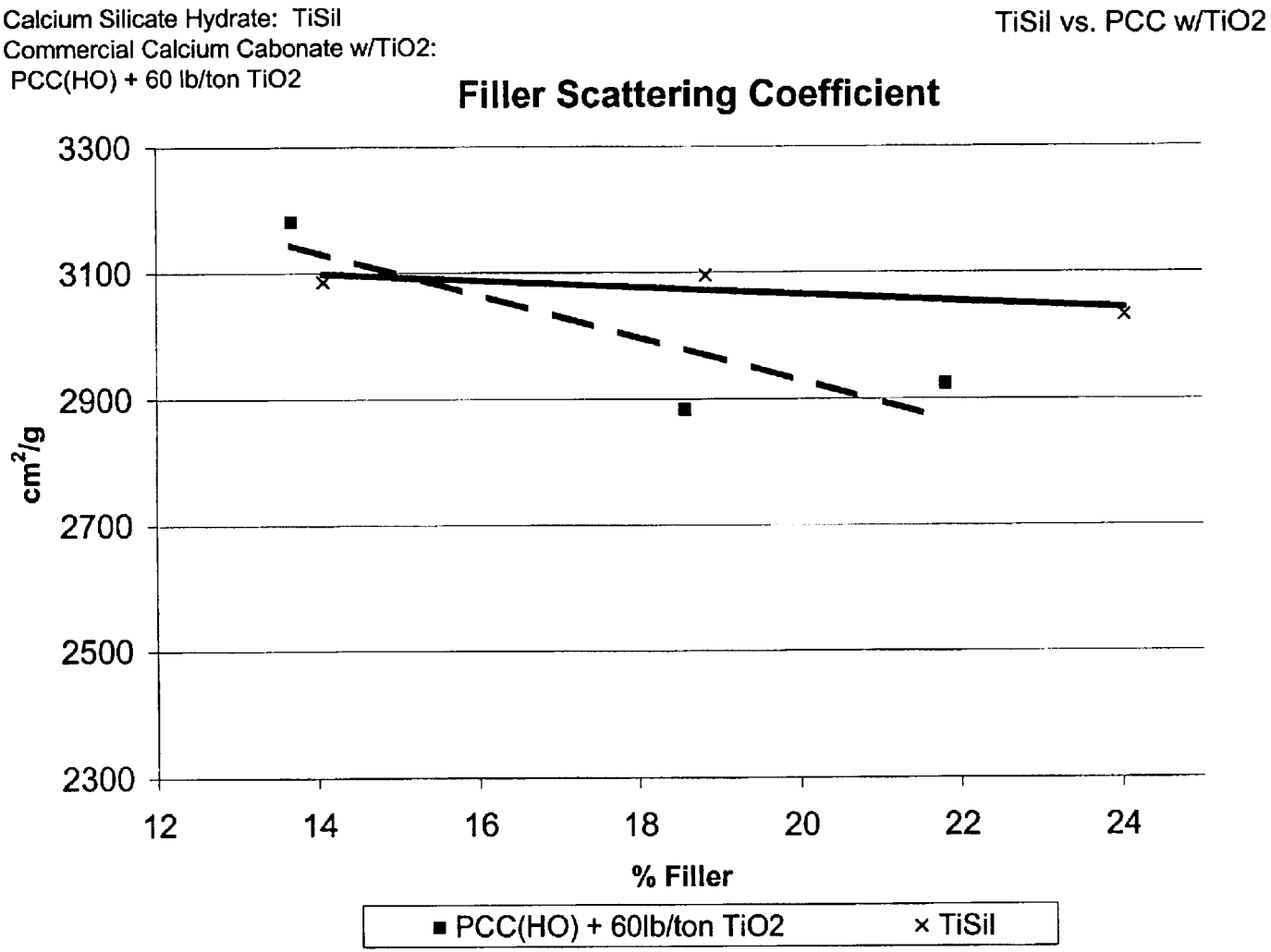
Fig 21: Filler Scattering Coefficient results for TiSil and PCC(HO) w/$TiO_2$

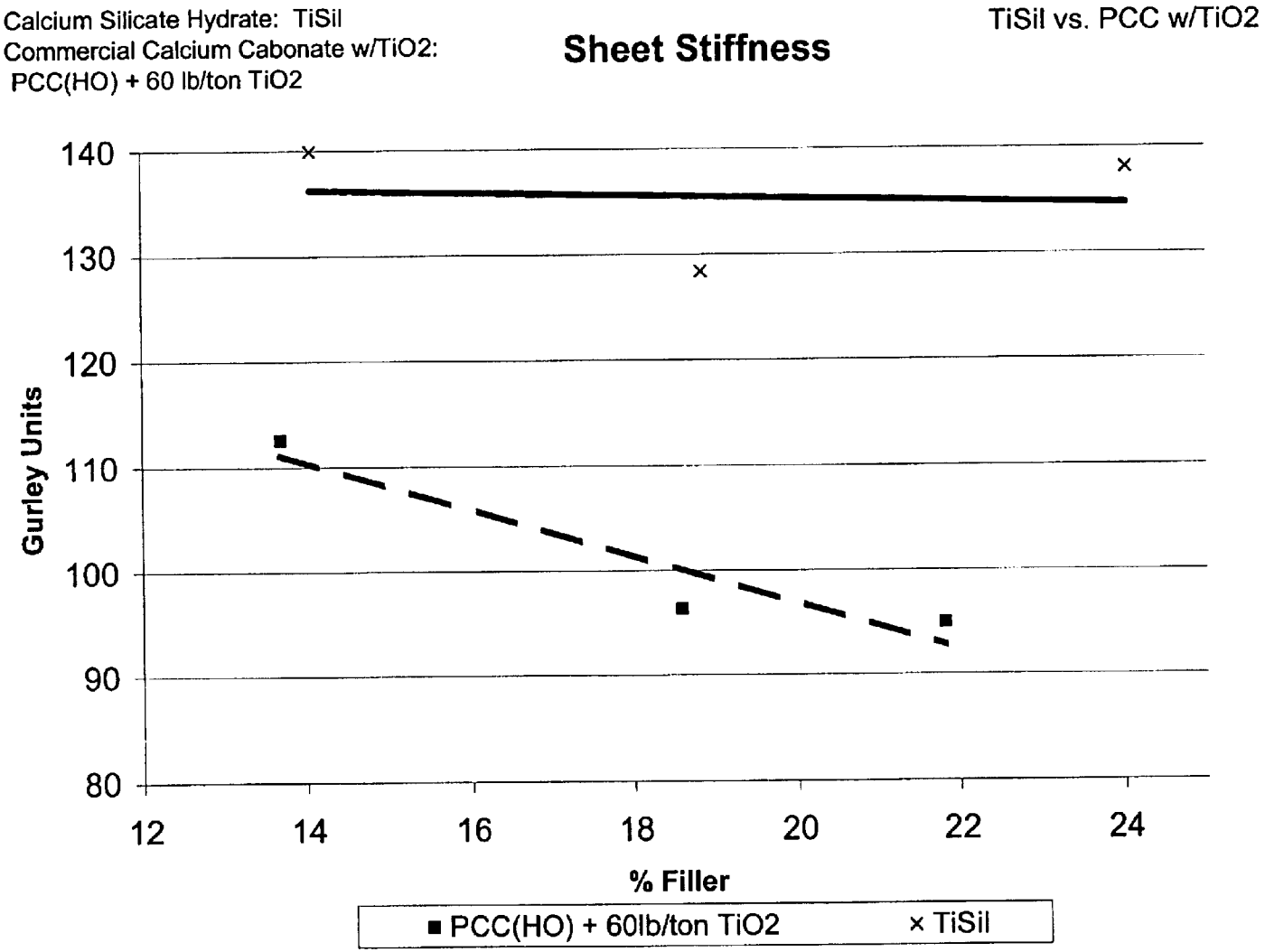
Fig 22: Sheet Stiffness results for TiSil and PCC(HO) w/$TiO_2$

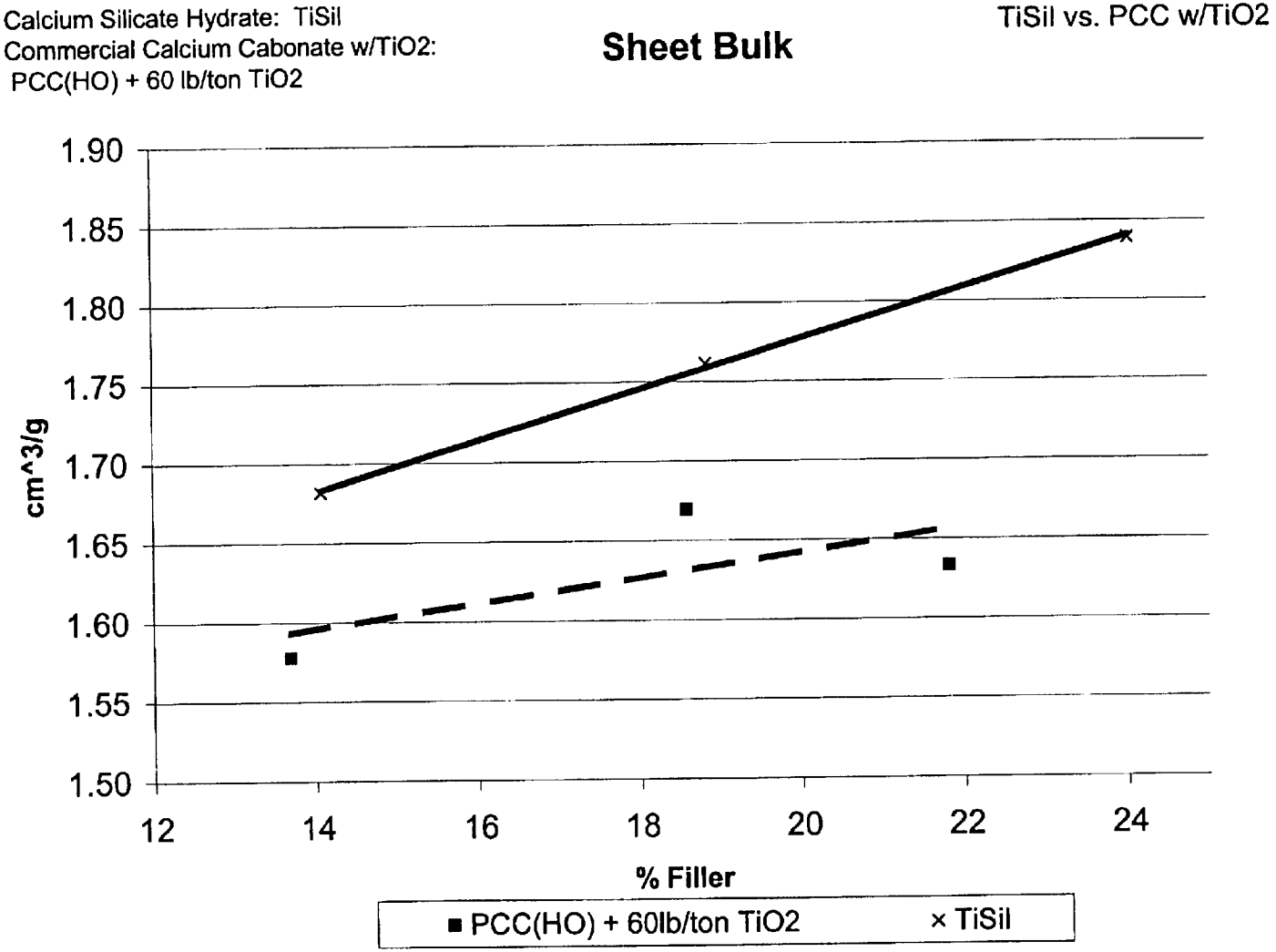
Fig 23: Sheet Bulk results for TiSil and PCC(HO) w/$TiO_2$

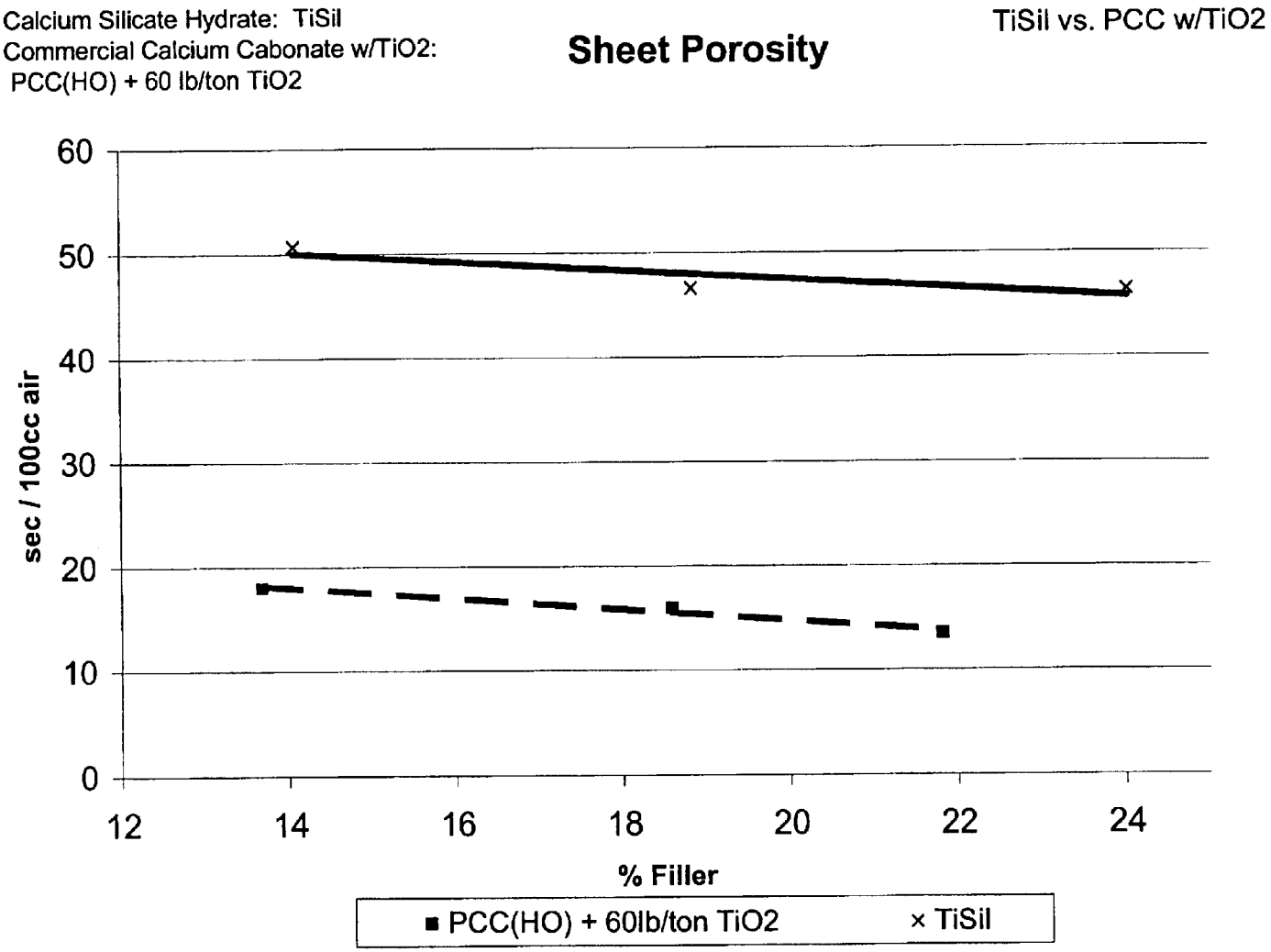
Fig 24: Sheet Porosity results for TiSil and PCC(HO) w/$TiO_2$

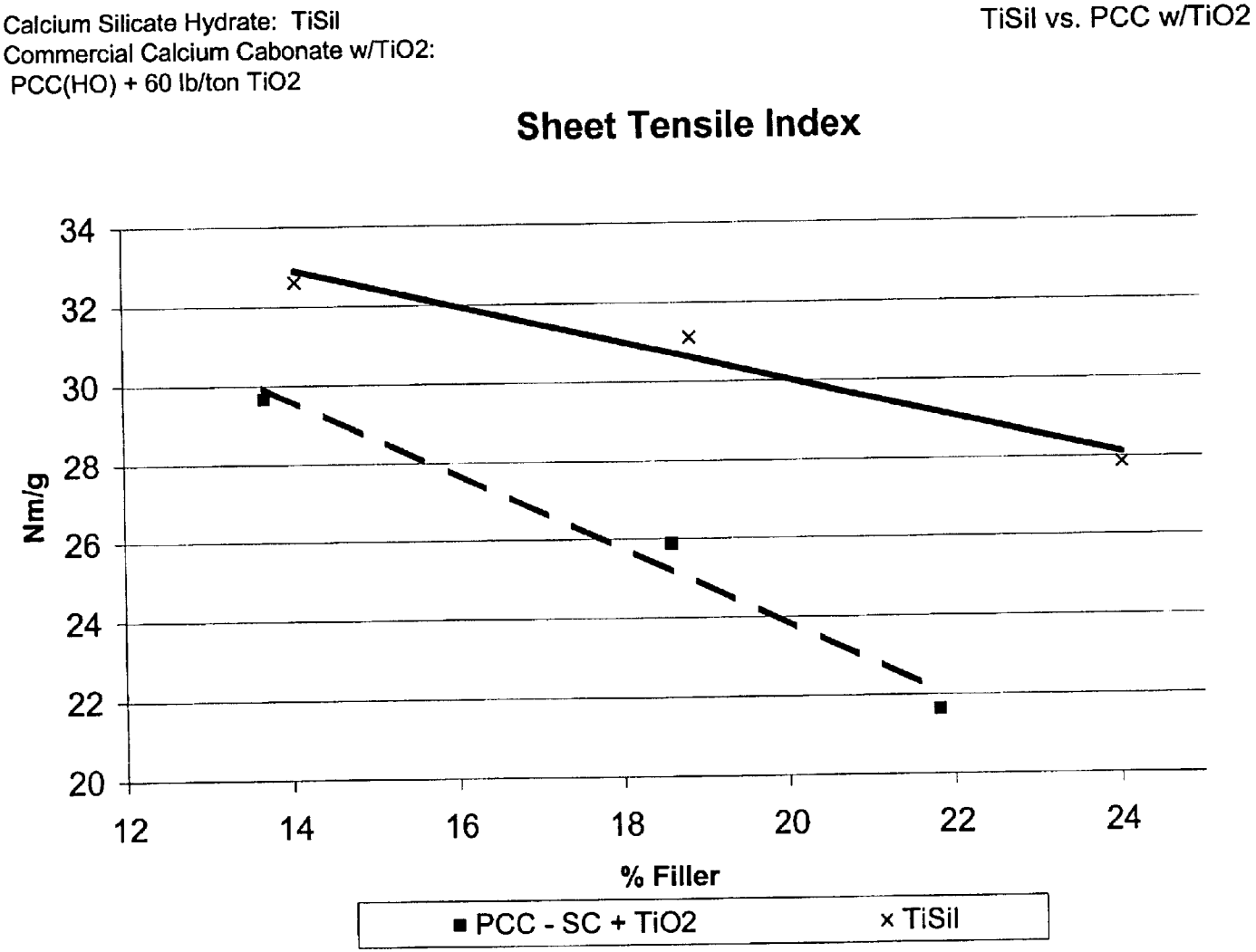
Fig 25: Sheet Tensile Index results for TiSil and PCC(HO) w/$TiO_2$

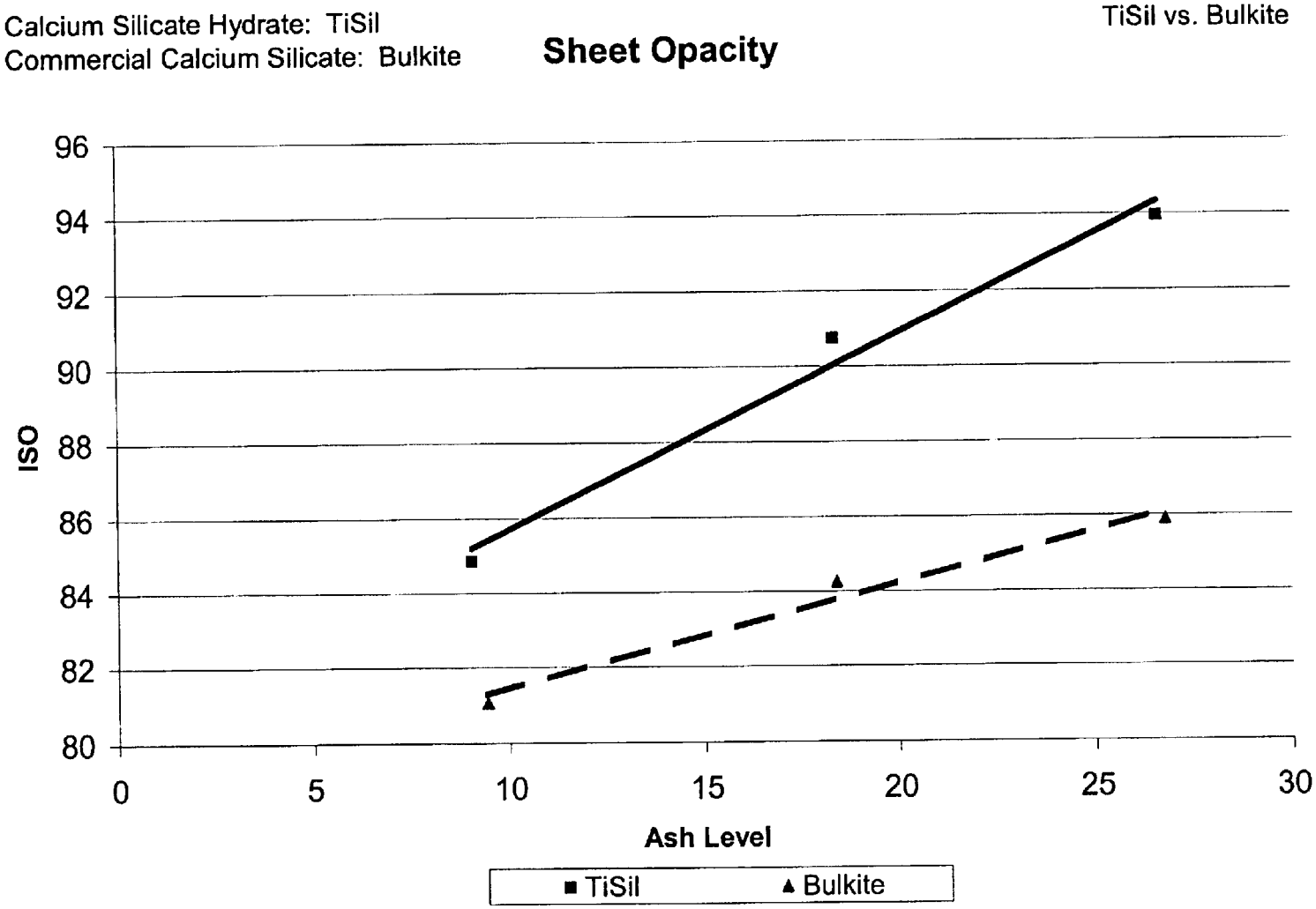
Fig 26: Sheet Opacity results for TiSil and Bulkite

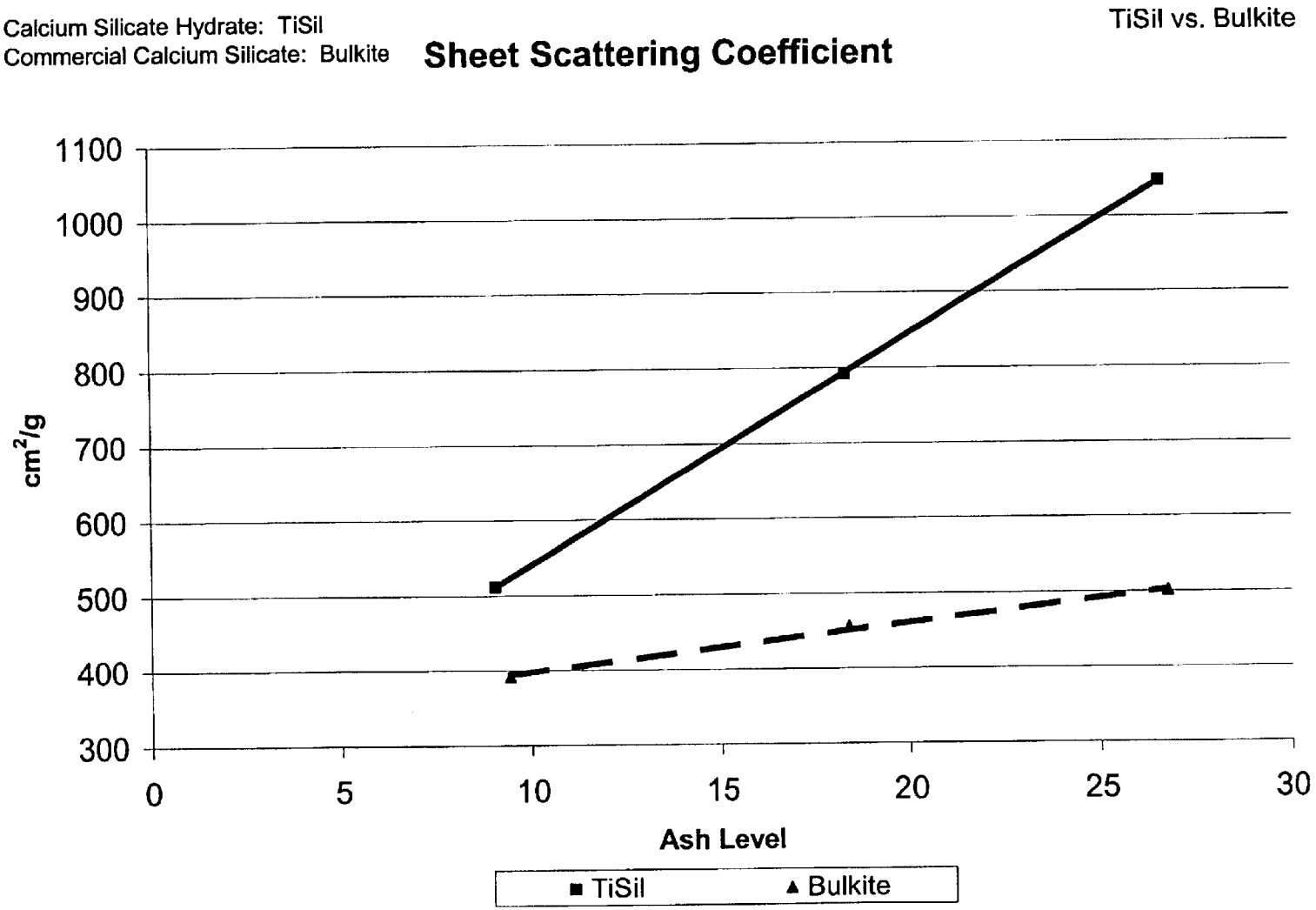
Fig 27: Sheet Scattering Coefficient results of TiSil and Bulkite

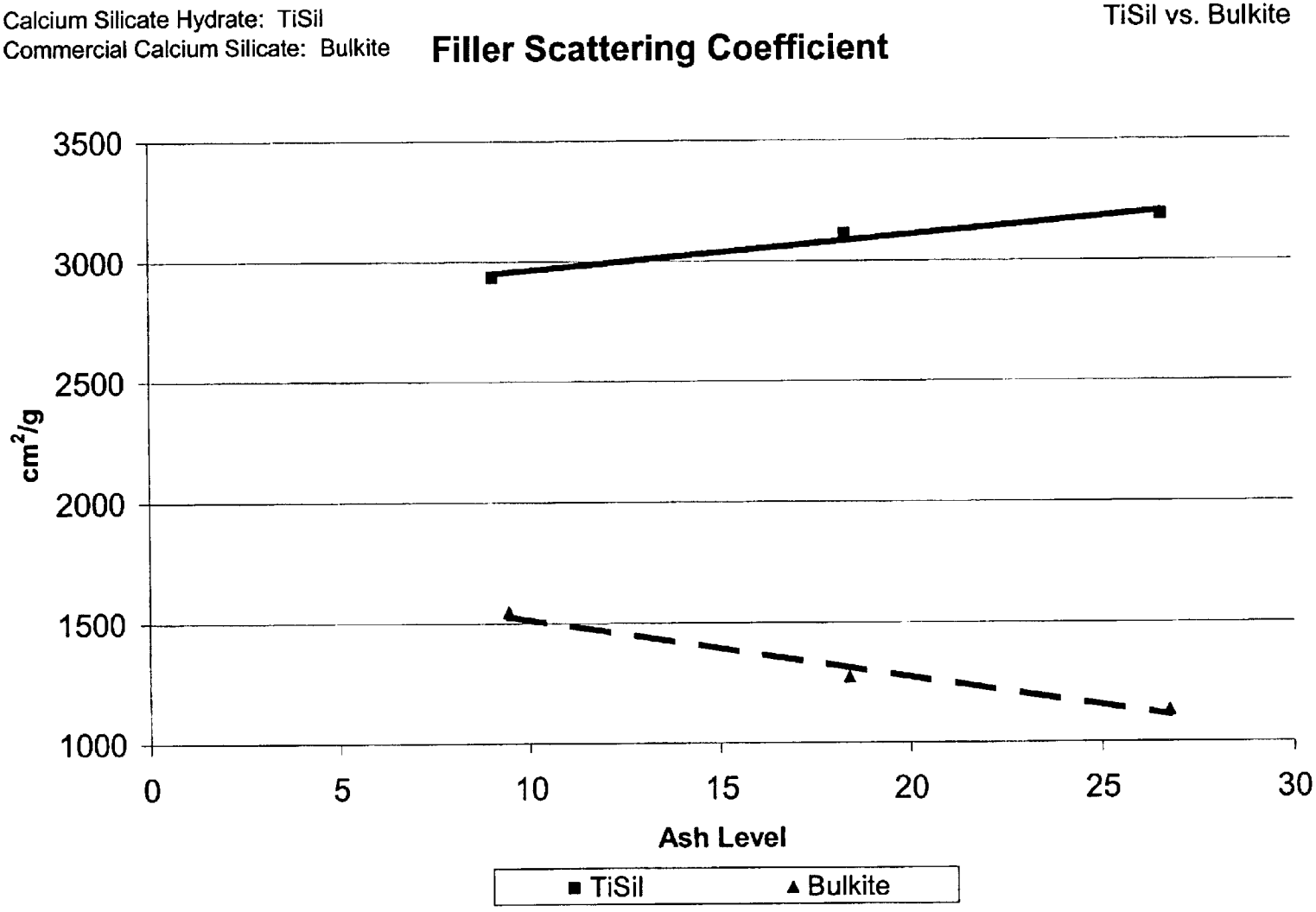
Fig 28: Filler Scattering Coefficient results for TiSil and Bulkite

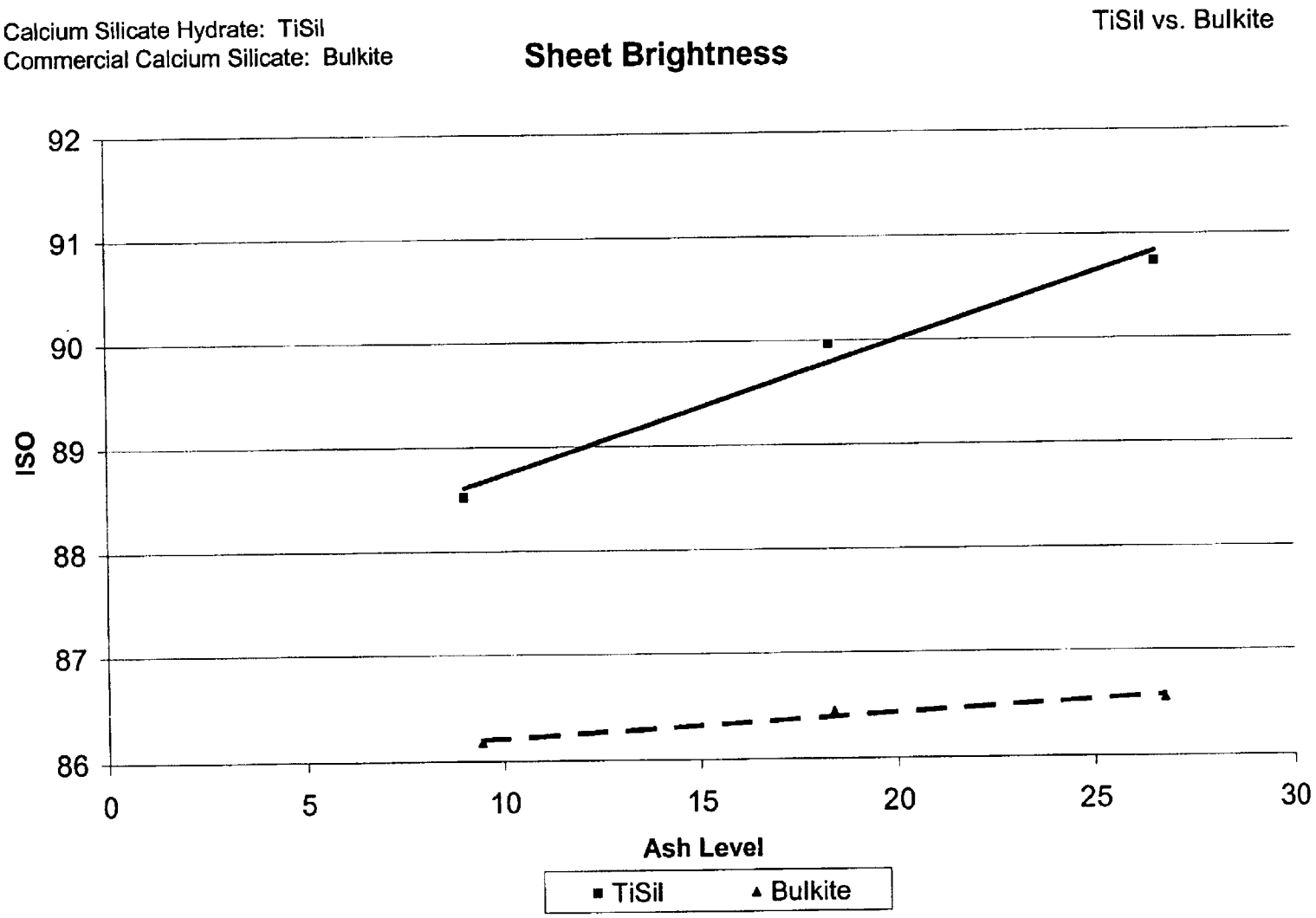
Fig 29: Sheet Brightness results for TiSil and Bulkite

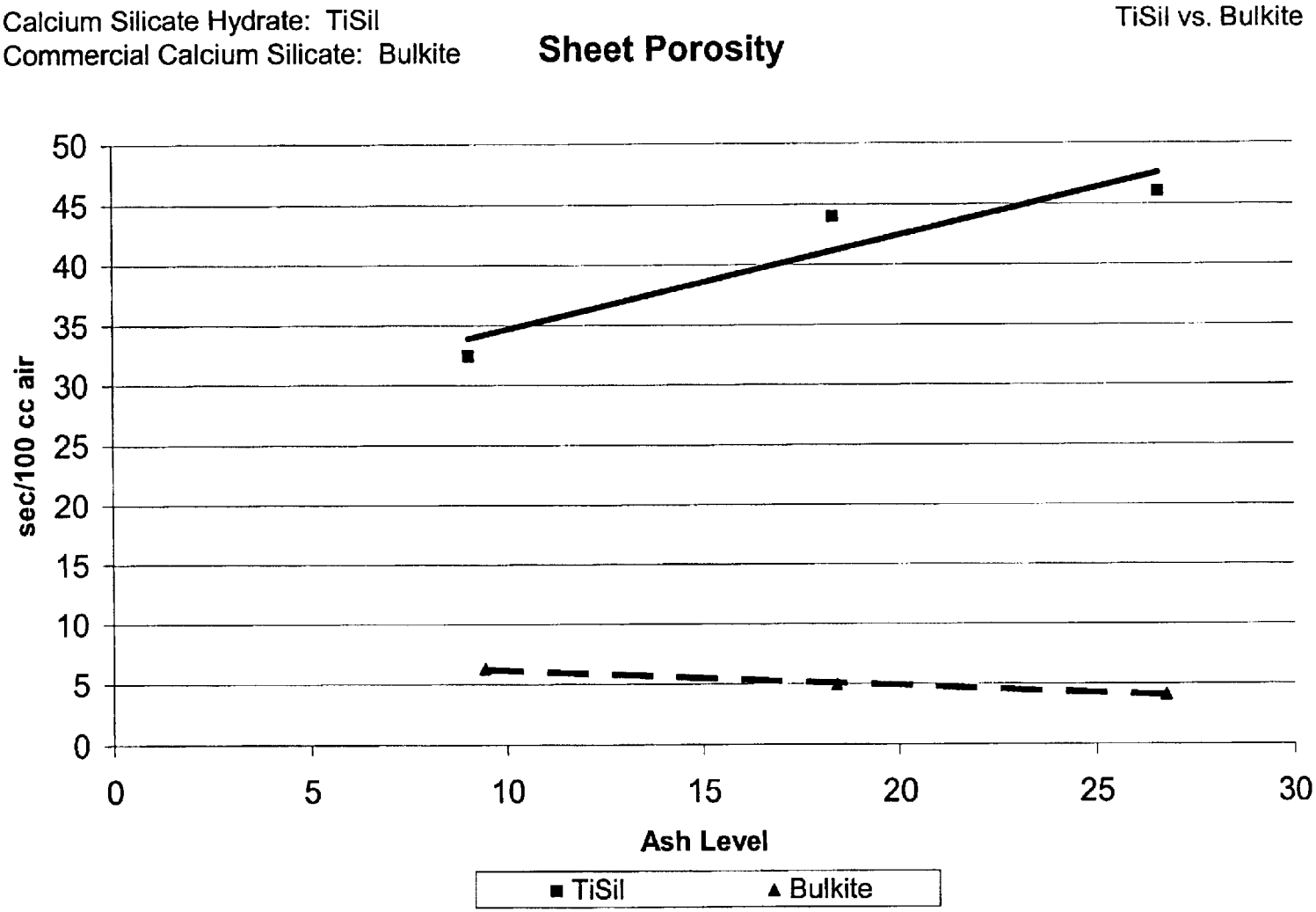
Fig 30: Sheet Porosity results for TiSil and Bulkite

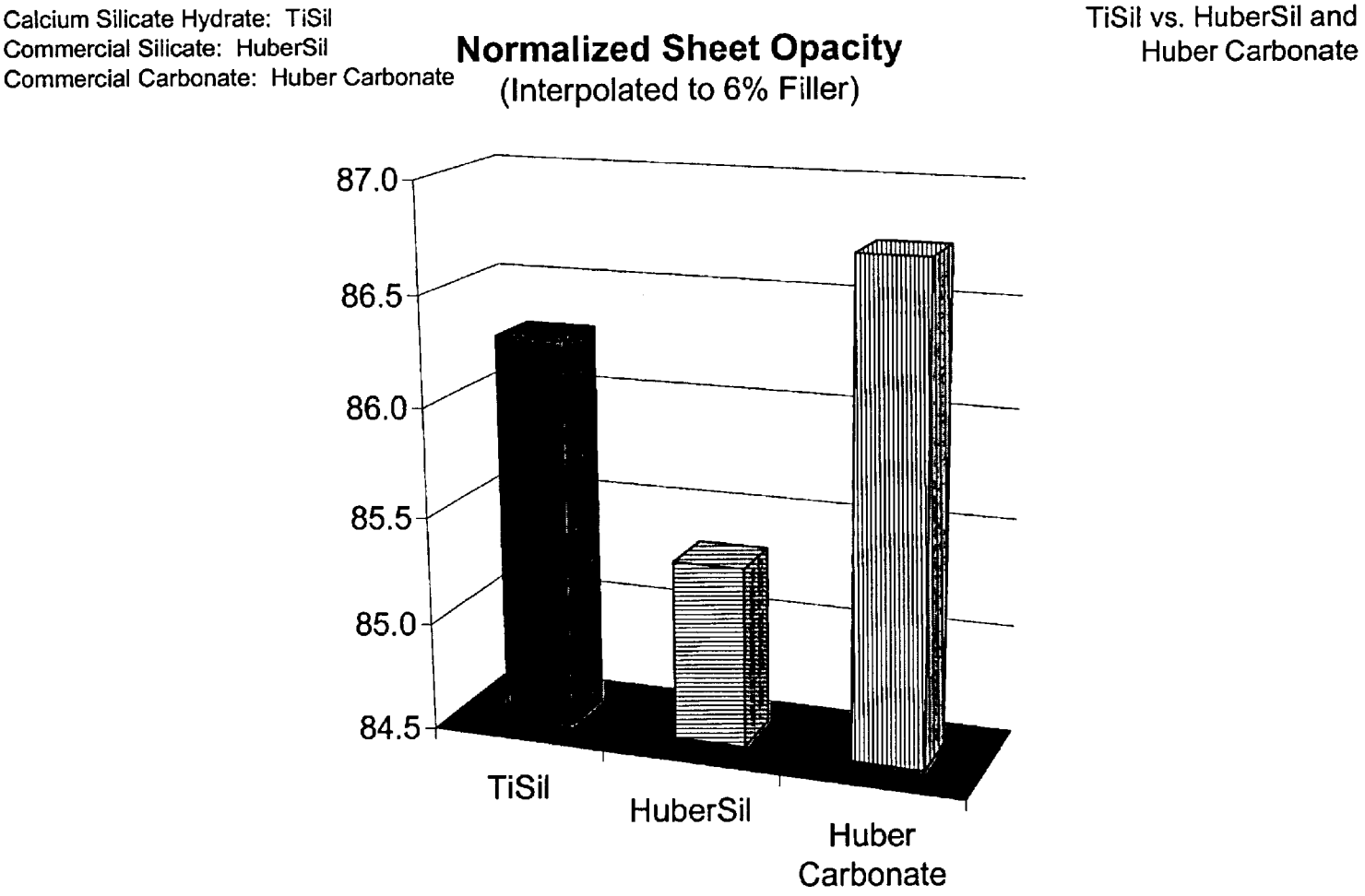
Fig 31: Normalized Sheet Opacity results for newsprint sheets containing various fillers, interpolated to 6% Ash.

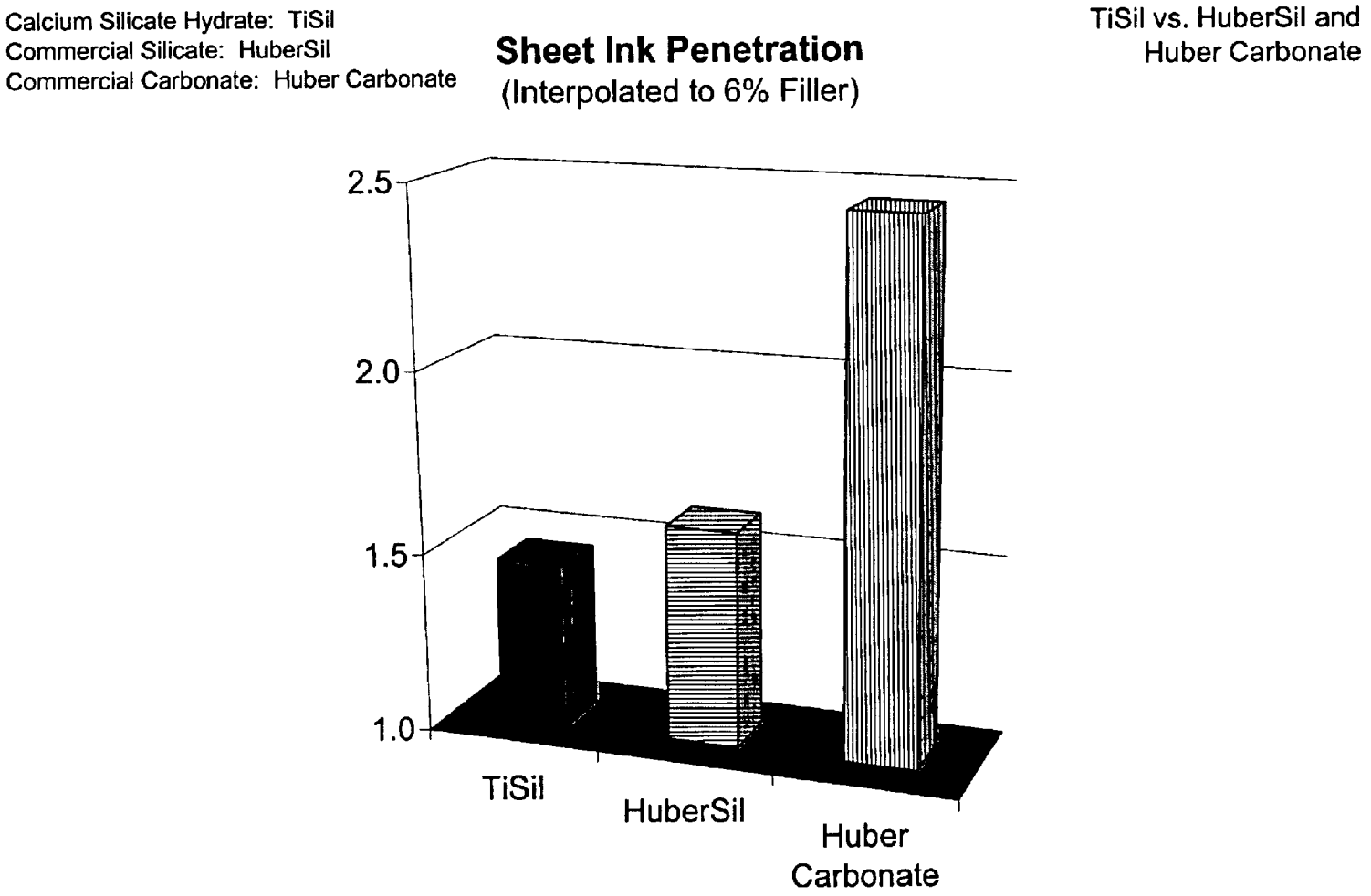
Fig 32: Sheet Ink Penetration results on newsprint sheets containing various fillers, interpolated to 6% Ash.

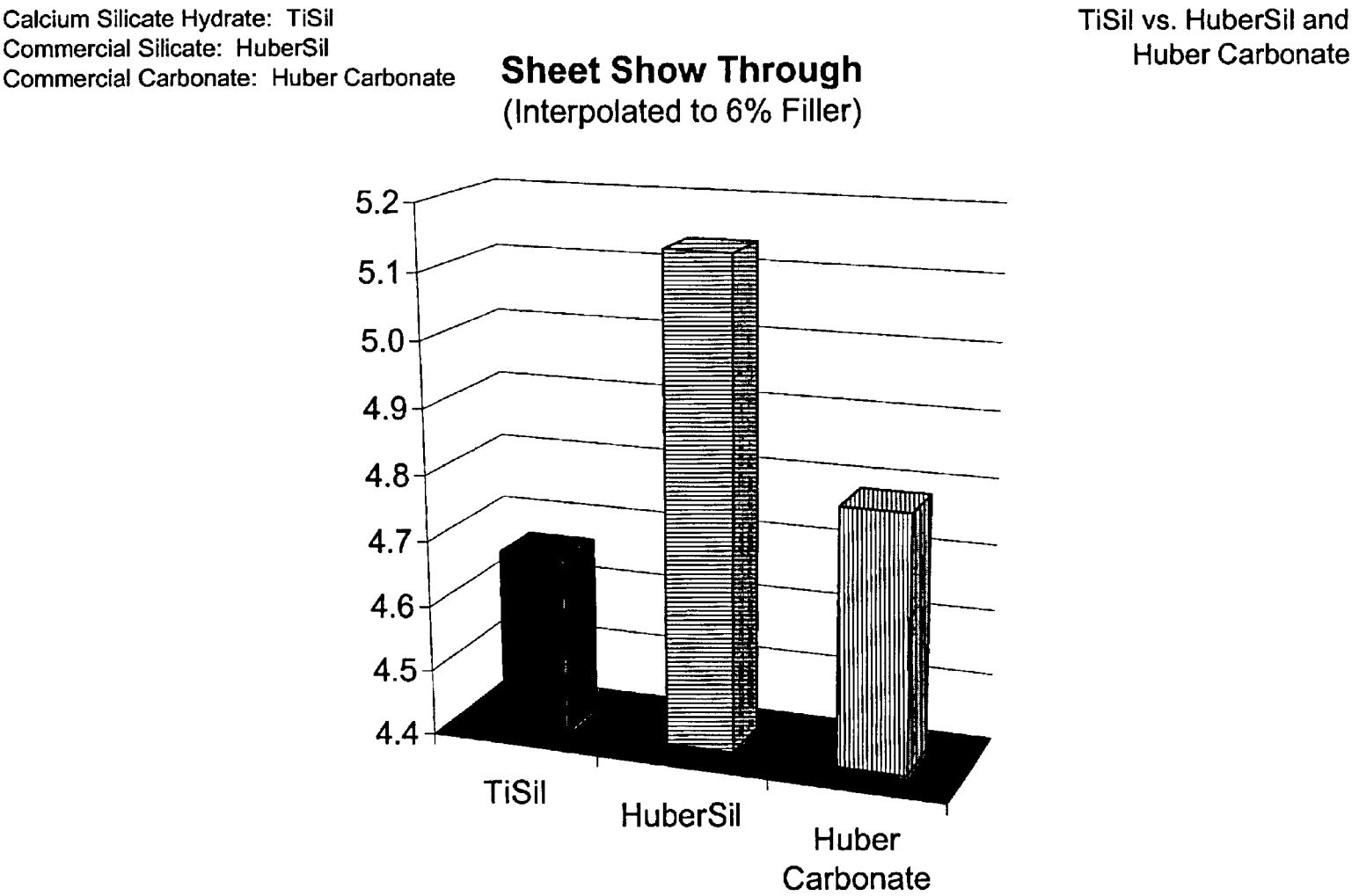
Fig 33: Sheet Show Through results on newsprint containing various fillers, interpolated to 6% Ash

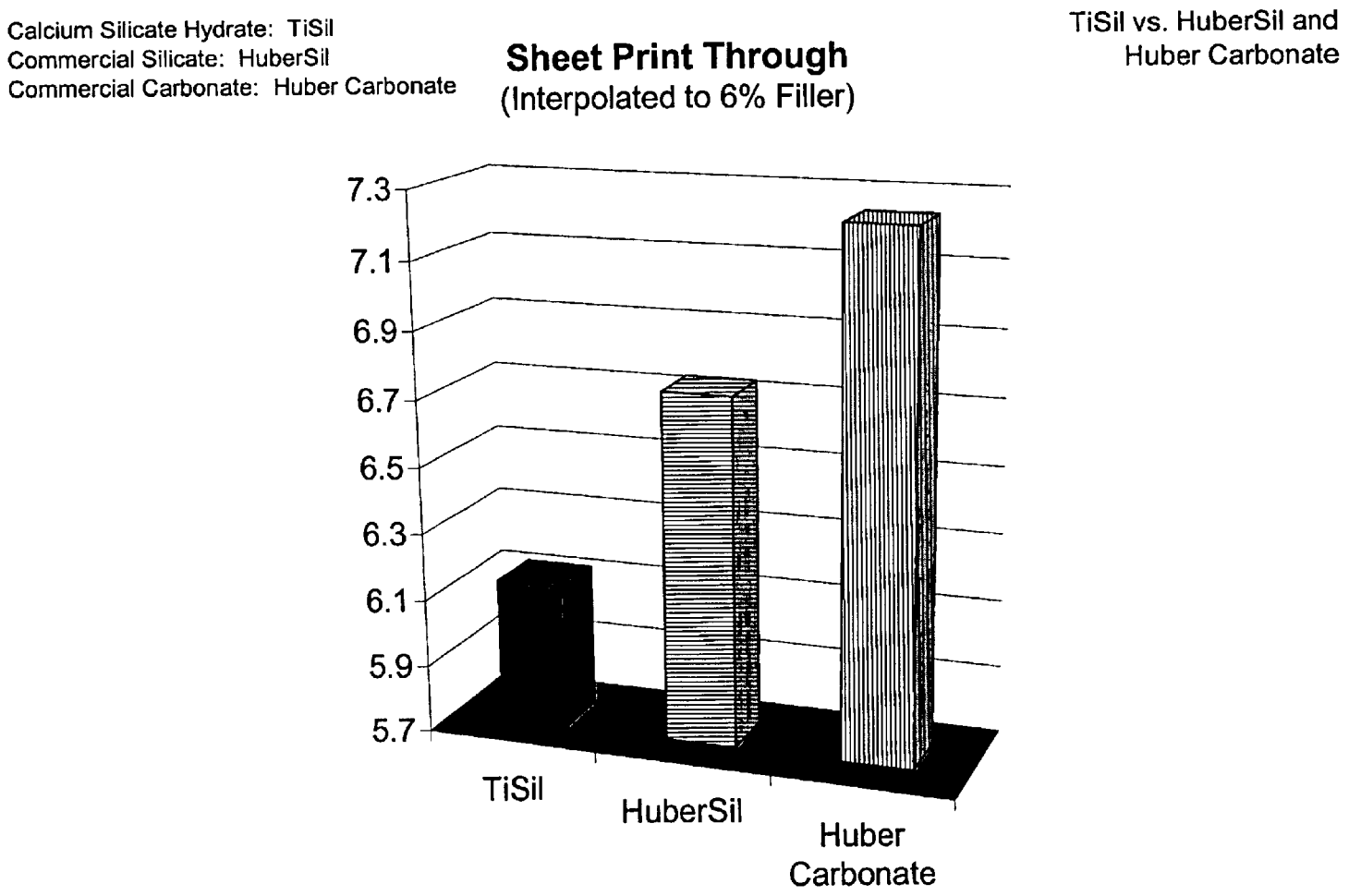
Fig. 34: Sheet Print Through results on newsprint sheets containing various fillers, interpolated to 6% Ash.

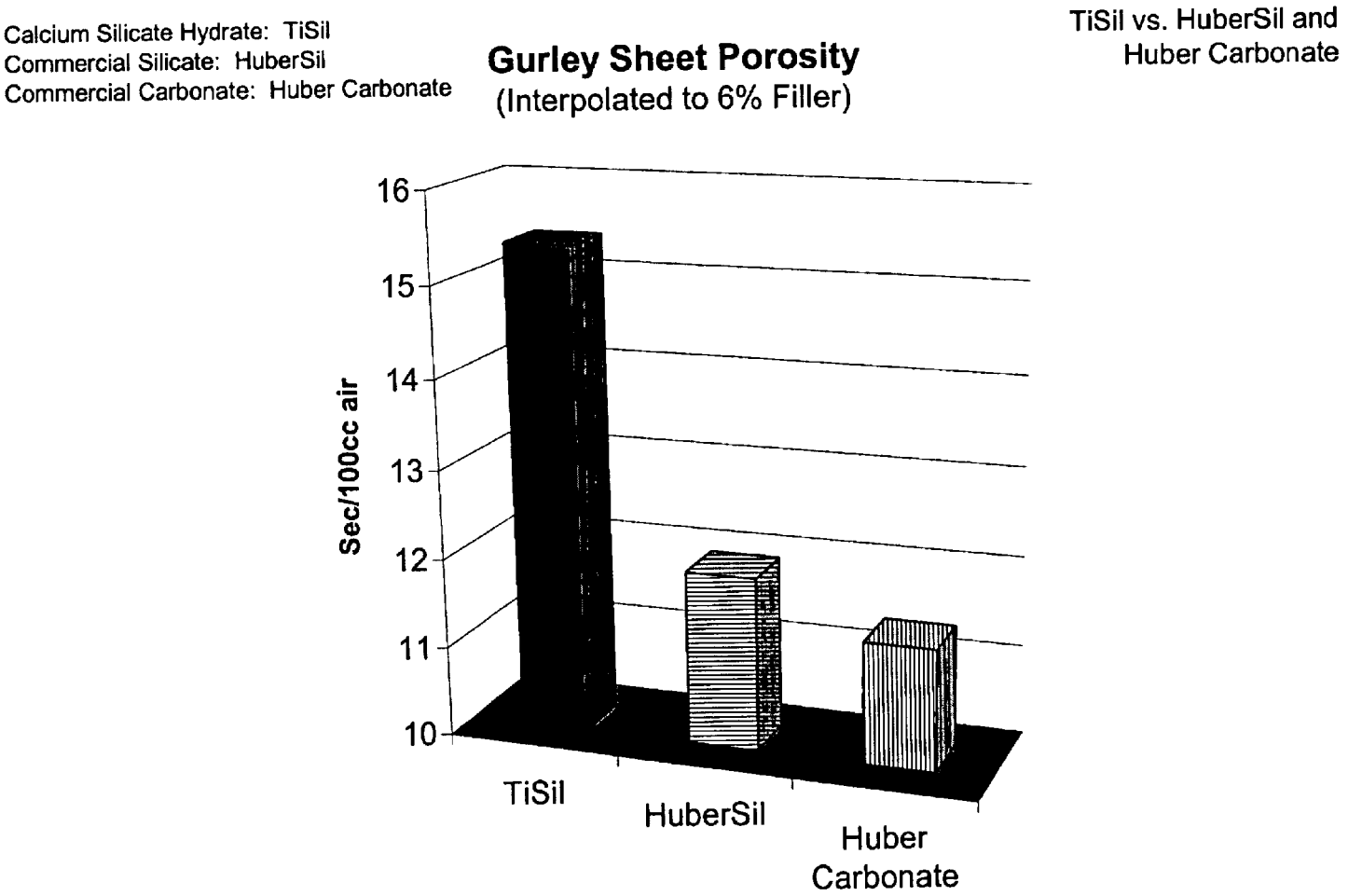
Fig 35: Gurley Sheet Porosity results for newsprint sheets containing various fillers, interpolated to 6% Ash

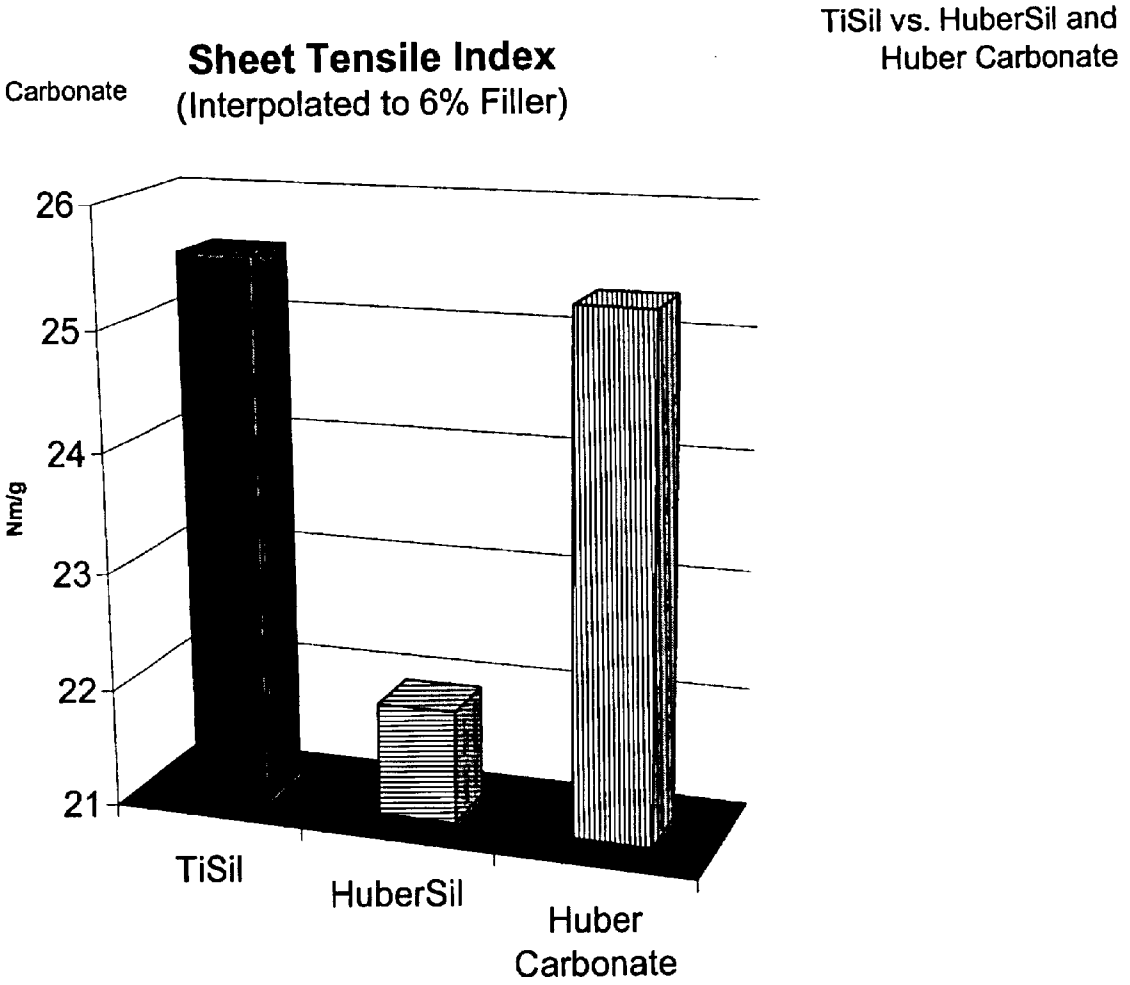
Fig 36: Sheet Tensile Index results for newsprint sheets containing various fillers, interpolated to 6% Ash

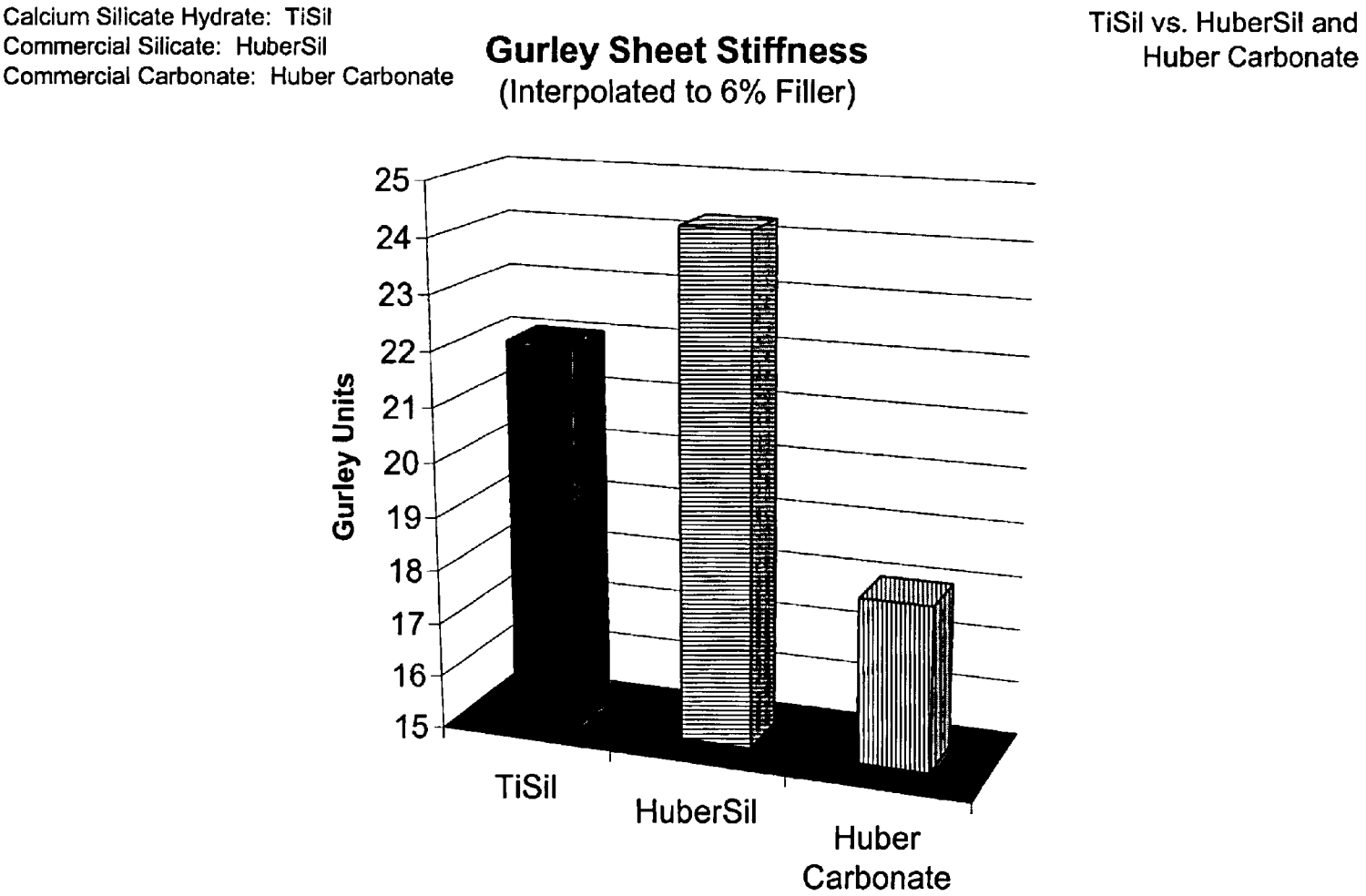
Fig 37: Gurley Sheet Stiffness results for newsprint sheets containing various fillers, interpolated to 6% Ash

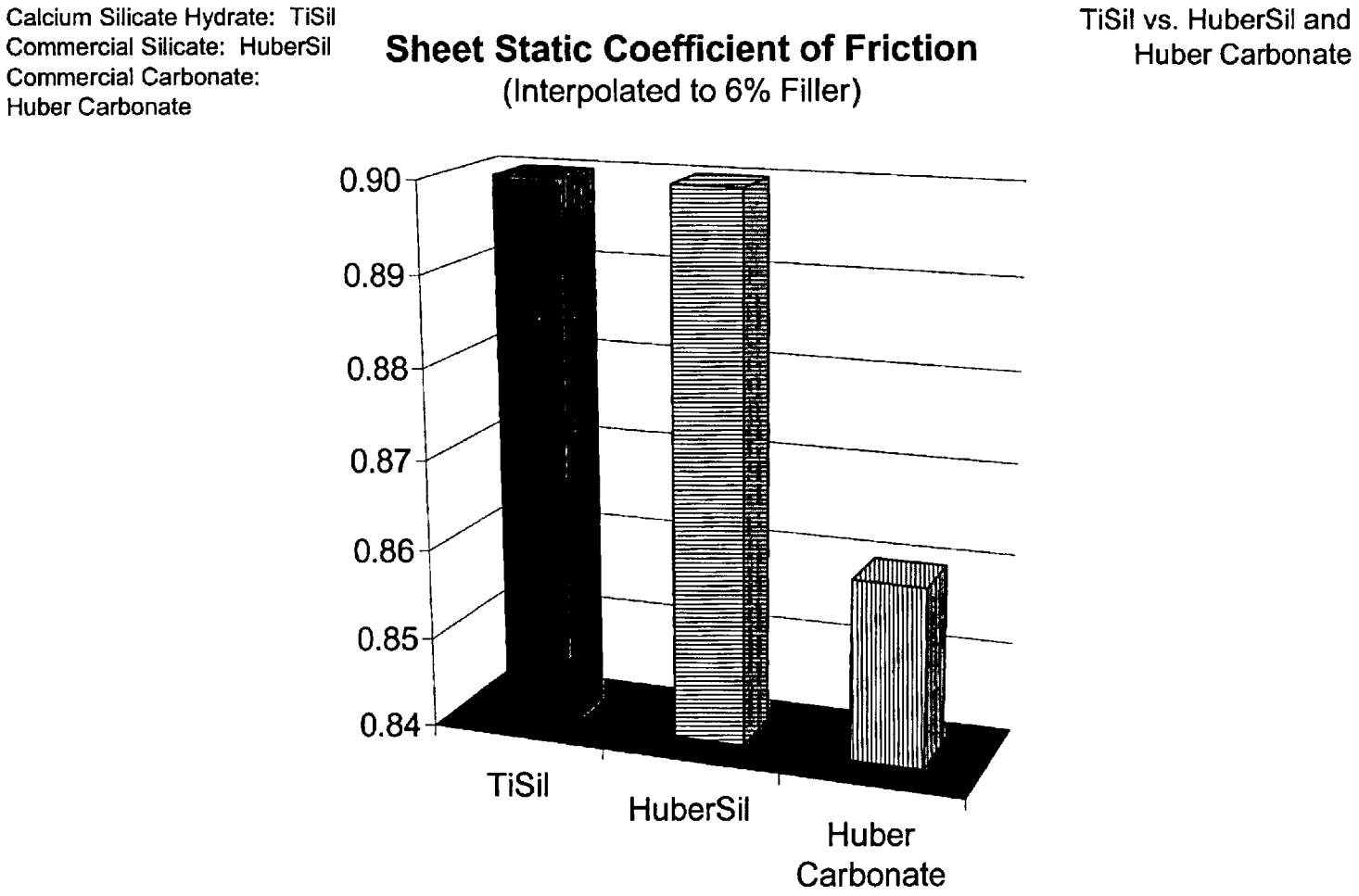
Fig 38: Sheet Static Coefficient of Friction results for newsprint sheets containing various fillers, interpolated to 6% Ash

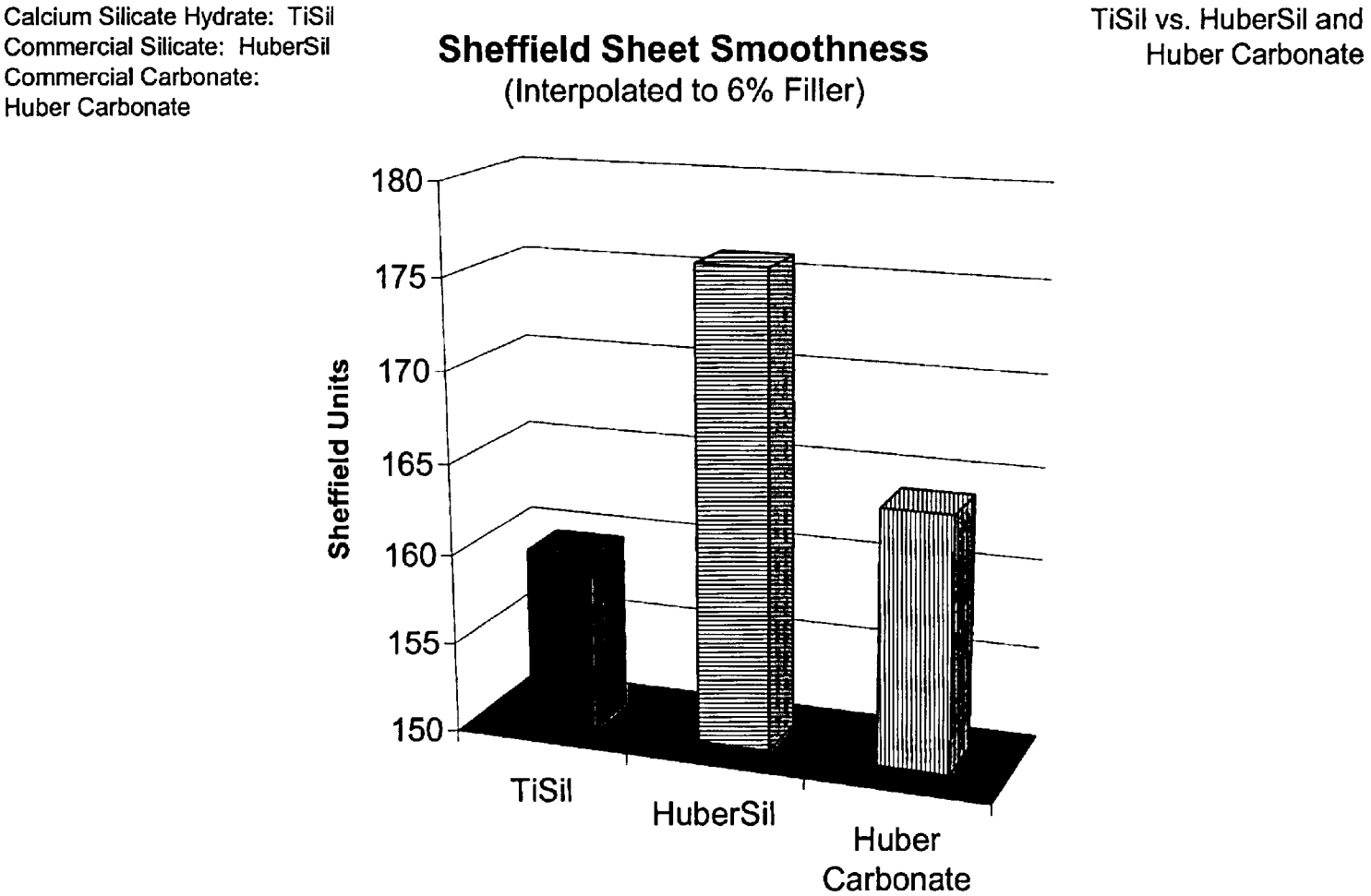
Fig 39: Sheffield Sheet Smoothness results for newsprint sheets containing various fillers, interpolated to 6% Ash.

MULTI-PHASE CALCIUM SILICATE HYDRATES, METHODS FOR THEIR PREPARATION, AND IMPROVED PAPER AND PIGMENT PRODUCTS PRODUCED THEREWITH

This application claims the benefit of Provisional application Ser. No. 60/150,862 filed Aug. 26, 1999.

TECHNICAL FIELD

This invention relates to the manufacturing of novel calcium silicate hydrate ("CSH") crystalline structures, and to pigment products, and novel to paper products produced therewith.

BACKGROUND

The paper industry currently utilizes many different types of fillers as a substitute for pulp fiber, as well as to provide desired functional and end-use properties to various paper and paper products. For example, clay has long been used as a filler or fiber substitute. Importantly, the use of clay also provides an improvement in print quality. However, one disadvantage of clay is that it is relatively low in brightness. And, the use of clay in papermaking leads to a decrease in tensile strength of the paper sheet, and to reductions in paper sheet caliper and stiffness.

Calcined clay was introduced to the paper industry in an effort to improve brightness and opacity in paper. However, one significant economic limitation of calcined clay is that it is relatively expensive. Also, physically, calcined claim is highly abrasive.

Titanium dioxide, $TiO_2$, is another example of a filler commonly used in papermaking. Most commonly, titanium dioxide is used to improve opacity of the paper sheet, and, in some cases, it is used to improve sheet brightness as well. Use of titanium dioxide is limited, though, because it is extremely expensive. Unfortunately, it is also the most abrasive pigment on the market today. This is important because highly abrasive pigments are detrimental in the paper industry since they wear down critical paper machine components, such as forming wires, printing press plates, and the like, ultimately leading to high life cycle costs due to the constant repair and maintenance costs.

When calcined clay was first introduced, it was touted as a titanium dioxide extender. Although it did succeed in extending $TiO_2$, it is nonetheless abrasive, and it is more expensive than either standard clay or market pulp fiber.

More recently, and particularly since the mid 1980's, ground calcium carbonate(GCC) has been used as a low cost alkaline filler. Although GCC improved sheet brightness, one downside to GCC was that it too is abrasive. Moreover, use of GCC reduces tensile strength, caliper and stiffness of paper sheets. Consequently, a paper sheet containing GCC tends to be rather limp.

Finally, one of the most commonly used alkaline paper fillers is precipitated calcium carbonate(PCC). PCC is presently one of the best compromise solutions for providing a high brightness filler at an economically feasible price. However, a significant downside to the use of PCC in paper sheets is that PCC provides a lower light scattering power than either $TiO_2$ or calcined clay. Also, it often reduces sheet strength and stiffness.

Thus, the paper industry still has an unmet need, and continues to look for, a multi-functional pigment that can simultaneously provide two or more of the following attributes:

a) cost that are less than $TiO_2$;

b) better optical properties than calcined clay;

c) better optical properties than GCC;

d) better optical properties than PCC;

e) minimal tensile strength loss associated with increased filler usage;

f) at least some improved strength characteristics, such as sheet stiffness.

In addition to the just stated criteria, if a paper filler could also simultaneously improve sheet porosity (i.e., provide a more closed sheet) yet provide higher sheet caliper, it would be a very highly desired filler material. To date, no single paper filler with such attributes has been brought to the market. Consequently, the development and commercial availability of such a filler would be extremely desirable.

Finally, the current industry demand for printing papers, especially the rapidly increasing demand for ink jet paper, requires a high performance paper. The performance of such paper would be enhanced by the availability of a pigment that would provide excellent water and oil absorption capacities, so that the paper could quickly capture and prevent ink from spreading or bleeding, as well as aid in surface drying of the ink.

Some of the key requirements for an ideal papermaking pigment can be summarized as set forth in Tables 1, 2 and 3 below.

TABLE 1

Idealized Paper Filler Attributes

| Sheet Attribute → | Opacity | Filler Scattering Coefficient | Sheet Scattering Power | Brightness |
|---|---|---|---|---|
| Industry Requirement → | HIGHER than pulp or carbonate fillers | HIGHER than pulp or carbonate fillers | HIGHER than pulp or carbonate fillers | EQUAL OR HIGHER than pulp or carbonate fillers |

TABLE 2

Key strength parameters for an "Ideal" pigment.

| Sheet Attribute → | Caliper | Bulk | Porosity | Sheet Smoothness | Stiffness | Tensile |
|---|---|---|---|---|---|---|
| Industry Requirement → | HIGHER than pulp sheet alone or with $CaCO_3$ fillers | HIGHER than pulp sheet alone or with $CaCO_3$ fillers | HIGHER than pulp sheet alone or with $CaCO_3$ fillers | HIGHER than pulp sheet alone or with $CaCO_3$ fillers | HIGHER than pulp sheet alone or with $CaCO_3$ fillers | HIGHER than pulp sheet alone or with $CaCO_3$ fillers |

TABLE 3

Key printing requirements for an "Ideal" pigment.

| Sheet Attribute → | Ink Penetration | Show Through | Print Through |
|---|---|---|---|
| Industry Requirement → | LOWER than pulp sheet alone or with $CaCO_3$ filler | LOWER than pulp sheet alone or with $CaCO_3$ filler | LOWER than pulp sheet alone or with $CaCO_3$ filler |

Currently, the papermaking industry uses various combinations of available fillers in order to optimize the properties as may be desired in a particular papermaking application. However, because currently available fillers reduce sheet strength to at least some extent, the industry relies on strength additives, such as starch and/or polymers, to maintain the desired paper strength properties when fillers are utilized. Unfortunately, because different pigments have different particle charge characteristics, additions of multiple pigments and additives in the paper making system often create an extremely complicated chemical system which may be somewhat sensitive and difficult to control.

In summary, there remains a significant and as yet unmet need for a high quality, cost effective filler which can be used to simultaneously achieve desired optical properties and sheet strength in paper products. Further, there remains a continuing, unmet need for a method to reliably produce such a pigment which has desirable optical properties and which provides significant cost benefits when compared to the use of titanium dioxide or other pigments currently utilized in the production of paper.

OBJECTS, ADVANTAGES AND NOVEL FEATURES

Accordingly, an important objective of my invention is to provide a process for the manufacture of unique calcium silicate hydrate ("CSH") products, which provide crystalline structures with desired brightness, opacity, and other optical properties.

Another important and related objective is to provide an economical substitute for current paper fillers such as titanium dioxide.

A related and important objective is to provide a method for the production of novel paper products using my unique calcium silicate hydrate product.

An important objective is to provide a new calcium silicate hydrate product with low bulk density, good chemical stability (particularly in aqueous solutions), and a high adsorptive capability, among other properties.

These and other advantages, and novel features of my multi-phase calcium silicate hydrates, the method for their preparation, and the improved pigments and paper products produced therewith will become evident and more fully appreciated from full evaluation and consideration of the following detailed description, as well as the accompanying tables and drawing figures.

SUMMARY

I have now discovered the process conditions required to reliably produce unique calcium silicate hydrate products with particularly advantageous properties for use as a filler in papermaking. The products are produced by reacting, under hydrothermal conditions, a slurry of burned lime (quick lime) and a slurry of fluxed calcined diatomaceous earth (or other appropriate starting siliceous material). Preferably, a fine slurry of each of the lime and the fluxed silica are utilized.

For one of my CSH products, the lime slurry is prepared by providing about 1.54 pounds of suspended solids per gallon of lime slurry. The silica slurry is prepared by providing about 1.55 pounds of suspended solids per gallon of water. The slaking of the lime slurry raises the temperature of the slurry to near the boiling point; this is accomplished before adding the same to the fluxed silica. The slurry of fluxed calcined diatomaceous earth is heated to near the boiling point, also, before it is mixed with the lime slurry. When both slurries are near atmospheric boiling point conditions, then they are mixed together and stirred, while being retained under pressure in an autoclave or similar reactor. Temperature of the reaction slurry is raised to between about 245 C. and 260 C., and the reaction is continued for about two hours, more or less. The CaO/SiO2 ratio is maintained, in the feed materials, of about 1.35 (+/− about 0.10) moles CaO to 1 mole of SiO2. After the reaction is completed, the product is cooled before the pressure is released and the product crystals are harvested.

Generally, the product of the above described reaction is a multi-phase mixture (i.e., two different forms or phases are present in the product), predominantly of foshagite, with some xonotlite. Importantly, small, haystack like particles containing complex multi-phase crystalline optical fibers are produced that can be advantageously employed in papermaking for coating and for wet end fillers. However, the hydrothermally produced multi-phase crystalline optical fibers are vastly improved over previously produced hydrothermal calcium silicate hydrates of which I am aware, at least with respect to their physical properties, their optical properties, and their utility as a filler in papermaking. Moreover, my unique CSH products are suitable for multiple end uses, such as filler for value added papers, for commodity papers, for newsprint, paper coating applications, as well as for paints, rubber compositions, and other structural materials.

It is important to appreciate that my hydrothermal process for the manufacture of my unique multiple phase calcium silicate hydrates ("CSH's"), including my novel multi-phase mixture of foshagite and xonotlite, ($CaO_4(SiO_3)(OH)_2$ and $C_6Si_6O_{17}(OH)_2$, respectively), results in a unique mixture of calcium silicate hydrates which have a unique and distinct X-ray diffraction pattern.

Further, the variables that affect the chemical composition of my CSH products, and the primary and secondary structure of the CSH particles and their characteristic properties, can be affected, among other things, by (a) the $CaO/SiO_2$ mole ratio, by (b) concentration of the CaO and of the $SiO_2$ in the reaction slurry, (c) the reaction temperature, and (d) the reaction time. By manipulating the just mentioned variables, I have been able to develop two novel pigment products. Those two products can be generally described as follows:

(1) A multi-phase calcium silicate hydrate having a primary phase of foshagite, and a secondary phase of xonotlite. I refer to this product as "TiSil" brand calcium silicate hydrate.

(2) A multi-phase calcium silicate hydrate complex having a primary phase fraction of riversidite with a minor phase fraction of xonotlite. I refer to this product as "StiSil" brand calcium silicate hydrate.

Figure 2:
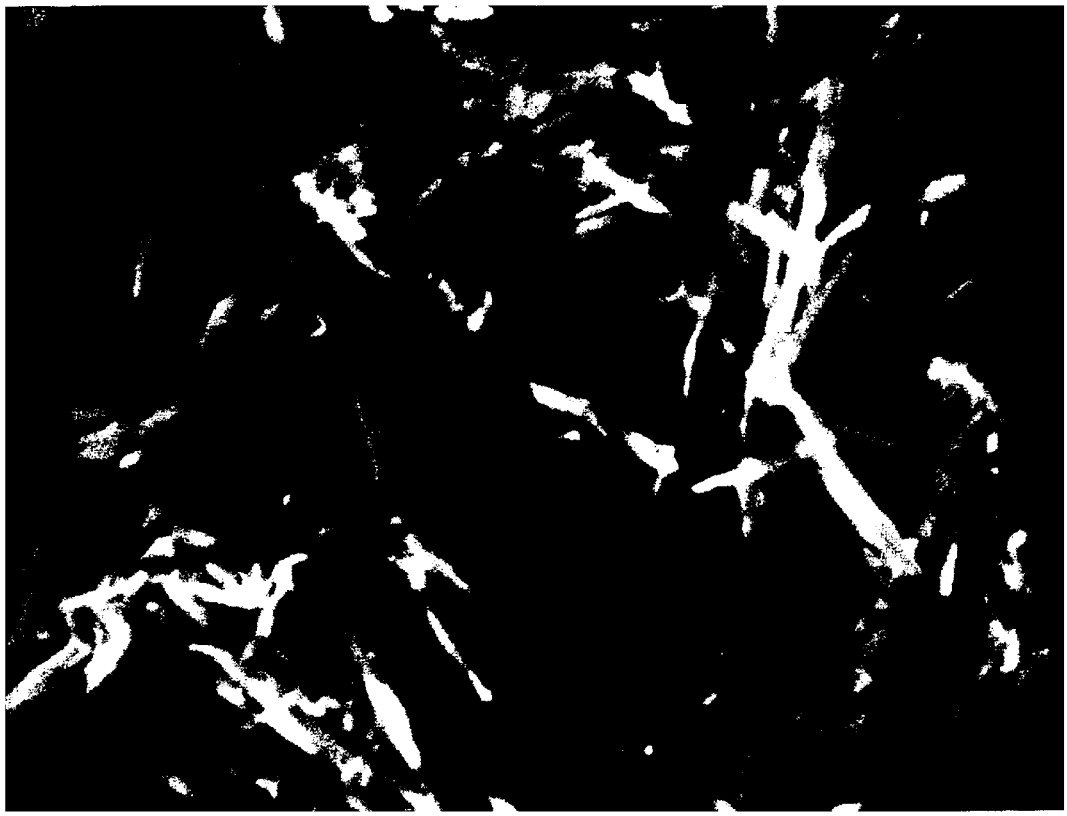
Figure 3:
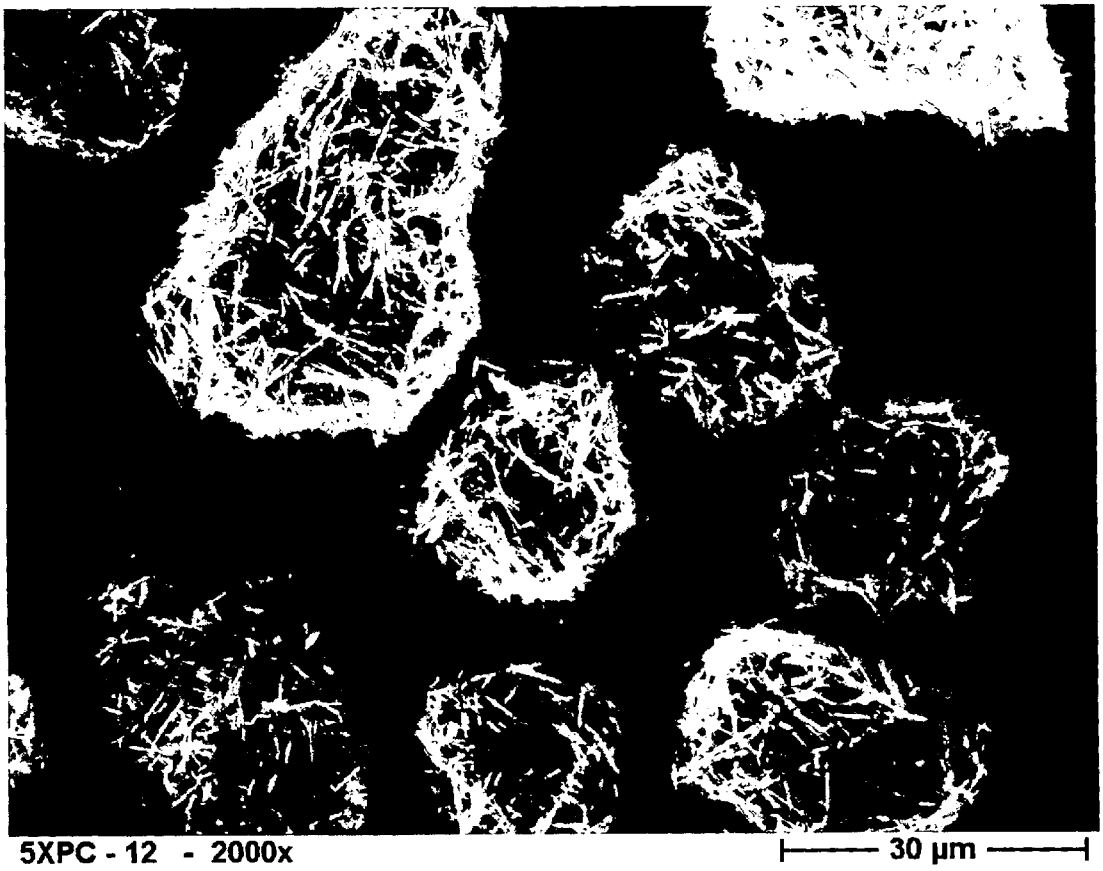

The first product is formed with a high CaO to $SiO_2$ mole ratio (about a 1 to 1, to about a 1.7 to 1 ratio of CaO to SiO2), at a high temperature (~200° C.–300° C.), with a low final slurry concentration (~0.4–0.6 lb of solids per gallon of slurry), and with a reaction time of approximately 2 hours. It has a characteristic X-ray diffraction pattern as shown in FIG. 1. The scanning electron micrographs (SEMS) of this product are shown in FIGS. 2 and 3. As is evident from the SEMs, this product consists of primary, fibrous particles joined together, and thus, produces a secondary, three dimensional, "hay-stack" structure. The physio-chemical characteristics of this product are unique. For example, extremely high water absorption is provided. This pigment also provides unique paper properties when utilized in papermaking. For example, this pigment, when used as a filler, can improve the optical properties along with sheet strength, sheet bulk, sheet smoothness, and sheet porosity, simultaneously.

The second product is formed by reacting lime and silica with a low mole-ratio (about a 0.85 to 1 ratio of CaO to SiO2), a low reaction temperature (~180° C. to 190° C.), at a high final slurry concentration (~0.7–1.0 pounds of solids per gallon of slurry), and with a reaction time of approximately 2 hours. This calcium silicate is quite different from the first product just mentioned above and its unique X-ray diffraction pattern is given in FIG. 4. The scanning electron micrographs (SEMS) for this product are given in FIGS. 5 and 6. As the SEMs indicate, this product consists of some fibrous growths that in turn grow randomly and almost continuously to provide an irregular globular structure. This product is uniquely formulated to provide ultra high sheet stiffness when it is used as a filler in paper.

In summary, the unique features of these hydrothermally produced calcium silicate hydrate products include:

a unique crystallo-chemical composition a multi-phase crystal system a primary and secondary fibrous particle structure a high water absorptivity (in the ~300%–1000% range).

The result of the unique properties and physical structure enable these unique CSH products to provide a combination of beneficial properties to paper products in a manner heretofore unknown by paper fillers. For example, the use of these products in paper can increase sheet bulk and Gurley porosity, simultaneously. In addition, these products are made up of large particles, but the products can still scatter light better than PCC, GCC, clay, or even calcined clay.

DETAILED DESCRIPTION

In order to prepare my unique calcium silicate hydrates (CSH) products, it is first necessary to prepare a source of calcium. This is normally accomplished by the formation of a slurry of calcious material, most commonly lime however, there are several different sources of calcium, which may be used. Some examples are $CaCO_3$, $CaCl_2$, and hydrated lime. I have found it advantageous to employ pebble lime, if less than ½ inch dimension. First, the CaO was slaked in water. The amount and the rate of addition of lime were set and maintained in order to obtain a desired concentration of lime slurry. Because the slaking of lime is an exothermic process, it was necessary to control both the rate of addition of lime and the quantity of water used. When slaking, the best temperature was determined to be near boiling, i.e., close to 100° C. (212° F.) in order to form lime particles as fine as possible. Once the slaking was complete, the lime slurry was then screened through a 200 mesh screen to remove any grit and oversized particles. The screened and slaked lime slurry was tested for available lime (as CaO) and then transferred to an autoclave.

The chemistry of the slaking process can be given as follows:

$$CaO+H_2O \rightarrow Ca(OH)_2 \quad 1)$$

(solid) (aqueous)

$$Ca(OH) \leftrightarrows Ca^{++}+2OH^- \quad 2)$$

(aqueous)

The solubility of calcium hydroxide slurry is inversely proportional to the temperature, as indicated in FIG. 7.

Next, it is necessary to prepare a slurry of siliceous material (i.e., a SiO2 slurry). Various siliceous materials such as quartz, water glass, clay, pure silica, natural silica (sand), diatomaceous earth, fluxed calcined diatomaceous earth, or any combination thereof may be utilized as a source of siliceous material. I prefer to utilize an ultra fine grade of fluxed, calcined diatomaceous earth. This raw material was prepared into a slurry of ~1.55 lbs of solids per gallon water. The slurry was then preheated to near boiling, i.e., near 100 C.

Importantly, the solubility of silica (unlike that of $Ca(OH)_2$), is directly proportional to temperature, as seen in FIG. 8. For example, quartz (line A in FIG. 8) is only slightly soluble up to 100° C. From 100° C. to 130° C., it starts solubilizing and around 270° C., it reaches its maximum solubility of about 0.07%.

The dissolution of silica can be represented as follows:

$$(SiO_2)_n+2n(H_2O) \rightarrow nSi(OH)_4 \quad 3)$$

The solubility of silica can be increased by raising the pH, and/or by using various additives (i.e. sodium hydroxide). In addition the rate of silica solubility is also a function of particle size, thus to enhance solubilization of the silica, I prefer to utilize ultra fine fluxed calcined diatomaceous earth.

Next, the siliceous slurry was mixed with the lime slurry in an autoclave, to achieve a hydrothermal reaction of the two slurries. Important, the amount of CaO in the lime slurry and the amount of $SiO_2$ in the fluxed calcined diatomaceous earth slurry were pre-selected to provide a predetermined $CaO/SiO_2$ mole ratio. Also, the concentration of the two slurries (CaO and $SiO_2$) was selected so that the final concentration of the reaction mixture in the autoclave falls between about 0.2 pounds of solid per gallon of slurry to about 1.0 pounds of solid per gallon of slurry.

The hydrothermal reaction itself was carried out in a pressurized vessel, with three major steps:

1) Heating the slurry to the desired temperature (e.g. 180° C. to 300° C.)

2) Reacting at temperature for a specified time (e.g. 60 min to 240 min).

3) Stopping the reaction and cooling down

In my laboratory, the reaction autoclave was cooled by passing quenching water through an internal cooling coil, or by utilizing an external jacketed cooling system. I prefer to utilize a cool down process of from approximately 25 to 30 minutes to drop the temperature from about 230° C. to about 80° C., as indicated in FIG. 9.

The process steps just mentioned are very important. This is because I have utilized the inverse solubilities of lime and silica with respect to temperature and time in an effort to produce the desired reaction composition, to arrive at the desired multi-phase calcium silicate hydrate product.

Without limiting my invention to any particular theory, I can postulate the following reaction during the hydrothermal reaction between calcious material and siliceous material. First, during the heating process, very few free $Ca^{++}$ ions are available. After 100° C., the silica starts going into a gel stage. Beyond 130° C., the silica ions become available for reacting. As the temperature nears 180° C., the calcium ion $Ca^{++}$ reacts with the $Si^{+}$ ion to form a metal silicate. The reaction can be written as follows:

$$x[Ca^{++}+2OH^{-}]+y[Si(OH)_4]\rightarrow CaO_x(SiO_2)_y+(x+y)H_2O \quad 4)$$

Where: x=1 to 6 y=1 to 6

The solid $Ca(OH)_2$ particles react with $SiO_2$ in the gel phase to give a calcium silicate hydroxide whose crystallo-chemical structure can be written as $Ca_6Si_6O_{17}(OH)_2$ (Xonotlite). As the temperature is further raised from 180° C. to 250° C., calcium silicate hydride condenses with the remaining $Ca(OH)_2$ particles to give yet another calcium silicate hydroxide, this time with a distinct X-ray diffraction pattern and a crystallo-chemical formula of $CaO_4(SiO_3)_3(OH)_2$ (Foshagite).

Further, I have developed my hydrothermal reaction process so that more than one unique calcium silicate hydrate can be produced. In this respect, it is important to note that the following variables are critical in producing a desired end product:

1) Slaking Temperature
2) $CaO/SiO_2$ mole ratio
3) Slurry Concentration
4) Reaction Temperature
5) Reaction Time at Temperature By changing these variables, a product having several different phases of calcium silicate hydroxide can be produced. Some of these phases may include:

| | | X-ray Diffraction peaks | |
|---|---|---|---|
| Formula | Morphology | Major | Minor |
| $Ca_4(SiO_3)_3(OH)_2$ | Foshagite | d = 2.93 Å, d = 2.16 Å, d = 4.96 Å | |
| $Ca_6Si_6O_{17}$ | Xonotlite | d = 3.02 Å, d = 2.04 Å, d = 8.50 Å | |
| $Ca_5Si_6O_{17}(OH)_2$ | Riversideite | d = 3.055 Å, d = 3.58 Å, d = 2.80 Å | |

Although not normally important, one should note that my final product CSH composition may also contain minor amounts of calcite—aragonite, produced as a result of side reactions.

The first and most important product of my process is a multi-phase CSH composition having various amounts of phases of matter represented by $CaO_4(SiO_3)_3(OH)_2$ (Foshagite) and $Ca_6Si_6O_{17}(OH)_2$ (Xonotlite). A unique X-ray diffraction pattern for this product is provided in FIG. 1. In that XRD, the crystallochemical formula of the mixture, and the characteristic d spacings, are given below:

| | |
|---|---|
| (Phase I) (Major) | |
| Foshagite $CaO_4(SiO_3)_3(OH)_2$ | d = 2.97 Å, d = 2.31 Å, d = 5.05 Å |
| (Phase II) (Minor) | |
| Xonotlite $Ca_6Si_6O_{17}(OH)_2$ | d = 3.107 Å, d = 1.75 Å, d = 3.66 Å |

The Scanning Electron Micrographs (SEMs) representing this first product are provided in FIGS. 2 and 3. As shown in FIGS. 2 and 3, it is important to note that the product consists of primary particles and secondary particles. The primary particles have a diameter between 0.1 and 0.2 microns and a length between 1.0 and 4.0 microns. FIG. 3 also indicates that the primary particle has two phases. The rod or ribbon like structure is characteristic of xonotlite ($Ca_6Si_6O_{17}(OH_2)$) while the predominant structures are thin and fibrous, characteristic of foshagite ($Ca_4(SiO_3)_3(OH)_2$). The diameter of the foshagite crystals ranges from 0.1 to 0.3 microns and the length is ranges from 2.0 to 5.0 microns.

The SEM of FIG. 3 reveals a secondary, three dimensional structure. This three dimensional structure is believed to be formed by the interlocking of the fibrous material and the continuous growth of the "gel" like material at the intersection of the individual particles. This may also be the reason that the secondary structure is fairly stable. Importantly, the secondary structure can generally withstand the shear forces encountered during the discharge of material from pressure vessels after the reaction has completed, as well as shear forces encountered during papermaking. This is seen, for example, in that the secondary structure maintains its "bulk density" during some of the end use processes such as calendering during paper making. The particle size of secondary structure, as measured by particle size measuring devices like the Malvern Mastersizer, is in the range of 10–40 microns.

The calcium silicate hydroxide mixture of my invention also has very high brightness characteristics. A comparison with other pigments is given below:

Various pigments and their typical published brightness values are as follows:

| Pigment | GE (TAPPI) Brightness (%) |
|---|---|
| Calcium Silicate Hydrate (TiSil Brand CSH) | 95–97 |
| Calcined (High Brightness) Clay | 89–91 |
| Filler Clay | 85–88 |
| Synthetic Silica | 97–100 |
| Calcium Carbonate | 95 ± 1 |

One of the most significant characteristics of the composition of matter produced by my process is the ability of these multiple phase calcium silicates to absorb large amounts of water. These calcium silicates can adsorb anywhere from 350% to 1000% of their weight. This high water absorption capacity makes my pigment extremely well suited for preventing ink strike through in writing and printing papers, newsprint and more.

EXAMPLE 1

Manufacture of Multiple Phase Silicate Hydrates (5XPC 12)

Initially, 135.09 grams of 1/2" rotary pebble lime (Mississippi Lime Co.) was accurately weighed and slaked in 410 milliliters of de-ionized water. The slaking reaction is exothermic and caused the slurry temperature to rise to near boiling. When the slurry temperature was very near boiling and before much of the water had evaporated, an additional 1190 milliliters of water was added to both dilute and cool the slurry. The slurry was then agitated for 30 minutes to insure slaking completion before being screened through a 140 mesh screen. The slurry was then transferred to 5 liter autoclave and tested for lime availability in accordance with ASTM method C25. The autoclave is fitted with an outside heating element contained in an insulated jacket housing. The autoclave is also fitted with a variable speed magnetic drive for stirring the slurry during reaction. Approximately 109.6 grams of ultra fine fluxed calcined diatomaceous earth was weighed and added to 750 ml of hot water (concentration of ~1.22 lb/gallon). The silica slurry was heated for approximately 10 min, to near boiling, then added to the screened and tested lime slurry. The exact amount of silica slurry added to lime slurry was determined by the lime availability such that a mol ratio of 1.35 mol $CaO/SiO_2$ would be maintained. The total slurry volume was also adjusted to a final concentration of 0.425 lb/gallon. The high pressure vessel was then closed, sealed, and connected to an automated heating/cooling control system (RX 330). The contents of the autoclave were under constant agitation via the magnetic drive motor mentioned above.

The high pressure reactor was heated by an externally jacketed heating element. The autoclave was continuously agitated at a constant speed of 338 rpm. The reactor was heated for approximately 100 min in order to reach the target temperature of 245° C. (473° F.). The temperature was maintained at 245° C. for 2 hours, after heating to the target temperature was accomplished, with the use of the heating/cooling controller. At the end of the reaction, the "quenching" water was flushed through the cooling coil built inside the autoclave. This cooling process was maintained until the inside vessel temperature reached approximately 80° C.(approximately 30 min). At which point, the vessel was opened and the reaction products were transferred to a holding vessel for storage. A portion of the resultant slurry was dried in a 105° C. oven for 12 hours. During the drying process, the slurry formed hard lumps, which had to be broken up through the use of a mortar and pestle. The now powdered, dry product was brushed through a 140 mesh screen to insure product uniformity when testing. The pigment in this example was designated 5XPC 12. The test carried out on the dry powder were as follows:

1) X-ray diffraction analysis
2) Scanning Electron Micrograph (S.E.M.)
3) Brightness
4) Percent Water Absorption
5) Air Permeability (Blaine Method)
6) pH For the air permeability test, two numbers are reported. The first is the weight in grams of powder required to fill the capsule and is an indication of the "bulk density" of the powder. The second is the time in seconds for a controlled volume of air to pass through the compressed powder inside the capsule and is an approximate measure of the "structure" of the particle.

The process conditions are given in Table 1a and the pigment properties are given in Table 1b.

TABLE 1a

Process conditions of 5XPC 12

| Batch # | Mol Ratio ($CaO/SiO_2$) | Concentration (lb/gallon) | Temperature (° C.) | Average Pressure (psi) | Reaction Time (hours) |
|---|---|---|---|---|---|
| 5XPC 12 | 1.35 | 0.425 | 245 | 456 | 2.0 |

TABLE 1b

Pigment Properties of 5XPC 12

| Batch # | GE Brightness (% reflectance) | Water Absorption (%) | Air Permeability Blaine Wt. (g) | Air Permeability Blaine time (sec.) |
|---|---|---|---|---|
| 5XPC 12 | 96.4 | 880 | 0.35 | 81.8 |

The x-ray diffraction pattern of this novel, multiphase calcium silicate hydrate is given in FIG. 1. This product (identified as 5XPC 12) gave a unique x-ray pattern. The pattern indicated that the powder had one major phase and one minor phase. The summary of the characteristic "peaks" is shown in Table 1c.

The major peaks for phase I were found to indicate the presence of calcium silicate hydroxide—Foshagite—($Ca_4(SiO_3)_3(OH)_2$) with major peaks at d(Å)=2.97, d(Å)=2.31 and a minor peak at d(Å)=5.05. For phase II, the x-ray diffraction pattern indicated the presence of calcium silicate hydrate—Xonotlite—($Ca_6Si_6O_{17}(OH)_2$) with major peaks at d(Å)=3.107, d(Å)=1.75 and a minor peak at d(Å)=3.66. Thus I obtained a novel combination of Foshagite and Xonotlite from a single reaction.

TABLE 1c

X-ray diffraction peak summary for 5XPC 12

| Common Name | Crystallochemical Formula | d-spacing (Major) | d-spacing (median) | d-spacing (Minor) |
|---|---|---|---|---|
| Foshagite (Phase I) | $CaO_4(SiO_3)_3(OH)_2$ (Major) | d = 2.97 Å | d = 2.31 Å | d = 5.05 Å |
| Xonotlite (Phase II) | $Ca_6Si_6O_{17}(OH)_2$ (Minor) | d = 3.107 Å | d = 1.75 Å | d = 3.66 Å |

The S.E.M. pictures at 10,000 times and 2000 times magnification are given in FIGS. 2 and 3, respectively. The high magnification S.E.M. clearly shows the fibrous structure of Foshagite and a small fraction of "rod" or "ribbon" like, tubular structures of Xonotlite. The diameter of the Foshagite "fibers" ranges from 0.1 to 0.2 microns while the length ranges from 1 to 5 microns. The Xonotlite particles had diameters in the range of 0.1 to 0.3 microns and a length in the range of 1 to 3 microns.

The low magnification S.E.M. depicts the three dimensional structure of the secondary particles of calcium silicate hydrates. The structure appears to have been formed by an interlocking of the primary "fibrous" crystals and some inter-fiber bonding due to hydrogel of silica formed during the initial stages of hydro-thermal reaction. Because of these two main reasons, the secondary particles are fairly stable and do not significantly lose their 3-d structure when subjected to process shear. In addition, these particles also seem to withstand the pressure encountered during the calendering or finishing operations integral to papermaking. The median size of the secondary particles as seen, ranges from 10 to about 40 microns.

In order to evaluate this pigment in paper, handsheets were prepared for evaluation. Handsheets were prepared using the 5XPC 12 product sample in order to evaluate the papermaking characteristics of the pigment. The procedure included preparation of a standard pulp slurry made up of 75% hardwood and 25% softwood. Both pulp sources were beaten separately, in a Valley Beater, to a specific Canadian Standard Freeness of 450±10 in accordance with TAPPI test methods T-200 and T-227. Handsheets were formed from the prepared stock, on a 6" British handsheet mold, in accordance with TAPPI test method T-205. The exceptions to the standard method were as follows. Since the goal of producing these handsheets was to test filler performance, some filler was incorporated into the handsheets at various replacement levels (usually 15%, 20%, and 25%). In order to achieve comparability between different levels, a constant basis weight was achieved via a reduction in fiber content. Thus, a 25% filled sheet would contain only 75% of the fiber that the unfilled sheet had. The next variation on the standard test method was the addition of retention aid. A retention aid (Percol 175) was added to hold the filler in the sheet until the sheet had dried completely. All other handsheet formation components were kept consistent with TAPPI test method T-205.

The handsheets were tested in accordance with TAPPI test method T-220, with one exception. Instead of using a 15 mm sample for testing tensile, a 25.4 mm sample was used and the tensile index calculations were altered accordingly. The handsheets were ashed in accordance with TAPPI test method T-211.

Paper handsheets were tested for the following properties:

1. Opacity
2. Sheet Scattering Coefficient
3. Filler Scattering Coefficient
4. Brightness
5. Sheet Bulk (Basis Weight/Caliper ratio)
6. Sheet Stiffness
7. Sheet Porosity
8. Sheet Smoothness
9. Sheet Tensile Index A standard alkaline filler, precipitated calcium carbonate (SMI Albacar HO), was used as a reference material to gauge product performance. The results of the handsheet evaluation are given in Tables 1d and 1e.

TABLE 1d

Optical property performance of handsheets containing 20% (interpolated) 5XPC 12 and pulp only.

| Pigment | Brightness (ISO) | Opacity (ISO) | Sheet Scattering Coefficient ($cm^2/g$) | Filler Scattering Coefficient ($cm^2/g$) |
|---|---|---|---|---|
| 5XPC 12 | 90.56 | 90.88 | 835.21 | 3077.24 |
| Pulp Only | 85.73 | 73.19 | 274.8 | NM |
| Improvement over pulp | +5.6% | +24.2% | +203.9% | — |

TABLE 1e

Strength property performance of handsheets containing 20% (interpolated) 5XPC 12 and pulp only.

| Pigment | Stiffness (Gurley Units) | Bulk ($cm^3/g$) | Porosity (sec/100 cc air) |
|---|---|---|---|
| 5XPC 12 | 150.74 | 1.73 | 64.91 |
| Pulp Only | 137.15 | 1.40 | 51.94 |
| Improvement over pulp | +9.9% | +23.3% | +25.0% |

TABLE 1f

Optical property performance of handsheets containing 20% (interpolated) 5XPC 12 and 20% (interpolated) PCC.

| Pigment | Brightness (ISO) | Opacity (ISO) | Sheet Scattering Coefficient ($cm^2/g$) | Filler Scattering Coefficient ($cm^2/g$) |
|---|---|---|---|---|
| 5XPC 12 | 90.56 | 90.88 | 835.12 | 3077.24 |
| PCC | 90.44 | 88.69 | 709.84 | 2474.48 |
| Improvement over PCC | Even | +2.47% | +17.66% | +24.36% |

TABLE 1g

Strength property performance of handsheets containing 20% (interpolated) of 5XPC 12 and 20% (interpolated) PCC.

| Pigment | Bulk ($cm^3/g$) | Porosity (sec/100 cc air) | Stiffness (Gurley Units) | Tensile Index (Nm/g) |
|---|---|---|---|---|
| 5XPC 12 | 1.73 | 64.91 | 150.74 | 31.17 |
| PCC | 1.55 | 22.24 | 107.54 | 27.95 |
| Improvement over PCC | +11.56% | +191.9% | +40.17% | +11.53% |

EXAMPLE 2

5XPC—27 Pigment Sample

This novel, multiphase calcium silicate hydrate was formed by hydro-thermal reaction of lime and silica. The $CaO/SiO_2$ mol ratio used for this new product was 0.85, the final slurry concentration was ~0.8 lb/gallon, the reaction temperature was 190° C., and the reaction time was 2.5 hours. A summary of these conditions is given in Table 2a.

A totally new product was formed using a new set of reaction conditions. First, the $CaO/SiO_2$ mol ratio was adjusted to 0.85, the reaction temperature was set to 190° C., the slurry concentration was increased to 0.75 lbs/gallon, and the reaction time was increased to 2.5 hours. The product of this example was designated 5XPC 27. A summary of the reaction conditions is given in Table 2a.

TABLE 2a

Process conditions of 5XPC 27

| Batch # | Mol Ratio ($CaO/SiO_2$) | Concentration (lb/gallon) | Temperature (° C.) | Average Pressure (psi) | Reaction Time (hours) |
|---|---|---|---|---|---|
| 5XPC 27 | 0.85 | 0.75 | 190 | 163.5 | 2.5 |

The resulting calcium silicate hydrate was tested for pigment brightness, water absorption, Blaine air permeability and density, and pH. Both X-ray diffraction and Scanning Electron Micrograph analyses were also performed on this product. The pigment properties are given in Table 2b. The pigment was evaluated for its performance in paper by incorporating it into handsheets as in example 1. The results of the handsheet work are given in Tables 2d and 2e. The X-ray diffraction pattern is given in FIG. 4. The S.E.M. pictures at 10,000 and 2000 times magnification are given in FIGS. 5 and 6, respectively.

The calcium silicate hydride formed under these conditions had substantially lower brightness and water absorption characteristics than TiSil Brand CSH set forth in Example 1. However, it gave much higher sheet bulk and sheet permeability characteristics. The pigment properties of my novel 5XPC 27 pigment are given in Table 2b. It appears that this product provided a much higher sheet bulk. Also, the sheet permeability of this new product was higher than the Foshagite-Xonotlite complex as described in Example 1.

TABLE 2b

Pigment Properties of 5XPC 27

| Batch # | G.E. Brightness (% reflectance) | Water Absorption (%) | Air Permeability Blaine Wt. (g) | Air Permeability Blaine time (sec.) |
|---|---|---|---|---|
| 5XPC 27 | 91.2 | 360 | 0.5 | 17.0 |

As the mole ratio of $CaO/SiO_2$ was reduced to ~0.85 and the reaction temperature was lowered to 190° C., I discovered another unique and useful multiple phase calcium silicate hydrate material with a distinct and unique X-ray diffraction pattern. The X-ray diffraction analysis revealed this product to be a mixture of Riversidite [$Ca_5Si_6O_{16}(OH)_2$] and Xonotlite [$Ca_6Si_6O_{17}(OH)_2$]. The X-ray diffraction pattern is given in FIG. 4. The pattern indicated that the powder had one major phase and one minor phase. The peak summary is shown in Table 2c.

TABLE 2c

X-ray diffraction peak summary for 5XPC 27

| Common Name | Crystallochemical Formula | d-spacing (Major) | d-spacing (Median) | d-spacing (Minor) |
|---|---|---|---|---|
| Riversideite (Phase I) | $Ca_5Si_6O_{16}(OH)_2$ (Major) | d = 3.055 Å | d = 3.58 Å | d = 2.80 Å |
| Xonotlite (Phase II) | $Ca_6Si_6O_{17}(OH)_2$ (Minor) | d = 3.056 Å | d = 4.09 Å | d = 2.50 Å |

The major peaks for phase I were found to indicate the presence of calcium silicate hydrate—Riversideite—($Ca_5Si_6O_{16}(OH)_2$) with major peaks at d(Å)=3.055, d(Å)=3.58 and a minor peak at d(Å)=2.80. For phase II, the pattern indicated the presence of calcium silicate hydroxide—Xonotlite—($Ca_6Si_6O_{17}(OH)_2$) with major peaks at d(Å)=3.056, d(Å)=4.09 and a minor peak at d(Å)=2.50. The pigment also contained trace amounts of calcite ($CaCO_3$). The other portion of the slurry was tested for the pigment performance as a filler in paper. The paper was formed into handsheets and tested using the procedures described in example 1.

Figure 5:
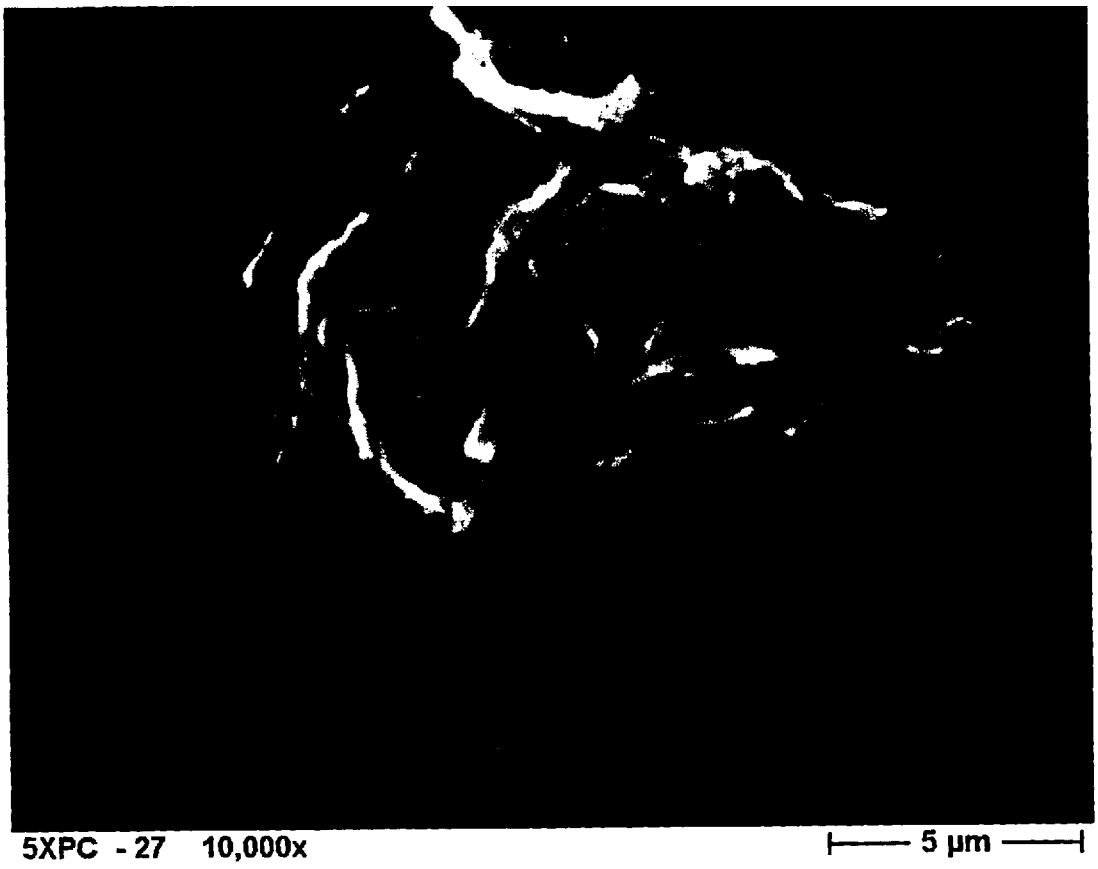
Figure 6:
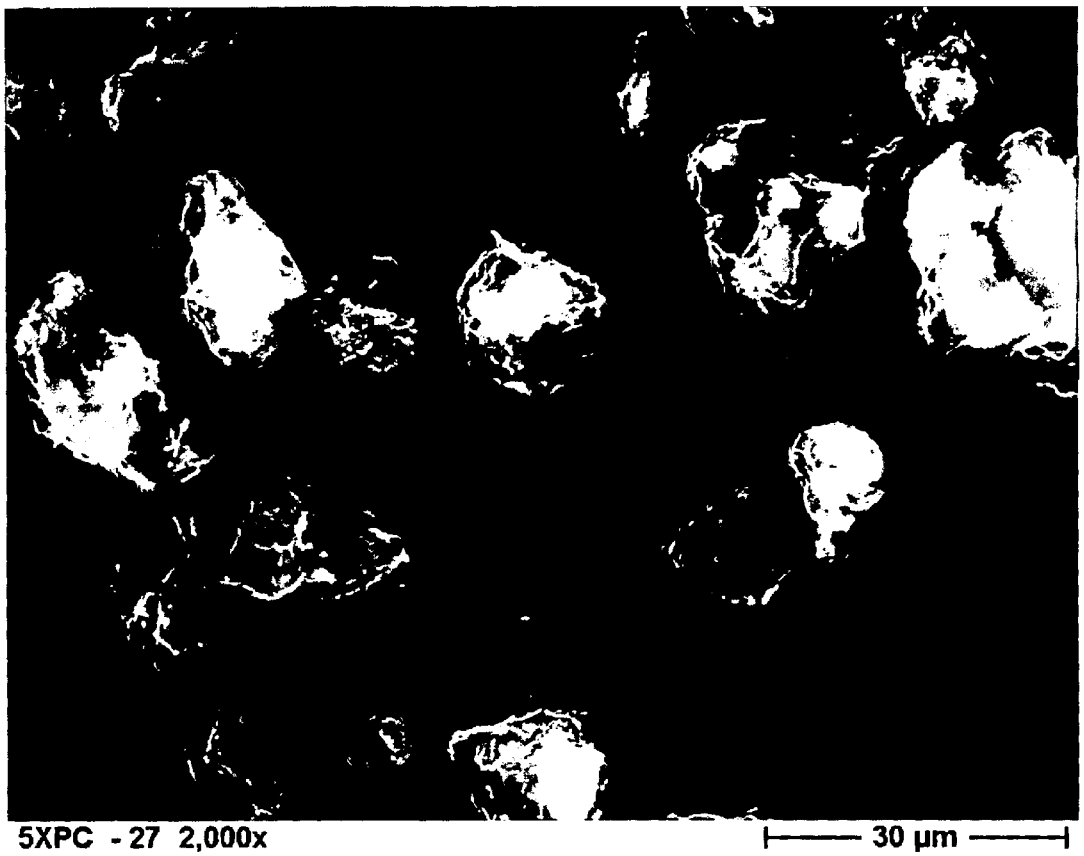

The S.E.M. pictures at 10,000 times and 2000 times are given in FIGS. 5 and 6. As can be seen in the 10,000× magnification photograph, the product is unlike the previous example. The calcium silicate hydrate mixture has fibrous and non-fibrous composition joined possibly by an amorphous portion of silica hydrogel formed during the initial phase of hydro-thermal reaction.

The 2000× magnification indicates the formation of an irregular globular particle formed by the fibrous intergrowth of a series of primary fibrous crystals. The particle size is in the range of 10–30 microns and the crystals seem to have grown randomly.

This multi-phase (primarily Riversideite and Xonotlite) calcium silicate hydrate gave lower brightness value than that of Example 1. More significantly, this material gave a much lower water absorption (around 360%–400%) as well.

To evaluate performance in paper, handsheets were formed using this pigment and then tested as in Example 1. The paper performance results are shown in Tables 2d–g.

This product, compared to pulp only, gave substantially higher stiffness and sheet bulk. Unlike the pigment provided in Example 1, (where Foshagite was the primary component), this second pigment (where Riversideite and Xonotlite are present) combination produced a much more open sheet, as shown by the low Gurley porosity numbers. The optical properties, like brightness, opacity and scattering coefficient of the sheet decreased.

Comparing the performance of this second pigment (with predominantly Riversidite and Xonotlite present) with an alkaline filler, such as precipitated calcium carbonate, the sheet stiffness and bulk improved dramatically. The optical properties (sheet opacity, sheet brightness, etc.) of the handsheets decreased, however. The decreased optical properties of this new multiphase product, were clearly due to the large particle size and irregular globular structure as seen in the S.E.M. pictures.

TABLE 2d

Optical property performance of handsheets containing 20% (interpolated) 5XPC 27 and pulp only.

| Pigment | Brightness (ISO) | Opacity (ISO) | Sheet Scattering Coefficient ($cm^2/g$) | Filler Scattering Coefficient ($cm^2/g$) |
|---|---|---|---|---|
| 5XPC 27 | 87.86 | 83.35 | 449.12 | 1092.42 |
| Pulp Only | 85.19 | 74.97 | 292.1 | N/A |
| Improvement over pulp | +3.1% | +11.2% | +53.8% | — |

TABLE 2e

Strength property performance of handsheets containing 20% (interpolated) 5XPC 27 and pulp only.

| Pigment | Stiffness (Gurley Units) | Bulk ($cm^3/g$) | Porosity (sec/100 cc air) |
|---|---|---|---|
| 5XPC 27 | 225.87 | 2.46 | 3.92 |
| Pulp Only | 136.68 | 1.47 | 33.5 |
| Improvement over pulp | +65.2% | +68.0% | −88.3% |

TABLE 2f

Optical property performance of handsheets containing 20% (interpolated) 5XPC 27 and 20% (interpolated) PCC.

| Pigment | Brightness (ISO) | Opacity (ISO) | Sheet Scattering Coefficient ($cm^2/g$) | Filler Scattering Coefficient ($cm^2/g$) |
|---|---|---|---|---|
| 5XPC 27 | 87.86 | 83.35 | 449.12 | 1092.42 |
| PCC | 90.21 | 89.39 | 738.55 | 2546.03 |
| Improvement over PCC | −2.6% | −6.76% | −39.19% | −57.09% |

TABLE 2g

Strength property performance of handsheets containing 20% (interpolated) of 5XPC 27 and 20% (interpolated) PCC.

| Pigment | Stiffness (Gurley Units) | Bulk ($cm^3/g$) | Porosity (sec/100 cc air) | Tensile Index (Nm/g) |
|---|---|---|---|---|
| 5XPC 27 | 225.87 | 2.46 | 3.92 | 29.67 |
| PCC | 102.11 | 1.65 | 13.23 | 24.77 |
| Improvement over PCC | +121.19% | +49.22% | −70.39% | +19.79% |

Thus, this multiphase combination of calcium silicate hydrate was most useful in improving sheet stiffness and sheet bulk. It was also excellent for "opening up" the sheet (lowering the Gurley porosity) for more "breathing." Due to its excellent stiffness, I refer to this product as "StiSil Brand CSH."

EXAMPLE 3

Varying Reaction Temperature (XPC 119)

Initially, 39.9 grams of pebble lime was weighed accurately and added slowly to 1.2 L of water in a beaker with constant agitation. The amount of lime, water, and the rate of lime addition were controlled in an effort to keep the slurry from boiling due to the exothermic nature of the lime slaking reaction. The slaked lime of $Ca(OH)_2$ was screened in a 200 mesh screen. The residual material was then discarded. The filtered $Ca(OH)_2$ slurry was tested by acidic titration to calculate the exact amount of available lime. The slaked lime was then transferred into a 2 liter autoclave. Then, 31.06 grams of ultrafine, calcined diatomaceous earth was added to 200 ml of water in order to produce a slurry of 0.1553 g/L concentration. This slurry was also preheated with constant stirring and brought to near boiling (near 100° C.). Next, the silica was added to the autoclave containing the hot slaked lime slurry. The total solids concentration of the $CaO+SiO_2$ slurry inside the autoclave, at this point was ~0.5 lbs/gallon. The mol ratio of lime to silica was 1.67 $CaO/SiO_2$. The high-pressure reactor was sealed and then heated by an externally, jacketed, electrical heating element.

The autoclave was simultaneously agitated at a constant speed magnetic drive motor at 600 RPM. The autoclave was heated until a preset temperature of 220° C. was reached. At that point the reaction conditions were held constant by a system controller, RX-32. The $CaO+SiO_2$ slurry was reacted at a temperature of 220° C. for 120 minutes. At the end of this time, the "quenching" water was passed through a cooling system built into the inside of the autoclave. Inside the pressure vessel, steam condensed and the temperature fell rapidly. The cooling water continued until the vessel reached approximately 80° C.

The silicate slurry was transferred into a holding beaker. The following describes the overall heating/cooling cycle (see FIG. 5):

Time to temperature ~100 min

Time at temperature ~120 min

Time for cooling ~25 min

A portion of the slurry was tested for the following properties:

1) X-Ray Diffraction Analysis
2) Scanning Electron Microscope (S.E.M)
3) Brightness
4) Water Absorption
5) Blaine Air Permeability (ASTM/ASTM C204-78a)

Sample Weight (g)—Indication of Bulk Density

Time (in sec) for a fixed volume of air to pass through the volume of sample—Indication of particle packing or structure The reaction conditions and pigment properties are given in Tables 3a and 3b respectively.

EXAMPLE 4

Varying Reaction Temperature (XPC 107)

In this example, all the reaction conditions and parameters were identical to example 3 above, except for the reaction temperature was raised from 220° C. to 233° C. The resultant calcium silicate hydrate complex was then tested as per the above-described test program and the resultant reaction conditions and pigment properties are given in Tables 3a and 3b respectively.

EXAMPLE 5

Varying Reaction Temperature (XPC 124)

In this example, all of the reaction conditions and parameters were kept constant, as in example 3, except for reaction temperature. The reaction temperature was raised from 233° C. to 243° C. The calcium silicate hydrate complex formed was tested as in the above examples. The reaction conditions and pigment properties are given in Tables 3a and 3b respectively.

TABLE 3a

Reaction conditions for Examples 3, 4, and 5.

| Example # | Batch ID | Mole Ratio ($CaO/SiO_2$) | Conc. (lbs/gal) | Temp (degrees C.) | Reaction Time (hours) |
|---|---|---|---|---|---|
| Example 3 | XPC 119 | 1.67 | 0.7 | 220.0 | 2 |
| Example 4 | XPC 107 | 1.67 | 0.7 | 233.0 | 2 |
| Example 5 | XPC 124 | 1.67 | 0.7 | 243.0 | 2 |

TABLE 3b

Pigment properties for Examples 3, 4, and 5.

| Example # | Water Absorption (%) | Brightness (ISO) | Blaine Wt. (grams) | Blaine Time (sec.) | pH |
|---|---|---|---|---|---|
| Example 3 | 440 | 94.2 | 0.5 | 94 | 11.6 |
| Example 4 | 440 | 96.2 | 0.45 | 118.5 | 10.7 |
| Example 5 | 580 | 94.9 | 0.35 | 94.9 | 11.5 |

Note that the mid range reaction temperature of 233° C. produced the highest brightness material

EXAMPLE 6

Varying the $CaO/SiO_2$ mol Ratio (XPC 130)

In this example, all the reaction parameters were kept constant, as in example 4, except for the $CaO/SiO_2$ mol ratio. The $CaO/SiO_2$ mol ratio was changed to 1.4.

Then, 69.0 g of $SiO_2$ and 78.0 g of CaO were mixed to give a $CaO/SiO_2$ mol ratio of 1.4. The two slurries, CaO and $SiO_2$ were mixed in the autoclave. The concentration in the autoclave was adjusted by adding water to 0.7 lb/gal. The reaction was carried out for two hours and the autoclave was cooled and the product was handled as in example 1. The reaction temperature was kept constant at 233° C. The reaction mixture was agitated at a constant speed via a magnetic drive motor attached to the autoclave. The motor was rotated at 600 RPM. The final product was tested for key parameters and the reaction conditions and key pigment properties are shown in Tables 4a and 4b respectively.

EXAMPLE 7

Varying the $CaO/SiO_2$ mol Ratio (XPC 132)

In this example, all the reaction parameters were kept constant as in example 4, except the $CaO/SiO_2$ mol ratio was raised to 1.6. The hydrothermal reaction was carried out using the same cycle of heating and cooling as in the previous examples and the final product was again tested for key pigment properties. The reaction conditions and key pigment properties are shown in Tables 4a and 4b respectively.

EXAMPLE 8

Varying $CaO/SiO_2$ mol Ratio (XPC 134)

Here again, the reaction parameters were all held constant, as in example 4, except for the $CaO/SiO_2$ mol ratio, which was raised to 1.8. The hydrothermal reaction was carried out using the same cycle of heating and cooling as in the previous examples and the final product was again tested for key pigment properties. The reaction conditions and key pigment properties are shown in Tables 4a and 4b respectively.

TABLE 4a

Reaction conditions for Examples 6, 7, and 8.

| Example # | Batch # | Mole Ratio ($CaO/SiO_2$) | Conc. (lbs/gal) | Temp. (degrees C.) | Reaction Time (hours) |
|---|---|---|---|---|---|
| Example 6 | XPC 130 | 1.4 | 0.7 | 233.0 | 2 |
| Example 7 | XPC 132 | 1.6 | 0.7 | 233.0 | 2 |
| Example 8 | XPC 134 | 1.8 | 0.7 | 233.0 | 2 |

TABLE 4b

Pigment properties for Examples 6, 7, and 8.

| Example # | Water Absorption (%) | Brightness (ISO) | Blaine Wt. (grams) | Blaine Time (sec.) | pH |
|---|---|---|---|---|---|
| Example 6 | 380 | 94.7 | 0.45 | 112 | 10.9 |
| Example 7 | 420 | 94.1 | 0.45 | 51.9 | 11.4 |
| Example 8 | 400 | 94.7 | 0.5 | 57.8 | 11.7 |

Note that a $CaO/SiO_2$ mole ratio of 1.6 produced a calcium silicate hydrate with the highest water absorption capability.

EXAMPLE 9

Varying Reaction Time (XPC 172)

In this example, all the process conditions were kept constant, as in example 7, except for the reaction time, which was lowered to 1 hour. The calcium silicate hydrate complex was tested as in the previous examples and the reaction conditions and key pigment properties are shown in Tables 5a and 5b respectively.

EXAMPLE 10

Varying Reaction Time (XPC 173)

In this example, all the process conditions were kept constant, as in example 9, except for the reaction time, which was raised to 2 hours. The calcium silicate hydrate complex was tested as in the previous examples and the reaction conditions and key pigment properties are shown in Tables 5a and 5b respectively.

EXAMPLE 11

Varying Reaction Time (XPC 174)

In this example, all the process conditions were kept constant, as in example 9, except for the reaction time, which was raised to 3 hours. The calcium silicate hydrate complex was tested as in the previous examples and the reaction conditions and key pigment properties are shown in Tables 5a and 5b respectively.

TABLE 5a

Reaction conditions for Examples 9, 10, and 11.

| Example # | Batch # | Mole Ratio ($CaO/SiO_2$) | Conc. (lbs/gal) | Temp. (degrees C.) | Reaction Time (hours) |
|---|---|---|---|---|---|
| Example 9 | XPC 172 | 1.67 | 0.7 | 233.0 | 1 |
| Example 10 | XPC 173 | 1.67 | 0.7 | 233.0 | 2 |
| Example 11 | XPC 174 | 1.67 | 0.7 | 233.0 | 3 |

TABLE 5b

Pigment properties for Examples 9, 10 and 11.

| Example # | Water Absorption (%) | Brightness (ISO) | Blaine Wt. (grams) | Blaine Time (sec.) | PH |
|---|---|---|---|---|---|
| Example 9 | 480 | 92.9 | 0.5 | 74 | 11.1 |
| Example 10 | 520 | 96.1 | 0.45 | 108.5 | 11.0 |
| Example 11 | 600 | 93.3 | 0.4 | 135.0 | 11.2 |

Note that a reaction time of 2 hours produced the highest brightness product. The longer reaction time of 3 hours produced the greatest water absorption values, but at a lower brightness.

EXAMPLE 12

Varying $CaO—SiO_2$ Slurry Concentration (XPC 136)

In this example, all the reaction conditions were kept constant, as in Example 7, except for the $CaO/SiO_2$ slurry concentration, which was lowered to 0.4 lb/gallon. To start, 49.6 g of lime was slaked, screened, and titrated for available CaO. Then, 34.2 g of ultra-fine fluxed calcined diatomaceous earth was slurried. The fluxed calcined diatomaceous earth slurry was added to the lime slurry to give the mixture an initial $CaO/SiO_2$ mol ratio of 1.6. The reactants were then placed in a 2.0 liter autoclave and water was added to bring the final concentration of $CaO+SiO_2$ slurry up to 0.4 lb/gallon. The reaction temperature was set at 233° C. The autoclave was set and controlled using a temperature controller for both heating and cooling cycles as shown in FIG. 9. The silica-lime slurry was reacted at 233° C. for two hours. At the end of the reaction, the resulting calcium silicate hydrate was cooled by circulating water through the jacketed autoclave. The resulting mass was transferred to a holding beaker. The product was tested for the same key parameters and with the same methods as described in example 3. The reaction conditions and key pigment properties are shown in Tables 6a and 6b, respectively.

EXAMPLE 13

Varying $CaO—SiO_2$ Slurry Concentration (XPC 138)

In this reaction, all the reaction parameters were kept constant, as in example 12, except for the $CaO+SiO_2$ slurry concentration, which was raised to 0.6 lb/gallon. The product was tested as in Example 3 and the reaction conditions and key pigment properties are shown in Tables 6a and 6b, respectively.

EXAMPLE 14

Varying CaO—$SiO_2$ Slurry Concentration (XPC 140)

In this reaction, all the reaction parameters were kept constant, as in example 12, except for the CaO+$SiO_2$ slurry concentration, which was raised to 0.8 lb/gallon. The product was tested as in example 3 and the reaction conditions and key pigment properties are shown in Tables 6a and 6b, respectively.

EXAMPLE 15

Varying CaO—$SiO_2$ Slurry Concentration (XPC 141)

In this reaction, all the reaction parameters were kept constant, as in example 12, except for the CaO/$SiO_2$ slurry concentration, which was raised to 0.9 lb/gallon. The product was tested as in example 3 and the reaction conditions and key pigment properties are shown in Tables 6a and 6b, respectively.

TABLE 6a

Reaction conditions for Examples 12, 13, 14, 15.

| Example # | Batch # | Mole Ratio (CaO/$SiO_2$) | Conc. (lbs/gal) | Temp. (degrees C.) | Reaction Time (hours) |
|---|---|---|---|---|---|
| Example 12 | XPC 136 | 1.6 | 0.4 | 233 | 2 |
| Example 13 | XPC 138 | 1.6 | 0.6 | 233 | 2 |
| Example 14 | XPC 140 | 1.6 | 0.8 | 233 | 2 |
| Example 15 | XPC 141 | 1.6 | 0.9 | 233 | 2 |

TABLE 6b

Pigment properties for Examples 12, 13, 14, 15.

| Example # | Water Absorption (%) | Brightness (ISO) | Blaine Wt. (grams) | Blaine Time (sec.) | pH |
|---|---|---|---|---|---|
| Example 12 | 480 | 93.9 | 0.45 | 93.7 | 11.4 |
| Example 13 | 460 | 94.6 | 0.50 | 173.0 | 10.4 |
| Example 14 | 560 | 96.7 | 0.35 | 75.1 | 10.7 |
| Example 15 | 420 | 94.2 | 0.45 | 45.7 | 11.6 |

Note that the slurry concentration of 0.8 lb/gallon produced the highest brightness and the lowest bulk density.

EXAMPLE 16

5XPC 52

In this example, the same procedures described in example 1 were used, except that the siliceous raw material was changed. Instead of using diatomaceous earth, a source of 100% pure silica was used (trade name: Min-U-Sil). The reaction was carried out at a very low CaO—$SiO_2$ slurry concentration of 0.2 lb/gallon. The resultant calcium silicate hydrate complex was tested for the same key pigment properties as in example 1 above. The reaction conditions and key pigment properties are given in Tables 7a and 7b, respectively.

EXAMPLE 17

5XPC 55

In this example, the same procedures described in example 16 were used (including using the pure silica for a siliceous source). The only difference here was that the CaO—$SiO_2$ slurry concentration was raised to 0.4 lb/gallon, and the temperature was kept at 232° C. The calcium silicate hydrate complex formed from this reaction was tested as in example 16 above. The reaction conditions and key pigment properties are given in Tables 7a and 7b.

TABLE 7a

Reaction conditions for Examples 16 and 17.

| Batch # | Mol Ratio (CaO/$SiO_2$) | Conc. (lb/gallon) | Temp. (° C.) | Average Pressure (psi) | Reaction Time (hours) |
|---|---|---|---|---|---|
| 5XPC 52 | 1.31 | .25 | 245 | 490 | 2 |
| 5XPC 55 | 1.31 | .4 | 232 | 387 | 2 |

TABLE 7b

Pigment Properties Examples 16 and 17

| Batch # | G.E. Brightness (% reflectance) | Water Absorption (%) | Air Perm. Blaine Wt. (g) | Air Perm. Blaine time (sec.) |
|---|---|---|---|---|
| 5XPC 52 | 96.2 | 920 | | |
| 5XPC 55 | 95.1 | 840 | | |

EXAMPLE 18

Sodium Silicate (5XPC 57)

In this example, all the reaction procedures were kept constant as in example 1. The only difference was the addition of a different siliceous raw material source. Here, 20 parts of the fluxed calcined diatomaceous earth were replaced by liquid sodium silica $Na_2O$—$SiO_2$ ratio of 1:3 (P.Q. "N" product). The overall CaO/$SiO_2$ mol ratio was kept at 1.31, the concentration of the CaO—$SiO_2$ slurry was kept at 0.5 lb/gallon, and all the other reaction conditions were kept the same as well. This product was also tested according to the procedures in example 1. The reaction conditions and key pigment properties are given in Tables 8a and 8b, respectively.

TABLE 8a

Reaction conditions for Examples 18.

| Batch # | Mol Ratio (CaO/$SiO_2$) | Concentration (lb/gallon) | Temperature (° C.) | Average Pressure (psi) | Reaction Time (hours) |
|---|---|---|---|---|---|
| 5XPC 57 | 1.31 | 0.5 | 245 | 375 | 2 |

TABLE 8b

Pigment Properties Examples 18.

| Batch # | GE Brightness (% reflectance) | Water Absorption (%) | Air Permeability Blaine Wt. (g) | Air Permeability Blaine time (sec.) |
|---|---|---|---|---|
| 5XPC 57 | 97.0 | 680 | 0.35 | 57.5 |

Note that the most significant difference between this product and the previous example is the high brightness values produced.

EXAMPLE 19

TiSil Brand CSH vs. PCC

Application of multi phase calcium silicate hydrate complex comprising predominantly Foshagite, $Ca_4(SiO_3)_3(OH)_2$ and some Xonotlite, $Ca_6Si_6O_{17}(OH)_2$ in paper according to the following process conditions. My novel calcium silicate hydrate complex, referred to as TiSil Brand CSH, was applied in paper handsheets. It was compared to commercial PCC (SMI's Albacar(HO)) and a mixture of PCC and approximately 60 lbs. per ton $TiO_2$. The results of the testing are given in Table 9a and 9b. The graphs showing the performance of TiSil compared to PCC are given in FIGS. 6 through 13. Improvement by TiSil over PCC is given in Tables 9c. TiSil Brand CSH gave the following improvement at 20% ash and equal brightness:

TABLE 9a

Optical property performance of handsheets containing 20% (interpolated) TiSil and 20% (interpolated) PCC.

| Pigment | Brightness (ISO) | Opacity (ISO) | Sheet Scattering Coefficient ($cm^2/g$) | Filler Scattering Coefficient ($cm^2/g$) |
|---|---|---|---|---|
| TiSil | 87.2 | 92.3 | 858.0 | 3065.1 |
| PCC | 90.0 | 89.0 | 716.8 | 2507.0 |

TABLE 9b

Strength property performance of handsheets containing 20% (interpolated) of TiSil and 20% (interpolated) PCC.

| Pigment | Stiffness (Gurley Units) | Bulk ($cm^3/g$) | Porosity (sec/100 cc air) | Tensile Index (Nm/g) |
|---|---|---|---|---|
| TiSil | 135.3 | 1.78 | 47.5 | 30.0 |
| PCC | 113.4 | 1.58 | 26.0 | 29.0 |

TABLE 9c

Handsheet results for TiSil vs. PCC

| | |
|---|---|
| Opacity | +2.13% |
| Scattering Power of sheet | +16.2% |
| Filler Scattering Coefficient | +24% |
| Bulk | +9% |
| Porosity | +220% |
| Stiffness | +38.0% |
| Tensile Strength Index | +22.0% |

The TiSil brand CSH pigment seemed to improve a combination of properties, which were heretofore unattainable. For example, if sheet bulk was improved, sheet porosity would usually drop. In addition, if sheet bulk was obtained by having a larger particle size, optical properties would be significantly reduced. With my novel pigment, it is the unique composition and structure of the pigment that allows improvement in key paper properties like higher bulk and lower porosity.

EXAMPLE 20

TiSil Brand CSH vs. PCC With 60 lb/ton $TiO_2$

In this example, the calcium silicate hydrate from example 1 (5XPC12) was compared with a mixture of SMI's Albacar(HO) containing 60 lb/ton $TiO_2$. The results of the paper testing are placed in Tables 10a and 10b. The graphical representations of the data are given in FIGS. 18 through 25. The improvement TiSil gave over the PCC+$TiO_2$ Mixture (@ 20% ash level and equal brightness) is given in Table 10c.

TABLE 10a

Optical property performance of handsheets containing 20% (interpolated) TiSil and 20% (interpolated) PCC + $TiO_2$ combination.

| Pigment | Brightness (ISO) | Opacity (ISO) | Sheet Scattering Coefficient ($cm^2/g$) | Filler Scattering Coefficient ($cm^2/g$) |
|---|---|---|---|---|
| TiSil | 87.2 | 92.3 | 858.0 | 3065.1 |
| PCC with $TiO_2$ | 90.0 | 89.0 | 716.8 | 2507.0 |

TABLE 10b

Strength property performance of handsheets containing 20% (interpolated) of TiSil and 20% (interpolated) PCC + $TiO_2$ combination.

| Pigment | Stiffness (Gurley Units) | Bulk ($cm^3/g$) | Porosity (sec/100 cc air) | Tensile Index (Nm/g) |
|---|---|---|---|---|
| TiSil | 135.3 | 1.78 | 47.5 | 30.0 |
| PCC with $TiO_2$ | 113.4 | 1.58 | 26.0 | 29.0 |

TABLE 10c

Handsheet results – TiSil vs. PCC + $TiO_2$ combination

| | |
|---|---|
| Opacity | by 0.5% |
| Scattering Power of sheet | by 3.0% |
| Filler Scattering Coefficient | by 4.0% |
| Bulk | by 8.2% |
| Porosity | by 40.0% |
| Stiffness | by 26.0% |
| Tensile | by 221.0% |

Here, TiSil Brand CSH has demonstrated exceptional scattering power for light, an unusual ability to close up the sheet (higher Gurley porosity) and a significant improvement in sheet bulk, stiffness, and tensile index.

EXAMPLE 21

TiSil Brand CSH vs. Bulkite—XPC65

In this example, the pigment of my invention, namely a calcium silicate hydrate complex (Foshagite—Xonotlite complex) was manufactured under the conditions given in Table 11a. The pigment was tested for brightness, water absorption, Blaine, and pH. The results are given in Table 11b. This product was compared as a paper-making pigment with commercially available calcium silicate, (Trade name Bulkite). The graphical representation of the results are given in FIGS. 26–30. The comparison of the two pigments, XPC-65 and Bulkite at 20% ash is given in Table 11c. The improvement over Bulkite at 20% ash (interpolated) is given in Table 11d.

TABLE 11a

Reaction conditions for Example 21.

| Example # | Batch # | Mol Ratio ($CaO/SiO_2$) | Concentration (lb/gallon) | Temperature (° C.) | Reaction Time (hours) |
|---|---|---|---|---|---|
| Example 21 | XPC 65 | 1.67 | 0.71 | 232 | 2 |

TABLE 11b

Pigment properties for Example 21.

| Example # | Water Absorption (%) | Brightness (ISO) | Blaine Wt. (grams) | Blaine Time (sec.) | PH |
|---|---|---|---|---|---|
| Example 21 | 420 | 93.7 | 0.45 | 46.2 | 10.7 |

TABLE 11c

Optical property performance of handsheets containing 20% (interpolated) XPC 65 and Bulkite.

| Pigment | Opacity (ISO) | Sheet Scattering Coefficient ($cm^2/g$) | Filler Scat. Coeff. ($cm^2/g$) | Brightness (ISO) | Porosity (sec/100 cc air) |
|---|---|---|---|---|---|
| XPC - 65 | 90.9 | 845.4 | 3109.6 | 90.0 | 42.4 |
| Bulkite | 84.2 | 460.9 | 1273.4 | 86.4 | 4.9 |

TABLE 11d

Summary of TiSil Improvement over Bulkite

| | |
|---|---|
| Opacity | by 7.2% |
| Scattering Power of sheet | by 83.0% |
| Filler Scattering Coefficient | by 144.0% |
| Brightness | by 4.13% |
| Porosity | by 770.0% |

Once again, this product shows substantially significant improvement over industry standard pigments.

EXAMPLE 22

(XPC 117) Application in Newsprint

In this example, the multi-phase CSH Foshagite—Xonotlite was made by the same procedure as in Example 1, using the process conditions in Table 12a below.

TABLE 12a

Reaction conditions for Example 22.

| Example # | Batch # | Mol Ratio ($CaO/SiO_2$) | Concentration (lb/gallon) | Temperature (° C.) | Reaction Time (hours) |
|---|---|---|---|---|---|
| Example 22 | XPC 117 | 1.67 | 0.67 | 224 | 2 |

The product was tested for brightness, water absorption, Blaine and pH. The results are given in Table 12b.

TABLE 12b

Pigment properties for Example 22.

| Example # | Water Absorption (%) | Brightness (ISO) | Blaine Wt. (grams) | Blaine Time (sec.) | pH |
|---|---|---|---|---|---|
| Example 22 | 470 | 95.3 | 0.45 | 184.7 | 10.6 |

The calcium silicate hydrate complex of this invention was added to newsprint furnish (20% kraft, 80% TMP). To compare the performance of the product of my invention, handsheets were made using commercially available calcium silicate (Hubersil, JM Huber Co.) and a precipitated calcium carbonate (also by JM Huber Co). The newsprint sheets containing these pigments were tested for the following:

Sheet bulk, stiffness, porosity, smoothness, brightness, opacity and several print quality parameters like ink strike through, show through and overall print through. Sheets were also tested for the static coefficient of friction.

The actual values, interpolated to 6% ash, are given in Tables 12c and 12d. A comparison of the product of my invention and Huber's PCC and HuberSil gave the differences shown in Tables 12e and 12f. The corresponding bar graphs at 6.0% interpolated ash are given in FIGS. 31 through 39.

TABLE 12c

Optical property performance of handsheets containing 6% (interpolated) TiSil, HuberSil, and Huber Carbonate.

| Pigment | Normalized Opacity (ISO) | Ink Penetration | Show Through | Print Through |
|---|---|---|---|---|
| TiSil | 86.29 | 1.46 | 4.67 | 6.13 |
| HuberSil | 85.33 | 1.60 | 5.14 | 6.74 |
| Huber Carbonate | 86.75 | 2.46 | 4.79 | 7.24 |

TABLE 12d

Strength property performance of handsheets containing 6% (interpolated) TiSil, HuberSil, and Huber Carbonate.

| Pigment | Porosity (sec/100 cc air) | Tensile Index (Nm/g) | Stiffness (Gurley Units) | Static Coeff. of Friction | Sheet Smoothness (Sheffield Units) |
|---|---|---|---|---|---|
| TiSil | 15.40 | 25.57 | 22.08 | 0.90 | 159.76 |
| HuberSil | 11.93 | 21.95 | 24.31 | 0.90 | 176.02 |
| Huber Carbonate | 11.36 | 25.32 | 18.06 | 0.86 | 164.06 |

TABLE 12e

Summary of Improvement over Huber Carbonate

| | |
|---|---|
| Opacity | −0.53% |
| Ink Penetration | 40% less (better) |
| Show through | 2.0% less (better) |
| Overall print through | 15.0% less (better) |
| Porosity | +35.0% (better) |
| Tensile | even |
| Stiffness | +22% (better) |
| Static coefficient of friction | +5.0% (better) |

A comparison of my new multi-phase CSH products with Huber's calcium silicate gave the following TABLE 12f

| Summary of Improvement over HuberSil | |
|---|---|
| Opacity | +1.1 points |
| Ink Penetration | 9.0% less (better) |
| Show through | 9.0% less (better) |
| Overall print through | 9.0% less (better) |
| Porosity | +29.0% (better) |
| Tensile | +16.0% (better) |
| Shefield smoothness | 10.0% less (better) |

Once again, my multi-phase CSH product gives better paper and printing properties than currently available commercial calcium carbonate and commercial calcium silicate fillers.

During testing of my novel multi-phase calcium silicate hydrate products, conventional industry quality control standards were observed. Brightness was tested by using a GE/TAPPI Brightness Meter, Model S-4. Where applicable, the pH was tested with a pH meter utilizing TAPPI method T-667. Pulp beating was performed using a Valley Beater according to TAPPI Method T-200. Handsheets were produced using a British Handsheet Mold according to TAPPI Method T-205. Handsheet testing was for tensile strength used a one inch strip and otherwise was conducted according to TAPPI method T-220. Where applicable, freeness was tested utilizing a Canadian Standard Freeness tester according to TAPPI standard T-227. Ashing tests were conducted at 500° C. according to TAPPI Method T-211. Air permeability testing was conducted by Blaine, ASTM Method C204. Available lime was measured according to ASTM Method C25. For fine paper testing, a standard pulp slurry was made up of 75% hardwood and 25% softwood. Both pulp sources were beaten separately, in a Valley Beater, to a specific Canadian Standard Freeness of 450±10 in accordance with TAPPI test methods T-200 and T-227. for newsprint testing, a standard newsprint pulp slurry was made up of 20% softwood kraft fibers, and 80% thermo-mechanical pulp. Both pulp sources were received with Canadian Standard Freeness values of 180 csf ±25. This freeness value was deemed sufficient and no further beating was performed on the pulp. For the disintegration of the stock pulp solutions, hot water was added to help relax the pulp fibers and prevent fiber clumps in the final sheet. Handsheets were formed from the above prepared stock, on a 6" British handsheet mold, in accordance with TAPPI test method T-205. However, since the goal of producing these handsheets was to test filler performance, some filler was incorporated into the handsheets at various replacement levels (usually 15%, 20%, and 25%). In order to achieve comparability between different replacement levels, a constant basis weight was achieved via a reduction in fiber content. Thus, a 25% filled sheet contained only 75% of the fiber that the unfilled sheet has. Also, a retention aid was utilized to hold the filler in the sheet until the sheet had dried completely. All other handsheet formation components were kept consistent with TAPPI test method T-205. Handsheets utilizing titanium dioxide in fine paper were similarly formed, except that they required double the amount of retention aid as required by the other fillers. In addition, when $TiO_2$ was added in conjunction with another filler, it was necessary to first add $TiO_2$, then add one dose of retention aid, and then add the filler and a second dose of retention aid. Handsheets formed for newsprint testing were prepared in a similar method to the fine paper handsheets. However, different filler loading levels were utilized and the newsprint sheets were usually loaded at 3%, 6%, and 9% filler. The handsheets were tested in accordance with TAPPI test method T-220, except that a 25.4 mm sample was used and the tensile index calculations were recalculated accordingly. Handsheets were ashed in accordance with TAPPI test method T-211.

In summary, the unique crystalline microfibres produced as a product of the reactions described herein exist, in one unique product, as bundles sized from about 10 to about 40 microns, typically occurring as haystacks or balls. Preferably, individual fibers are about 0.2 microns in the largest cross-sectional dimension, with lengths of up to 4 or 5 microns, so as to have a relatively large L/D ratio.

Importantly, the crystalline microfibers as just described have advantageous properties when utilized as a paper filler, particularly in uncoated groundwood, and in coated groundwood, in uncoated fine paper, and in coated fine paper. The aforementioned adsorptive properties help to adsorb printing ink in the papers. Also, it helps the paper sheet itself to absorb fines, so that it improves overall sheet retention during the papermaking process. Overall, final paper products exhibit improved porosity, improved smoothness, improved bulk, and improved stiffness. Also, brightness and opacity are maintained or improved. Moreover, the printability of the final product is significantly improved, due to the improved ink adsorption.

It is to be appreciated that my unique, light, fluffy adsorptive calcium silicate hydrate products, and the method of producing the same, and the paper products produced using such products, each represent an appreciable improvement in the paper production arts. Although only a few exemplary embodiments of this invention have been described in detail, those skilled in the art may find that the processes described herein, and the products produced thereby, may be modified from those embodiments provided herein, without materially departing from the novel teachings and advantages provided.

It will thus bee seen that the objects set forth above, including those made apparent from the preceding description, are efficiently attained. Since certain changes may be made in carrying out production of the CSH products, and the unique paper products produce therewith, it is to be understood that my invention may be embodied in other specific forms without departing from the spirit or essential characteristics thereof. Many other embodiments are also feasible to attain advantageous results utilizing the principles disclosed herein. Therefor, it will be understood that the foregoing description of representative embodiments of the invention have been presented only for purposes of illustration and for providing an understanding of the invention, and are not intended to be exhaustive or restrictive, or to limit the invention to the precise embodiments disclosed. The intention is to cover all modifications, equivalents, and alternatives falling with the scope and spirit of the invention, as expressed herein above and in the appended claims. As such, the claims are intended to cover the products, processes, methods, and equivalent processes and methods. The scope of the invention, as described herein, is thus intended to included variations from the embodiments provided which are nevertheless described by the broad meaning and range properly afforded to the language herein, and as explained by and in light of the terms included herein, or by the legal equivalents thereof.

APPENDIX 1—LIST OF FIGURES

FIG. 1: FIG. 1 shows the X-ray diffraction pattern for the TiSil brand calcium silicate hydrate.

FIG. 2: FIG. 2 shows the S.E.M. photograph at 10,000 times magnification for the TiSil Brand calcium silicate hydrate.

FIG. 3: FIG. 3 shows the S.E.M. photograph at 2000 times magnification for the TiSil Brand calcium silicate hydrate.

Figure 4:
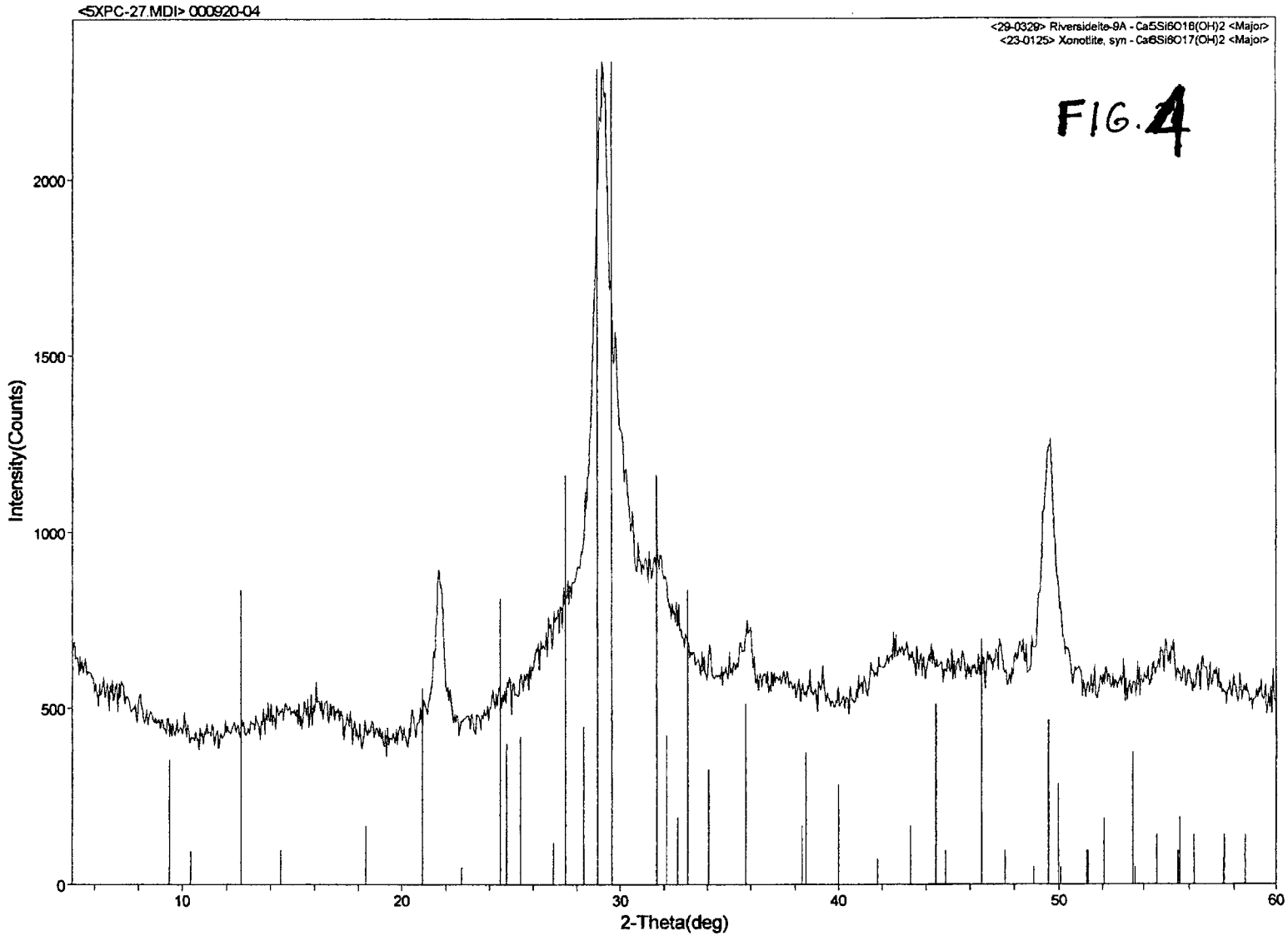

FIG. 4: FIG. 4 shows the X-ray diffraction pattern for the StiSil brand calcium silicate hydrate.

FIG. 5: FIG. 5 shows the S.E.M. photograph at 10,000 times magnification for StiSil Brand calcium silicate hydrate.

FIG. 6: FIG. 6 shows the S.E.M photograph at 2000 times magnification for StiSil Brand calcium silicate hydrate.

FIG. 7: FIG. 7 shows a graphical representation of the solubility of lime in water.

FIG. 8: FIG. 8 shows a graphical representation of the solubility of silica in water.

FIG. 9: FIG. 9 shows a graphical representation of a standard heating/cooling cycle for the reaction process.

FIG. 10: FIG. 10 shows a graphical representation of the brightness results from handsheets containing the TiSil brand calcium silicate hydrate and a commercial PCC.

FIG. 11: FIG. 11 shows a graphical representation of the opacity results from handsheets containing the TiSil brand calcium silicate hydrate and a commercial PCC.

FIG. 12: FIG. 12 shows a graphical representation of the sheet scattering coefficient results from handsheets containing the TiSil brand calcium silicate hydrate and a commercial PCC.

FIG. 13: FIG. 13 shows a graphical representation of the filler scattering coefficient results from handsheets containing the TiSil brand calcium silicate hydrate and a commercial PCC.

FIG. 14: FIG. 14 shows a graphical representation of the sheet stiffness results from handsheets containing the TiSil brand calcium silicate hydrate and a commercial PCC.

FIG. 15: FIG. 15 shows a graphical representation of the sheet bulk results from handsheets containing the TiSil brand calcium silicate hydrate and a commercial PCC.

FIG. 16: FIG. 16 shows a graphical representation of the porosity results from handsheets containing the TiSil brand calcium silicate hydrate and a commercial PCC.

FIG. 17: FIG. 17 shows a graphical representation of the tensile index results from handsheets containing the TiSil brand calcium silicate hydrate and a commercial PCC.

FIG. 18: FIG. 18 shows a graphical representation of the brightness results from handsheets containing the TiSil brand calcium silicate hydrate and a PCC with 60 lb/ton $TiO_2$ mixture.

FIG. 19: FIG. 19 shows a graphical representation of the opacity results from handsheets containing the TiSil brand calcium silicate hydrate and a PCC with 60 lb/ton $TiO_2$ mixture.

FIG. 20: FIG. 20 shows a graphical representation of the sheet scattering coefficient results from handsheets containing the TiSil brand calcium silicate hydrate and a PCC with 60 lb/ton $TiO_2$ mixture.

FIG. 21: FIG. 21 shows a graphical representation of the filler scattering coefficient results from handsheets containing the TiSil brand calcium silicate hydrate and a PCC with 60 lb/ton $TiO_2$ mixture.

FIG. 22: FIG. 22 shows a graphical representation of the sheet stiffness results from handsheets containing the TiSil brand calcium silicate hydrate and a PCC with 60 lb/ton $TiO_2$ mixture.

FIG. 23: FIG. 23 shows a graphical representation of the sheet bulk results from handsheets containing the TiSil brand calcium silicate hydrate and a PCC with 60 lb/ton $TiO_2$ mixture.

FIG. 24: FIG. 24 shows a graphical representation of the porosity results from handsheets containing the TiSil brand calcium silicate hydrate and a PCC with 60 lb/ton $TiO_2$ mixture.

FIG. 25: FIG. 25 shows a graphical representation of the tensile index results from handsheets containing the TiSil brand calcium silicate hydrate and a PCC with 60 lb/ton $TiO_2$ mixture.

FIG. 26: FIG. 26 shows a graphical representation of the opacity results from handsheets containing the TiSil brand calcium silicate hydrate and Bulkite.

FIG. 27: FIG. 27 shows a graphical representation of the sheet scattering coefficient results from handsheets containing the TiSil brand calcium silicate hydrate and Bulkite.

FIG. 28: FIG. 28 shows a graphical representation of the filler scattering coefficient results from handsheets containing the TiSil brand calcium silicate hydrate and Bulkite.

FIG. 29: FIG. 29 shows a graphical representation of the brightness results from handsheets containing the TiSil brand calcium silicate hydrate and Bulkite.

FIG. 30: FIG. 30 shows a graphical representation of the porosity results from handsheets containing the TiSil brand calcium silicate hydrate and Bulkite.

FIG. 31: FIG. 31 shows a graphical representation of the opacity results from newsprint handsheets containing 6% (interpolated) of the TiSil brand calcium silicate hydrate, HuberSil, and Huber Carbonate.

FIG. 32: FIG. 32 shows a graphical representation of the ink penetration results from newsprint handsheets containing 6% (interpolated) of the TiSil brand calcium silicate hydrate, HuberSil, and Huber Carbonate.

FIG. 33: FIG. 33 shows a graphical representation of the show through results from newsprint handsheets containing 6% (interpolated) of the TiSil brand calcium silicate hydrate, HuberSil, and Huber Carbonate.

FIG. 34: FIG. 34 shows a graphical representation of the print through results from newsprint handsheets containing 6% (interpolated) of the TiSil brand calcium silicate hydrate, HuberSil, and Huber Carbonate.

FIG. 35: FIG. 35 shows a graphical representation of the sheet porosity results from newsprint handsheets containing 6% (interpolated) of the TiSil brand calcium silicate hydrate, HuberSil, and Huber Carbonate.

FIG. 36: FIG. 36 shows a graphical representation of the tensile index results from newsprint handsheets containing 6% (interpolated) of the calcium silicate hydrate TiSil, HuberSil, and Huber Carbonate.

FIG. 37: FIG. 37 shows a graphical representation of the sheet stiffness results from newsprint handsheets containing 6% (interpolated) of the calcium silicate hydrate TiSil, HuberSil, and Huber Carbonate.

FIG. 38: FIG. 38 shows a graphical representation of the static coefficient of friction results from newsprint handsheets containing 6% (interpolated) of the TiSil brand calcium silicate hydrate, HuberSil, and Huber Carbonate.

FIG. 39: FIG. 39 shows a graphical representation of the sheet smoothness results from newsprint handsheets containing 6% (interpolated) of the TiSil brand calcium silicate hydrate, HuberSil, and Huber Carbonate.

What is claimed is:

1. A method for improving opacity of paper, said paper manufactured by drying a furnish mixture of an aqueous pulp slurry and at least one preselected filler, said method comprising incorporating into said furnish mixture a preselected filler comprising a multiple phase calcium silicate hydrate comprising a major component comprised of foshagite, and a minor component of xenotlite, said multiple phase mixture (a) having an x-ray diffraction pattern substantially as set forth in Table 1c of the specification, and (b) a fibrous crystalline structure comprising (i) foshagite having (A) a diameter of less than about 0.2 microns, and (B) a length greater than about 1 micron, and (ii) xenotlite particles having (A) a diameter of less than about 0.3 microns, and (B) a length of greater than about 1 micron.

2. The method as set forth in claim 1, wherein said multiple phases calcium silicate hydrate comprises a plurality of stable secondary particles, said stable secondary particles comprising an interlocking structure of primary fibrous crystals.

3. The method as set forth in claim 2, wherein said stable secondary particles comprise a porous haystack like structure of median diameter from about 10 to about 40 microns.

4. The method as set froth in claim 1, wherein in said multiple phase calcium silicate hydrate has a water absorption characteristic of at least 400 percent by weight.

5. The method as set forth in claim 1, wherein said multiple phase calcium silicate hydrate has a water absorption characteristic of at least 800 percent by weight.

6. The method as set forth in claim 1, wherein said multiple phase calcium silicate hydrate has a water absorption characteristic of from about 500 percent to about 1000 percent by weight.

7. The method as set forth in claim 1, wherein the percentage of foshagite is at least seventy (70) percent.

8. The method as set forth in claim 1, wherein the percentage of foshagite is at least eighty (80) percent.

9. The method as set forth in claim 1, wherein the percentage of foshagite is at least ninety (90) percent.

10. The method as set forth in claim 1, wherein said foshagite has a diameter from about 0.1 to about 0.2 microns.

11. The method as set forth in claim 1, wherein said foshagite has a length from about 1 micron to about 5 microns.

12. The method as set forth in claim 1, wherein said xenotlite particles have a diameter from about 0.1 to about 0.3 microns.

13. The method as set forth in claim 1, wherein said xenotlite particles have a length of from about 1 microns to about 3 microns.

14. The method as set forth in claim 1, or in claim 3, wherein said multiple phase calcium silicate hydrate comprises a hydrothermal reaction product of an aqueous suspension of lime and a siliceous material in a CaO to SiO2 mole ratio of between 1.2 to 1 and about 1.7 to 1.

15. The method as set forth in claim 1 or in claim 3, wherein said multiple phase calcium silicate hydrate comprises a hydrothermal reaction product of an aqueous suspension of lime and a siliceous material in a CaO to SiO2 mole ratio of about 1.35 to 1.

16. The method as set forth in claim 1 or in claim 3, wherein said paper has a Gurley porosity, and wherein addition of said multiple phase calcium silicate hydrate to said furnish simultaneously increases said Gurley porosity and said opacity.

17. The method as set forth in claim 16, wherein said paper has a bulk, and wherein addition of said multiple phase calcium silicate hydrate to said furnish simultaneously increases said bulk with said opacity.

18. The method as set forth in claim 16, wherein said paper has a measurable smoothness, and wherein addition of said multiple phase calcium silicate hydrate to said furnish simultaneously increases (a) said measurable smoothness, (b)said bulk, (c) said opacity, and said porosity.

19. The method as set forth in claim 17, wherein said paper has a measurable print show through, and wherein addition of said multiple phase calcium silicate hydrate to said furnish (a) decreases measurable print show throw, and (b) increases (i) said measurable smoothness, (ii) said bulk, and (iii) said opacity.

20. The method as set forth in claim 17, wherein said paper has a measurable sheet stiffness, and wherein addition of said multiple phase calcium silicate hydrate to said furnish increases measurable sheet stiffness.

21. The method as set forth in claim 1, wherein said paper has a brightness, and wherein addition of said multiple phase calcium silicate hydrate to said furnish increases said brightness.

22. The method as set forth in claim 1, wherein said paper has a sheet scattering coefficient, and wherein addition of said multiple phase calcium silicate hydrate to said furnish increases said sheet scattering coefficient.

23. The method as set forth in claim 17, wherein said paper has a sheet tensile index, and wherein addition of said multiple phase calcium silicate hydrate to said furnish increases said sheet tensile index.

24. A method for improving opacity of paper, said paper manufactured by drying a furnish mixture of an aqueous pulp slurry and at least one preselected filler, said method comprising incorporating into said furnish mixture a preselected filler comprising a multiple phase calcium silicate hydrate comprising a major component comprised of foshagite, and a minor component of xenotlite, said multiple phase mixture (a) having an x-ray diffraction pattern substantially as set forth in Table 1c of the specification, and (b) a fibrous crystalline structure comprising (i) foshagite having (A) a diameter of less than about 0.2 microns, and (B) a length greater than about 1 micron, and (ii) xenotlite particles having (A) a diameter of less than about 0.3 microns, and (B) a length of greater than about 1 micron;

(c) a plurality of stable secondary particles, said stable secondary particles comprising an interlocking structure of primary fibrous crystals, wherein said stable secondary particles comprise a porous haystack like structure of median diameter from about 10 to about 40 microns.

25. The method as set forth in claim 24, wherein (a) said paper has a Gurley porosity, and wherein addition of said multiple phase calcium silicate hydrate to said furnish simultaneously increases said Gurley porosity and said opacity; and (b) said paper has a bulk, and wherein addition of said multiple phase calcium silicate hydrate to said furnish simultaneously increases said bulk with said opacity;

(c) said paper has a measurable smoothness, and wherein addition of said multiple phase calcium silicate hydrate to said furnish increases said measurable smoothness; and (d) said paper has a measurable print show through, and wherein addition of said multiple phase calcium silicate hydrate to said furnish decreases measurable print show through; and (e) said paper has a measurable sheet stiffness, and wherein addition of said multiple phase calcium silicate hydrate to said furnish increases measurable sheet stiffness; and (f) said paper has a brightness, and wherein addition of said multiple phase calcium silicate hydrate to said furnish increases said brightness; and (g) said paper has a sheet scattering coefficient, and wherein addition of said multiple phase calcium silicate hydrate to said furnish increases said sheet scattering coefficient;

(h) said paper has a sheet tensile index, and wherein addition of said multiple phase calcium silicate hydrate to said furnish increases said sheet tensile index.

26. The method as set forth in claim 1 or in claim 25, wherein said calcium silicate hydrate has an ISO brightness from about 94 to about 97.

27. A method for improving sheet stiffness of paper, said paper manufactured by drying a furnish mixture of an aqueous pulp slurry and preselected fillers, said method comprising incorporating into said furnish mixture a multiple phase calcium silicate hydrate comprising a major component comprised of riversideite, and a minor component of xenotlite, said multiple phase mixture having (a) an x-ray diffraction pattern substantially as set forth in Table 2c of the specification, and (b) an irregular globular structure having an outside diameter from about 10 to about 30 microns.

28. The method as set forth in claim 27, wherein in said multiple phase calcium silicate hydrate has a water absorption characteristic of at least 250 percent.

29. The method as set forth in claim 27, wherein said multiple phase calcium silicate hydrate has a water absorption characteristic of between 200 and 500 percent.

30. The method as set forth in claim 27, wherein said paper has a measurable stiffness and a measurable bulk, and wherein in said measurable stiffness is simultaneously increased along with said bulk.

31. The method as set forth in claim 27, wherein said paper has a measurable print show through, and wherein in measurable print show through is decreased while simultaneously increasing bulk and stiffness.

* * * * *